US010208372B2

(12) United States Patent
Takahashi et al.

(10) Patent No.: US 10,208,372 B2
(45) Date of Patent: Feb. 19, 2019

(54) GRAIN-ORIENTED ELECTRICAL STEEL SHEET AND MANUFACTURING METHOD THEREOF

(75) Inventors: Fumiaki Takahashi, Tokyo (JP); Yoshiyuki Ushigami, Tokyo (JP); Kazumi Mizukami, Tokyo (JP); Shuichi Nakamura, Tokyo (JP); Norikazu Fujii, Tokyo (JP); Norihiro Yamamoto, Tokyo (JP); Masahide Urago, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 966 days.

(21) Appl. No.: 13/978,925

(22) PCT Filed: Jan. 12, 2012

(86) PCT No.: PCT/JP2012/050502

§ 371 (c)(1), (2), (4) Date: Jul. 10, 2013

(87) PCT Pub. No.: WO2012/096350

PCT Pub. Date: Jul. 19, 2012

(65) Prior Publication Data

US 2013/0292006 A1 Nov. 7, 2013

(30) Foreign Application Priority Data

Jan. 12, 2011 (JP) ..... 2011-004359

(51) Int. Cl.
*C23C 8/02* (2006.01)
*H01F 1/01* (2006.01)
(Continued)

(52) U.S. Cl.
CPC ..... *C23C 8/02* (2013.01); *C21D 8/1255* (2013.01); *C21D 8/1277* (2013.01);
(Continued)

(58) Field of Classification Search
CPC ..... C21D 8/1255; H01F 1/18
(Continued)

(56) References Cited

U.S. PATENT DOCUMENTS 5,082,509 A * 1/1992 Ushigami ..... C21D 8/1255 148/111
5,565,272 A 10/1996 Masui et al.
(Continued)

FOREIGN PATENT DOCUMENTS

EP 1162280 12/2001
EP 1818420 8/2007
(Continued)

OTHER PUBLICATIONS

International Search Report dated Apr. 3, 2012, issued in corresponding PCT Application No. PCT/JP2012/050502.
(Continued)

*Primary Examiner* — Colleen P Dunn
*Assistant Examiner* — Jeremy C Jones
(74) *Attorney, Agent, or Firm* — Birch, Stewart, Kolasch & Birch, LLP

(57) ABSTRACT

A grain-oriented electrical steel sheet being a grain-oriented electrical steel sheet containing Si of 0.8 mass % to 7 mass %, Mn of 0.05 mass % to 1 mass %, B of 0.0005 mass % to 0.0080 mass %, each content of Al, C, N, S, and Se of 0.005 mass % or less, and a balance being composed of Fe and inevitable impurities and having a glass coating film made of composite oxide mainly composed of forsterite on the steel sheet surface, in which when glow discharge optical emission spectrometry (GDS) to the surface of a secondary coating film formed on the surface of the glass coating film under a predetermined condition is performed, a peak, of B, in emission intensity having a peak position in emission intensity different from a peak position, of Mg, in emission
(Continued)

intensity is obtained and the peak position, of B, in emission intensity from the steel sheet surface is deeper than the peak position, of Mg, in emission intensity.

5 Claims, 16 Drawing Sheets

(51) Int. Cl.

| | |
|---|---|
| ***C21D 8/12*** | (2006.01) |
| ***C22C 38/00*** | (2006.01) |
| ***C22C 38/02*** | (2006.01) |
| ***H01F 1/18*** | (2006.01) |
| ***C22C 38/04*** | (2006.01) |
| ***C22C 38/06*** | (2006.01) |
| ***C23C 28/04*** | (2006.01) |
| ***C22C 38/08*** | (2006.01) |
| ***C22C 38/12*** | (2006.01) |
| ***C22C 38/16*** | (2006.01) |
| ***C22C 38/34*** | (2006.01) |
| ***C22C 38/60*** | (2006.01) |
| *C21D 6/00* | (2006.01) |

(52) U.S. Cl.
CPC ..... *C21D 8/1283* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/34* (2013.01); *C22C 38/60* (2013.01); *C23C 28/04* (2013.01); *C23C 28/042* (2013.01); *H01F 1/01* (2013.01); *H01F 1/18* (2013.01); *C21D 6/008* (2013.01); *C21D 2201/05* (2013.01)

(58) Field of Classification Search
USPC ..... 148/208
See application file for complete search history.

(56) References Cited

U.S. PATENT DOCUMENTS

| | | | | |
|---|---|---|---|---|
| 5,885,371 | A | 3/1999 | Komatsubara et al. | |
| 6,103,022 | A | 8/2000 | Komatsubara et al. | |
| 6,451,128 | B1 * | 9/2002 | Lee | C21D 3/04 148/111 |
| 7,399,369 | B2 | 7/2008 | Nanba et al. | |
| 7,727,644 | B2 * | 6/2010 | Watanabe | C21D 8/12 148/111 |
| 8,366,836 | B2 | 2/2013 | Komatsubara et al. | |
| 2002/0157734 | A1 * | 10/2002 | Senda | C21D 8/1266 148/111 |
| 2010/0055481 | A1 * | 3/2010 | Kubo | C21D 8/1266 428/471 |
| 2010/0300583 | A1 * | 12/2010 | Abbruzzese | C21D 8/12 148/208 |
| 2012/0103474 | A1 | 5/2012 | Ushigami et al. | |

FOREIGN PATENT DOCUMENTS

| | | | | |
|---|---|---|---|---|
| EP | 2096185 | A1 * | 9/2009 | C21D 8/1266 |
| EP | 2455497 | | 5/2012 | |
| EP | 2455498 | | 5/2012 | |
| JP | 60-55570 | | 12/1985 | |
| JP | 06-17261 | | 1/1994 | |
| JP | 07-207424 | | 8/1995 | |
| JP | 10-140243 | | 5/1998 | |
| JP | 10-324959 | | 12/1998 | |
| JP | 11-269544 | | 10/1999 | |
| JP | 2000-503726 | | 3/2000 | |
| JP | 2000-129352 | | 5/2000 | |
| JP | 2000-204450 | | 7/2000 | |
| JP | 2000-282142 | | 10/2000 | |
| JP | 2002-348611 | | 12/2002 | |
| JP | 2003-027196 | | 1/2003 | |
| JP | 2004-076143 | | 3/2004 | |
| JP | 2008-001977 | | 1/2008 | |
| JP | 4709949 | | 6/2011 | |
| WO | WO 99/02742 | | 1/1999 | |
| WO | 2011/007771 | | 1/2011 | |

OTHER PUBLICATIONS

International Preliminary Report on Patentability dated Jul. 25, 2013 issued in corresponding PCT Application No. PCT/JP2012/050502.

Search Report dated Jun. 30, 2014 issued in corresponding European Application No. 12734045.3.

* cited by examiner

GRAIN-ORIENTED ELECTRICAL STEEL SHEET AND MANUFACTURING METHOD THEREOF

TECHNICAL FIELD

The present invention relates to a manufacturing method for improving a coating film property and a magnetic property of a grain-oriented electrical steel sheet. This application is a national stage application of International Application No. PCT/JP2012/050502, filed on Jan. 12, 2012, which claims priority to Japanese Patent Application No. 2011-4359, filed on Jan. 12, 2011, the entire contents of which are incorporated herein by reference.

BACKGROUND ART

A grain-oriented electrical steel sheet is mainly used for a transformer core material for electric power and thus is required to be low in core loss. In a manufacturing method of a grain-oriented electrical steel sheet, a cold-rolled steel sheet having a final sheet thickness is subjected to decarburization annealing, and then is subjected to finish annealing aimed at secondary recrystallization and purification, and then is subjected to a process of forming a coating film on the steel sheet surface. The grain-oriented electrical steel sheet obtained in this manner is composed of a Si containing steel sheet having a sharp (110)[001] texture (Goss orientation) and a several micron inorganic coating film formed on the surface. The steel sheet has the Goss orientation, which is an essential condition for achieving a low core loss property of the grain-oriented electrical steel sheet, and for making this structure, grain growth called secondary recrystallization in which Goss oriented grains selectively grow during finish annealing is used.

For stably causing the secondary recrystallization, in the grain-oriented electrical steel sheet, fine precipitates in the steel called inhibitors are used. The inhibitor suppresses the grain growth in a low-temperature portion during finish annealing and at a certain temperature or higher, loses its pinning effect by decomposition or coarsening to cause the secondary recrystallization, and sulfide or nitride is generally used. For obtaining the desirable structure, it is necessary to keep the inhibitor up to a certain temperature, and if being sulfide, a sulfur component partial pressure in the finish annealing is controlled, and if being nitride, a nitrogen partial pressure is controlled or the like, and thereby the object of the desirable structure is accomplished. Sulfide and nitride used as the inhibitor are needed for the secondary recrystallization to occur in the middle of increasing the temperature during the finish annealing, but when they are retained in a product, they significantly deteriorate a core loss of the product. In order to remove an effect of sulfide and nitride from the steel sheet, after the secondary recrystallization is completed, the steel sheet is retained for a long time in pure hydrogen at around 1200° C. This is referred to as purification annealing. Thus, in the purification annealing, the steel sheet is in a state of being retained at a high temperature during the finish annealing.

On the other hand, the coating film of the grain-oriented electrical steel sheet is composed of a glass coating film and a secondary coating film, and by tension that these coating films apply to the steel sheet, a magnetic domain control effect is obtained and the low-core loss property is improved. As described in Patent Literature 1, if this tension is high, a core loss improving effect is high, and thus the secondary coating film in particular is required to have capability of generating high tension.

Generally, at the time of finish annealing, $SiO_2$ in the steel sheet and MgO of an annealing separating agent main component react and thereby the glass coating film is formed on the steel sheet. The glass coating film has two functions. As the first function, the glass coating film tightly adheres to the steel sheet and the glass coating film itself has an effect of applying tension to the steel sheet and works as an intermediate layer to secure adhesiveness to the steel sheet when the secondary coating film to be formed in a process after the finish annealing is formed. When the adhesiveness of the glass coating film is good, the secondary coating film to generate high tension can be formed, and thus by the higher magnetic domain control effect, the low core loss can be achieved. Further, as the second function, the glass coating film has a function of preventing an excessive reduction in strength by the inhibitor during the finish annealing and stabilizing the secondary recrystallization. Thus, in order to stably manufacture a grain-oriented electrical steel sheet having a good magnetic property, the glass coating film having good adhesiveness to the steel sheet is required to be formed.

In order to improve the adhesiveness between the glass coating film and the steel sheet in the grain-oriented electrical steel sheet, it is necessary to optimize an interface structure between the glass coating film and the steel sheet. However, in a conventional grain-oriented electrical steel sheet, the sufficient adhesiveness is not necessarily secured when tension higher than ever before is desired to be applied, or the like.

CITATION LIST

Patent Literature

Patent Literature 1: Japanese Laid-open Patent Publication No. 07-207424

Patent Literature 2: Japanese Laid-open Patent Publication No. 2003-27196

Patent Literature 3: Japanese Laid-open Patent Publication No. 2004-76143

Patent Literature 4: Japanese Laid-open Patent Publication No. 2000-204450

Patent Literature 5: Japanese Laid-open Patent Publication No. 06-17261

Patent Literature 6: International Publication Pamphlet No. WO2011/7771

Patent Literature 7: Japanese Examined Patent Application Publication No. 60-55570

Patent Literature 8: Japanese Laid-open Patent Publication No. 2008-1977

SUMMARY OF INVENTION

Technical Problem

An object of the present invention is to provide a grain-oriented electrical steel sheet capable of forming a coating film to generate high tension, having a glass coating film excellent in coating film adhesiveness, and having a good magnetic property, and a manufacturing method thereof.

Solution to Problem

The gist of the present invention is as follows.

(1) A grain-oriented electrical steel sheet being a grain-oriented electrical steel sheet containing Si of 0.8 mass % to 7 mass %, Mn of 0.05 mass % to 1 mass %, B of 0.0005 mass % to 0.0080 mass %, each content of Al, C, N, S, and Se of 0.005 mass % or less, and a balance being composed of Fe and inevitable impurities and having a glass coating film made of composite oxide mainly composed of forsterite on the steel sheet surface, in which when on a condition that a secondary coating film having a thickness of not less than 1 μm nor more than 2 μm and formed in a manner that a coating solution containing 26 to 38 mass % of colloidal silica, 4 to 12 mass % of one type or two types selected from a group consisting of chromic anhydride and chromate, and a balance being composed of aluminum biphosphate is applied and dried and then is baked at 800° C. to 900° C. is formed on the surface of the glass coating film, glow discharge optical emission spectrometry (GDS) to the surface of the secondary coating film is performed, a peak, of B, in emission intensity having a peak position in emission intensity different from a peak position, of Mg, in emission intensity is obtained and the peak position, of B, in emission intensity from the steel sheet surface is deeper than the peak position, of Mg, in emission intensity, and further, out of the peaks, of B, in emission intensity observed by the glow discharge optical emission spectrometry (GDS), a peak occurrence time tB of the peak that is the farthest from the steel sheet surface is expressed by Expression (1) below.

$$tMg \times 1.6 \leq tB \leq tMg \times 5 \quad (1)$$

Here, tMg represents a peak occurrence time of Mg.

(2) A manufacturing method of a grain-oriented electrical steel sheet, includes:

at a predetermined temperature, heating an electrical steel sheet material containing Si of 0.8 mass % to 7 mass %, acid-soluble Al of 0.01 mass % to 0.065 mass %, N of 0.004 mass % to 0.012 mass %, Mn of 0.05 mass % to 1 mass %, B of 0.0005 mass % to 0.0080 mass %, at least one type selected from a group consisting of S and Se of 0.003 mass % to 0.015 mass % in total amount, a C content of 0.085 mass % or less, and a balance being composed of Fe and inevitable impurities;

performing hot rolling of the heated silicon steel material to obtain a hot-rolled steel strip;

performing annealing of the hot-rolled steel strip to obtain an annealed steel strip;

performing cold rolling of the annealed steel strip one time or more to obtain a cold-rolled steel strip;

performing decarburization annealing of the cold-rolled steel strip to obtain a decarburization-annealed steel strip in which primary recrystallization has been caused;

applying an annealing separating agent having MgO as its main component on the decarburization-annealed steel strip;

finish annealing the decarburization-annealed steel strip and thereby causing secondary recrystallization; and further performing a nitriding treatment in which an N content in the decarburization-annealed steel strip is increased between start of the decarburization annealing and occurrence of the secondary recrystallization in the finish annealing, in which the predetermined temperature, when S and Se are contained in the silicon steel material, is a temperature T1 (° C.) expressed by Expression (2) below or lower, a temperature T2 (° C.) expressed by Expression (3) below or lower, and a temperature T3 (° C.) expressed by Expression (4) below or lower, when no Se is contained in the silicon steel material, the predetermined temperature is the temperature T1 (° C.) expressed by Expression (2) below or lower and the temperature T3 (° C.) expressed by Expression (4) below or lower, when no S is contained in the silicon steel material, the predetermined temperature is the temperature T2 (° C.) expressed by Expression (3) below or lower and the temperature T3 (° C.) expressed by Expression (4) below or lower, and a finishing temperature Tf of finish rolling in the hot rolling satisfies Expression (5) below, amounts of BN, MnS, and MnSe in the hot-rolled steel strip satisfy Expressions (6), (7), and (8) below, and at the time of finish annealing, a temperature falls within a temperature range of 800° C. to 1100° C. and an atmosphere satisfies Expressions (9) and (10) below.

$$T1 = 14855/(6.82 - \log([Mn] \times [S])) - 273 \quad (2)$$

$$T2 = 10733/(4.08 - \log([Mn] \times [Se])) - 273 \quad (3)$$

$$T3 = 16000/(5.92 - \log([B] \times [N])) - 273 \quad (4)$$

$$Tf \leq 1000 - 10000 \times [B] \quad (5)$$

$$B_{asBN} \geq 0.0005 \quad (6)$$

$$[B] - B_{asBN} \leq 0.001 \quad (7)$$

$$S_{asMnS} + 0.5 \times Se_{asMnSe} \geq 0.002 \quad (8)$$

$$0.75 \geq P_{N2} \geq 0.2 \quad (9)$$

$$-0.7 \geq \mathrm{Log}\ [P_{H2O}/P_{H2}] \quad (10)$$

Here, [Mn] represents the Mn content (mass %) of the silicon steel material, [S] represents the S content (mass %) of the silicon steel material, [Se] represents the Se content (mass %) of the silicon steel material, [B] represents the B content (mass %) of the silicon steel material, [N] represents the N content (mass %) of the silicon steel material, $B_{asBN}$ represents an amount of B (mass %) that has precipitated as BN in the hot-rolled steel strip, $S_{asMnS}$ represents an amount of S (mass %) that has precipitated as MnS in the hot-rolled steel strip, and $Se_{asMnSe}$ represents an amount of Se (mass %) that has precipitated as MnSe in the hot-rolled steel strip. Further, $P_{N2}$ represents a nitrogen partial pressure, and $P_{H2O}$ and $P_{H2}$ represent a water vapor partial pressure and a hydrogen partial pressure respectively.

(3) The manufacturing method of the grain-oriented electrical steel sheet according to the previous clause (2), in which the temperature at the time of finish annealing falls within the temperature range of 800° C. to 1100° C. and the atmosphere at the time of finish annealing satisfies (11) Expression.

$$4\ \mathrm{Log}\ [P_{N2}] = 3\ \mathrm{Log}\ [P_{H2O}/P_{H2}] + A + 3455/T \quad (11)$$

Here, $-3.72 \geq 3\ \mathrm{Log}\ [P_{H2O}/P_{H2}] + A \geq -5.32$ and $-0.7 \geq \mathrm{Log}\ [P_{H2O}/P_{H2}]$ are satisfied and A represents a constant determined in such a manner that $3\ \mathrm{Log}\ [P_{H2O}/P_{H2}] + A$ falls within a predetermined range according to $\mathrm{Log}\ [P_{H2O}/P_{H2}]$, and T represents the absolute temperature.

(4) The manufacturing method of the grain-oriented electrical steel sheet according to the previous clause (2), in which at the time of finish annealing, an atmosphere at 1100° C. or higher satisfies (12) Expression and (13) Expression.

$$0.1 \geq P_{N2} \quad (12)$$

$$-2 \geq \mathrm{Log}\ [P_{H2O}/P_{H2}] \quad (13)$$

(5) The manufacturing method of the grain-oriented electrical steel sheet according to the previous clause (2), in which the electrical steel sheet material further contains at least one type selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

Advantageous Effects of Invention

According to the present invention, it is possible to obtain a grain-oriented electrical steel sheet capable of forming coating films to generate high tension, having a glass coating film excellent in coating film adhesiveness, and having a good magnetic property.

DESCRIPTION OF EMBODIMENTS

Conventionally, B has been used as an additive of an annealing separating agent of a grain-oriented electrical steel sheet, but the present inventors found that in the case of B being added into a steel sheet, there is sometimes a case that coating film adhesiveness is improved together with a magnetic property. Then, as a result of a detailed examination of a sample exhibiting good properties, it became clear that there are characteristics in distribution of B in an interface between a glass coating film and a steel sheet. That is, it was found that an interface structure between the glass coating film and the steel sheet is optimized, thereby making it possible to improve the magnetic property and the coating film adhesiveness. This interface structure includes the following characteristics. That is, in a grain-oriented electrical steel sheet containing, as an entire steel sheet, Si of 0.8 mass % to 7 mass %, Mn of 0.05 mass % to 1 mass %, B of 0.0005 mass % to 0.0080 mass %, each content of Al, C, N, S, and Se of 0.005 mass % or less, and a balance being composed of Fe and inevitable impurities, a layer made of composite oxide mainly composed of forsterite is provided on the steel sheet surface.

Figure 1:
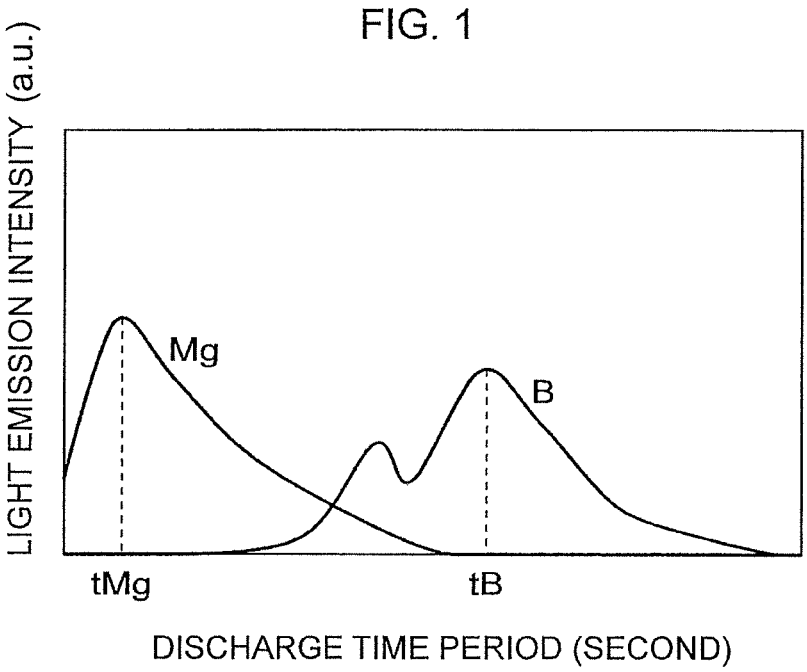
FIG. 1 is a view showing a schematic dialog of a result of glow discharge optical emission spectrometry (GDS) of a surface of a grain-oriented electrical steel sheet.

The meaning that it is mainly composed of forsterite here indicates that forsterite occupies 70% by weight or more of a constituent of a coating film as a forming compound of the coating film. Then, it is characterized in that when glow discharge optical emission spectrometry (GDS) to the steel sheet surface is performed, a peak, of B, in emission intensity is obtained at a position different from a peak position of Mg and the position of the peak from the steel sheet surface is deeper than that of Mg. Concretely, as shown in FIG. 1, it is characterized in that out of the peaks of B observed by the GDS, the distance from the surface to the peak that is the farthest from the steel sheet surface is a certain distance or more from the peak position of Mg.

Figure 32:
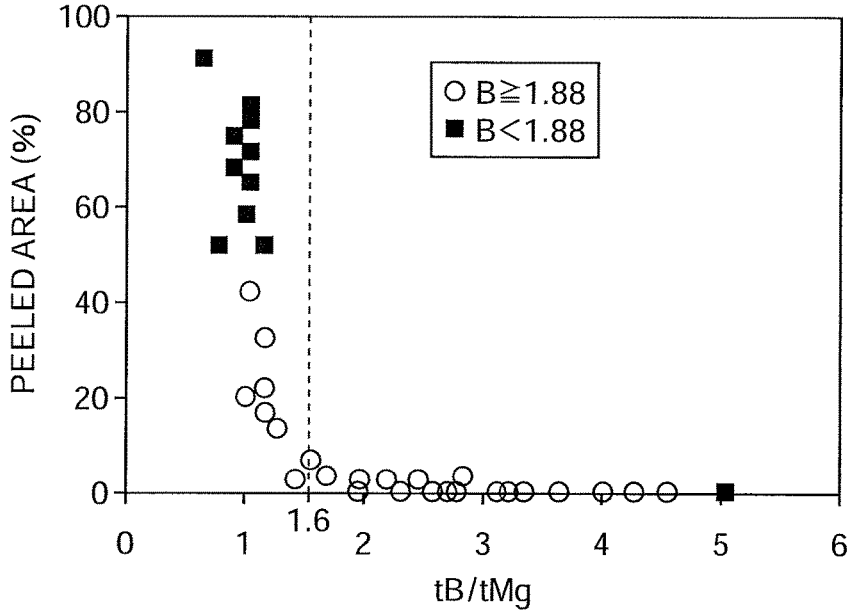
FIG. 32 is a view showing the relationship between a ratio tB/tMg of a GDS analysis result and the coating film adhesiveness.

This peak of Mg was examined on samples made under various conditions of the following first experiment and the relationship with the adhesiveness was examined, and thereby results shown in FIG. 32 were obtained. Here, the peak position of Mg was set to tMg, and out of the peaks of B, the position of the peak positioned in the deepest portion from the steel sheet surface was set to tB. Further, in FIG. 32, with regard also to the magnetic property, results arranged according to a ratio tB/tMg of values tMg and tB are shown. Incidentally, FIG. 32 shows that as a peeled area is smaller, the adhesiveness is improved.

As shown in FIG. 32, it is found that when $tB \geq tMg \times 1.6$ is satisfied, the peeled area of the coating film is 5% or less, which is minor, and the adhesiveness is improved. On the other hand, the magnetic property is also improved when the value tB is large, but when the value tB is too large, there is also a case that the magnetic property rather deteriorates, and thus the ratio tB/tMg is set to 5 or less.

Incidentally, when the values tB and tMg are measured by the GDS, the measurement is performed in a manner that the thickness of a secondary coating film on a glass coating film is set to a certain condition. For example, when a secondary coating film having a thickness of not less than 1 μm nor more than 2 μm and formed in a manner that a coating solution containing 26 to 38% by weight of colloidal silica, 4 to 12 mass % of one type or two types selected from a group consisting of chromic anhydride and chromate, and a balance being composed of aluminum biphosphate is applied and dried and then is baked at 800° C. to 900° C. is formed, the values tB and tMg can be measured by the GDS without change. However, when the composition and thickness of the secondary coating film are unclear, the secondary coating film is removed by an aqueous sodium hydroxide solution or the like to expose the surface of the glass coating film, and then, as described above, a secondary coating film having a thickness of not less than 1 μm nor more than 2 μm and formed in a manner that a coating solution containing 26 to 38% by weight of colloidal silica, 4 to 12 mass % of one type or two types selected from a group consisting of chromic anhydride and chromate, and a balance being composed of aluminum biphosphate is applied and dried and then is baked at 800° C. to 900° C. is formed, and in such a state, the values tb and tMg are measured by the GDS. The secondary coating film in such a composition range and in such a thickness range is formed, thereby making it possible to measure the values tB and tMg with sufficient accuracy.

From this result, an electrical steel sheet is characterized in that the peak position of Mg is expressed by (1) Expression when in the event that the GDS analysis is performed from the surface of the glass coating film, the peak position, of B, of concentration in the deepest portion is expressed by a discharge time, each of the peak positions of B is set to tB (second), and the peak position of Mg is set to tMg (second).

$$tMg \times 1.6 \leq tB \leq tMg \times 5 \quad (1)$$

Almost all Mg is derived from the glass coating film. Thus, in the event that the secondary coating film is thick, as the peak position of Mg changes, the peak position of B changes. In order to avoid this effect, in the present invention, the thickness of the secondary coating film at the time of GDS measurement is defined. Further, when a large amount of Mg is contained in the secondary coating film of a product sheet, the peak of Mg derived from the glass coating film becomes unclear. Therefore, in order to evaluate (1) Expression, the value measured after the secondary coating film is removed is needed to be used. Incidentally, the definitions of thickness, composition, and forming conditions of the secondary coating film are pretreatment conditions where the GDS measurement is performed, and the states of the secondary coating film and the like of the product sheet are not defined.

In order to make the structure determined in (1) Expression, as described in (3) described previously, components such as Si may be defined and this electrical steel sheet material may be treated at a predetermined temperature, or the methods described in (4) and (5) described previously may also be followed.

First Experiment

The contents of tests leading to obtaining of the knowledge as above will be described below. First, with regard to the relationship between precipitates and a magnetic property and coating film adhesiveness, tests to examine a silicon steel material having a composition containing S were performed.

First, various silicon steel slabs each containing Si: 3.3 mass %, C: 0.06 mass %, acid-soluble Al: 0.027 mass %, N: 0.008 mass %, Mn: 0.05 mass % to 0.19 mass %, S: 0.007 mass %, and B: 0.0010 mass % to 0.0035 mass %, and a balance being composed of Fe and inevitable impurities were obtained. Next, the silicon steel slabs were heated at a temperature of 1100° C. to 1250° C. and ware subjected to hot rolling. In the hot rolling, rough rolling was performed at 1050° C. and then finish rolling was performed at 1000° C., and thereby hot-rolled steel strips each having a thickness of 2.3 mm were obtained. Then, a cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and cold-rolled steel strips each having a thickness of 0.22 mm were obtained. Thereafter, the cold-rolled steel strips were heated at a speed of 15° C./s, and were subjected to decarburization annealing at a temperature of 840° C., and decarburization-annealed steel strips were obtained. Subsequently, the decarburization-annealed steel strips were annealed in an ammonia containing atmosphere to increase nitrogen in the steel strips up to 0.022 mass %. Next, an annealing separating agent having MgO as its main component was applied on the steel strips and finish annealing was performed. With regard to the atmosphere of the finish annealing, of the atmosphere from 800° C. to 1100° C., a nitrogen partial pressure $P_{N2}$ was set to 0.5 and an oxygen potential Log $[P_{H2O}/P_{H2}]$ was set to −1.0, and of the atmosphere at 1100° C. or higher, the nitrogen partial pressure $P_{N2}$ was set to 0.1 or less and the oxygen potential Log $[P_{H2O}/P_{H2}]$ was set to −2 or less, and various samples were manufactured.

Figure 2:
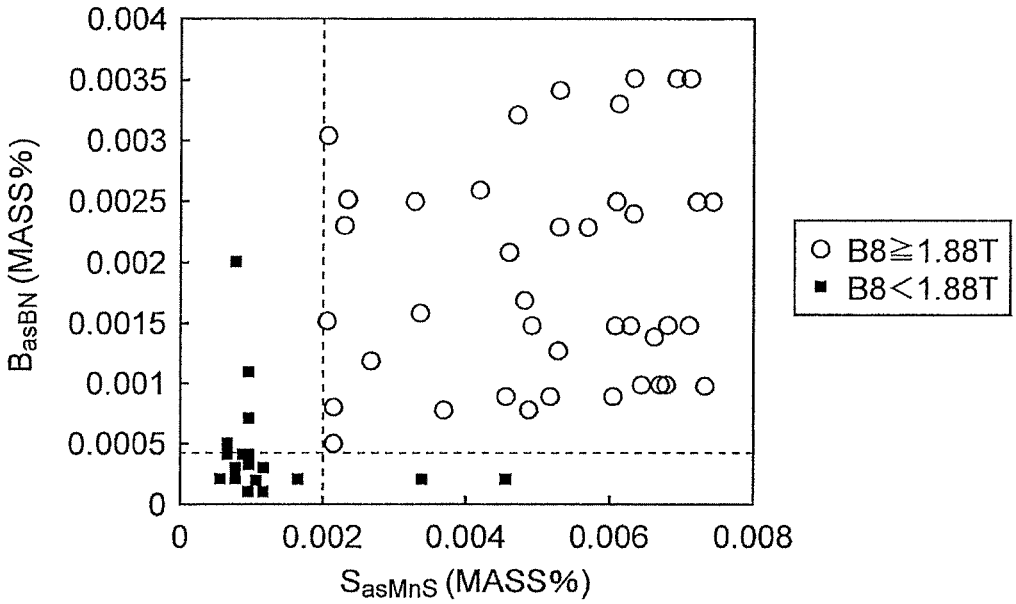
FIG. 2 shows the relationship between precipitate amounts in a hot-rolled steel strip and a magnetic property after finish annealing.

Then, the relationship between precipitates in the hot-rolled steel strip and a magnetic property after the finish annealing was examined. This result is shown in FIG. 2. The vertical axis indicates a value (mass %) obtained by converting a precipitation amount of BN into B. The horizontal axis corresponds to an amount of S that has precipitated as MnS (mass %). Further, white circles each indicate that a magnetic flux density B8 was 1.88 T or more, and black squares each indicate that the magnetic flux density B8 was less than 1.88 T. As shown in FIG. 2, in the samples each having the precipitation amount of MnS or BN being less than a certain value, the magnetic flux density B8 was low. This indicates that secondary recrystallization was unstable.

Figure 3:
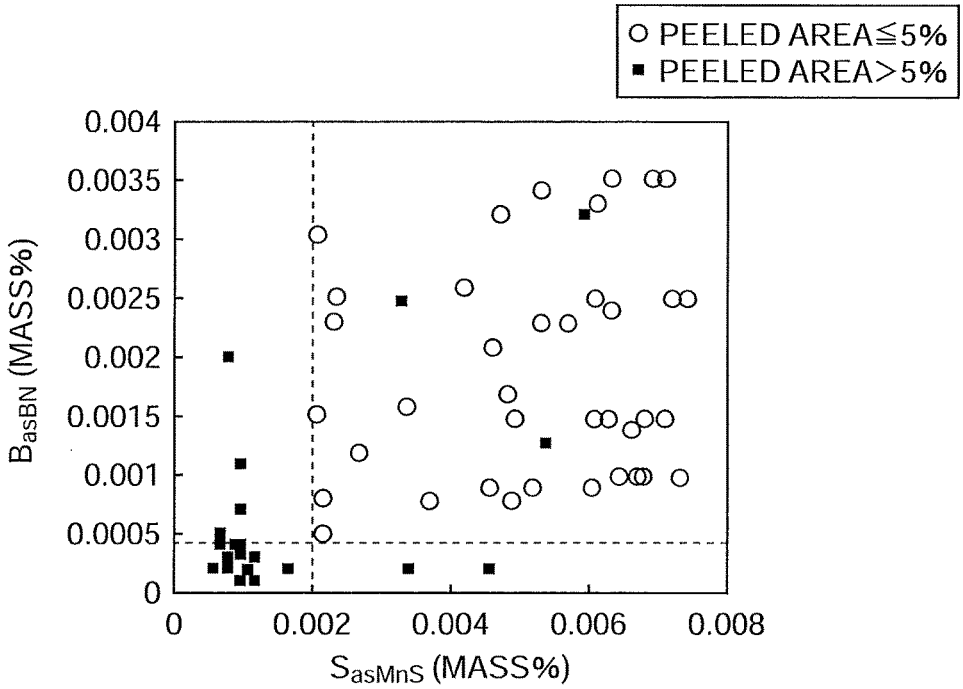
FIG. 3 is a view showing the relationship between the precipitate amounts in the hot-rolled steel strip and coating film adhesiveness after the finish annealing.

On the other hand, the relationship between the state of precipitates and coating film adhesiveness after the finish annealing was examined. In order to make an adhesiveness improving effect clear, an evaluation was performed with a secondary coating film amount larger than a normal areal weight. When the areal weight of a secondary coating film is increased, high tension is applied to a steel sheet, and if the adhesiveness of a glass coating film is not sufficient, coating film peeling occurs easily. For this test, as the secondary coating film, first, a coating solution containing 100 g of aluminum phosphate having a solid content concentration of 50%, 102 g of colloidal silica having a solid content concentration of 20%, and 5.4 g of chromic anhydride was made. Then, this coating solution was applied on a steel sheet having a glass coating film obtained after the finish annealing to be 10 g/m$^2$ per one side and was dried, and then was baked at 900° C. This steel sheet was wound around a round bar having 20ϕ, and then when a peeled area of the coating film to expose the steel sheet on the inner side of the bent portion was 5% or less, the adhesiveness was determined to be good. This result is shown in FIG. 3. In FIG. 3, white circles each indicate one having good adhesiveness, and black squares each indicate one having coating film peeling and having adhesiveness substantially equal to that of a conventional one. As shown in FIG. 3, in the samples each having the precipitation amounts of MnS and BN being certain values or more, the improvement of the coating film adhesiveness is confirmed.

Figure 4:
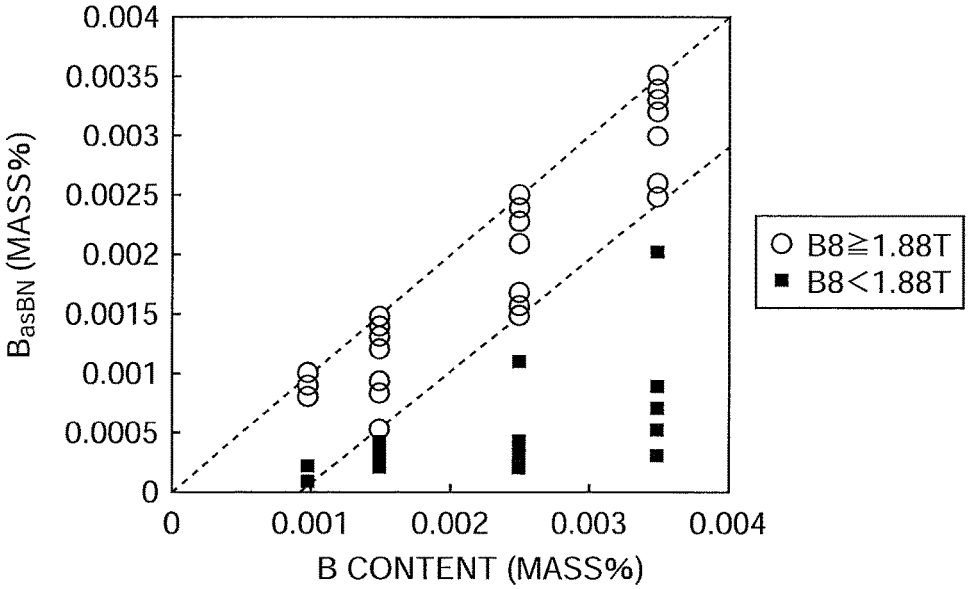
FIG. 4 is a view showing the relationship between an amount of B that has not precipitated as BN and the magnetic property after the finish annealing.

Further, with regard to the samples in which certain amounts or more of MnS and BN are precipitated, the relationship between an amount of B that has not precipitated as BN and the magnetic property after the finish annealing was examined. This result is shown in FIG. 4. In FIG. 4, the horizontal axis indicates the B content (mass %), and the vertical axis indicates the value (mass %) obtained by converting the precipitation amount of BN into B. Further, white circles each indicate that the magnetic flux density B8 was 1.88 T or more, and black squares each indicate that the magnetic flux density B8 was less than 1.88 T. As shown in FIG. 4, in the samples in which the amount of B that has not precipitated as BN is a certain value or more, the magnetic flux density B8 was low. This indicates that the secondary recrystallization was unstable.

Figure 5:
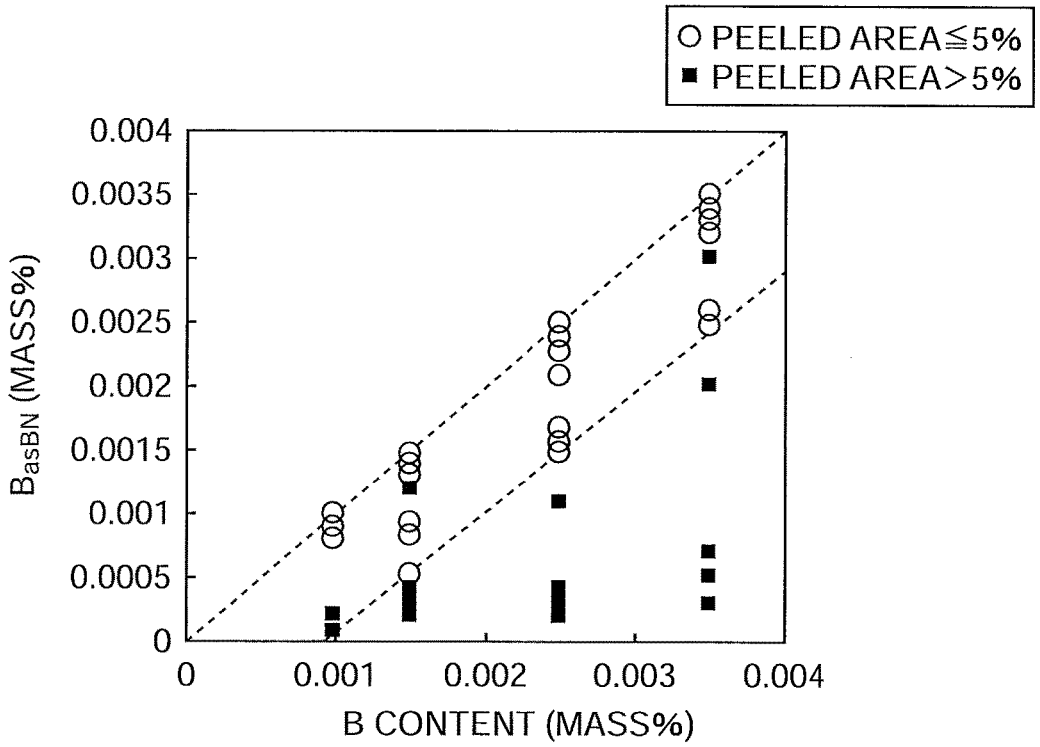
FIG. 5 is a view showing the relationship between the amount of B that has not precipitated as BN and the coating film adhesiveness after the finish annealing.

Similarly, with regard to the samples in which certain amounts or more of MnS and BN are precipitated, the relationship between the amount of B that has not precipitated as BN and the coating film adhesiveness after the finish annealing was examined. This result is shown in FIG. 5. The evaluation of the adhesiveness was performed by the same method as that described in the explanation in FIG. 3. As shown in FIG. 5, in the samples each having the precipitation amount of BN being a certain value or more, the improvement of the coating film adhesiveness is confirmed.

Further, as a result of examination of a form of the precipitates in the samples each having the good magnetic property and coating film adhesiveness, it turned out that MnS becomes a nucleus and BN compositely precipitates around MnS. Such composite precipitates are effective as inhibitors that stabilize the secondary recrystallization. Further, by making the atmosphere of the finish annealing appropriate, BN is decomposed in an appropriate temperature region during the finish annealing to supply B to an interface between the steel sheet and the glass coating film at the time of the glass coating film being formed, which contributes to the improvement of the coating film adhesiveness finally.

Further, the relationship between a condition of the hot rolling and the magnetic property after the finish annealing was examined. This result is shown in FIG. 6 and FIG. 7.

Figure 6:
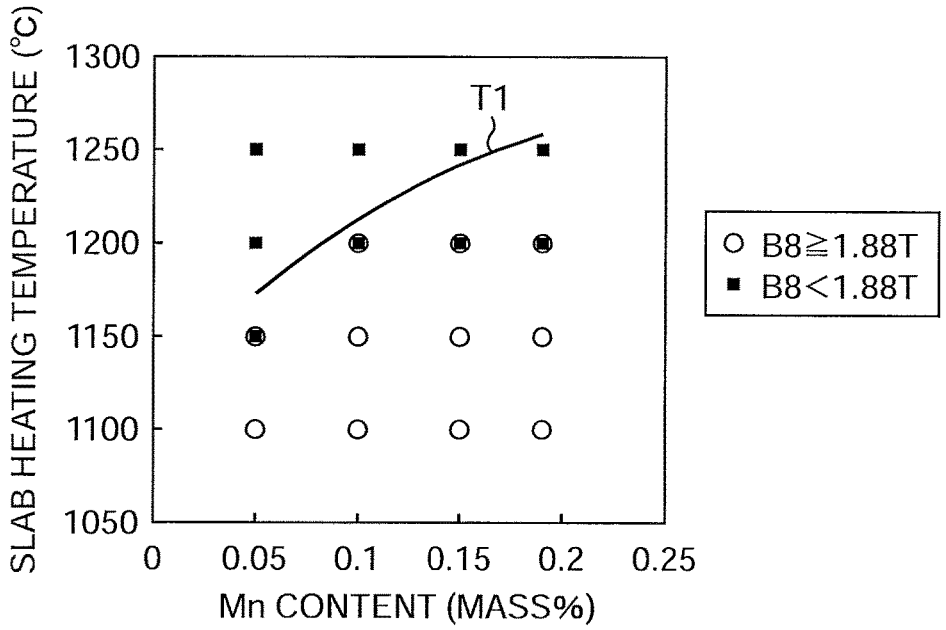
FIG. 6 is a view showing the relationship between a condition of hot rolling and the magnetic property after the finish annealing.
Figure 7:
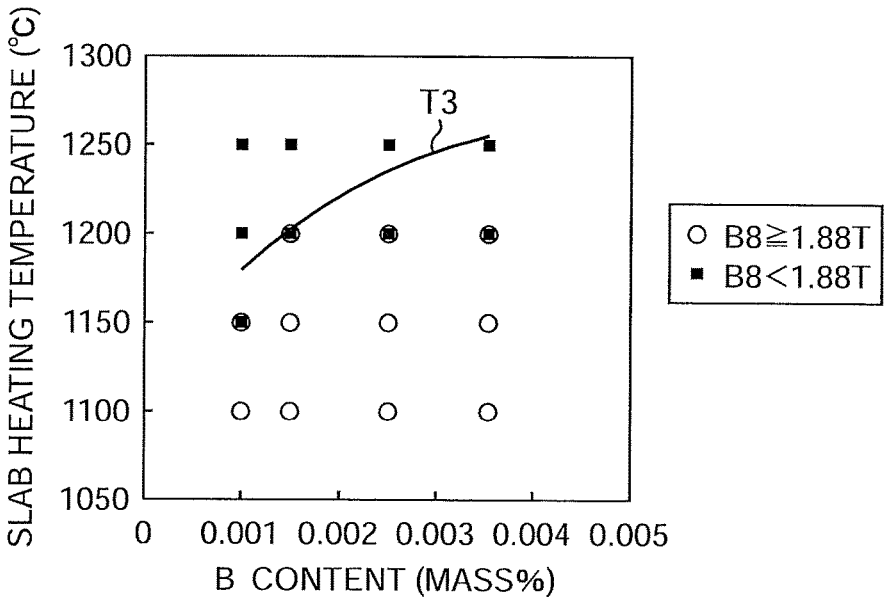
FIG. 7 is a view showing the relationship between the condition of the hot rolling and the magnetic property after the finish annealing.

In FIG. 6, the horizontal axis indicates the Mn content (mass %) and the vertical axis indicates the slab heating temperature (° C.) at the time of hot rolling. In FIG. 7, the horizontal axis indicates the B content (mass %) and the vertical axis indicates the slab heating temperature (° C.) at the time of hot rolling. Further, white circles each indicate that the magnetic flux density B8 was 1.88 T or more, and black squares each indicate that the magnetic flux density B8 was less than 1.88 T. Further, the curve in FIG. 6 indicates a solution temperature T1 (° C.) of MnS expressed by Expression (2) below, and the curve in FIG. 7 indicates a solution temperature T3 (° C.) of BN expressed by Expression (4) below. As shown in FIG. 6, it turned out that in the samples in which the slab heating is performed at a temperature determined according to the Mn content or lower, the high magnetic flux density B8 is obtained. Further, it also turned out that this temperature approximately agrees with the solution temperature T1 of MnS. Further, as shown in FIG. 7, it also turned out that in the samples in which the slab heating is performed at a temperature determined according to the B content or lower, the high magnetic flux density B8 is obtained. Further, it also turned out that this temperature approximately agrees with the solution temperature T3 of BN. That is, it turned out that it is effective to perform the slab heating in the temperature region where MnS and BN are not completely solid-dissolved.

$$T1=14855/(6.82-\log([Mn]\times[S]))-273 \quad (2)$$

$$T3=16000/(5.92-\log([B]\times[N]))-273 \quad (4)$$

Here, [Mn] represents the Mn content (mass %), [S] represents the S content (mass %), [B] represents the B content (mass %), and [N] represents the N content (mass %).

Further, as a result of examination of precipitation behavior of BN, it turned out that a precipitation temperature region of BN is 800° C. to 1000° C.

Figure 8:
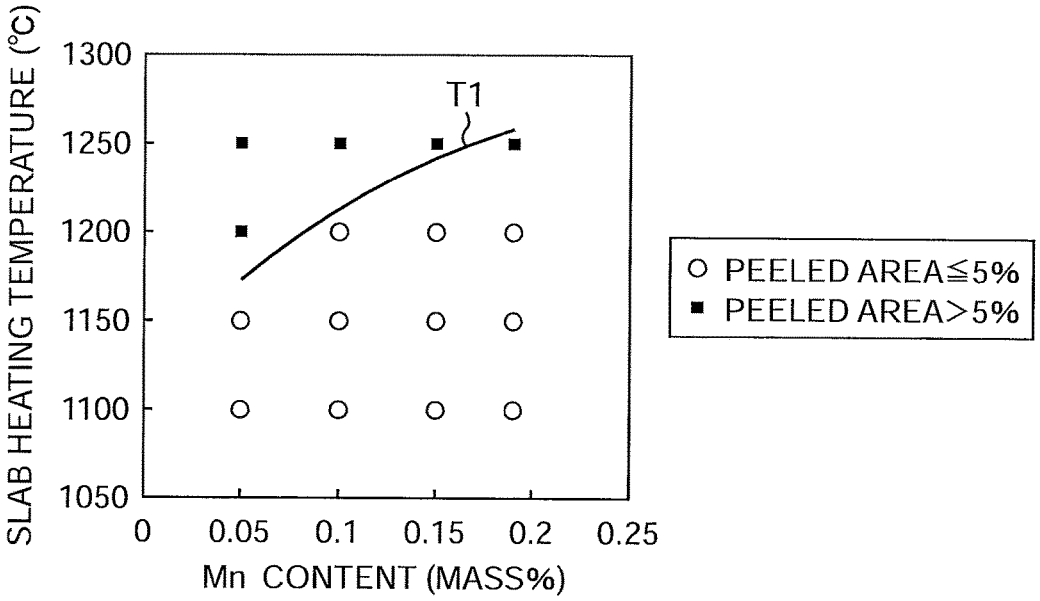
FIG. 8 is a view showing the relationship between the condition of the hot rolling and the coating film adhesiveness after the finish annealing.
Figure 9:
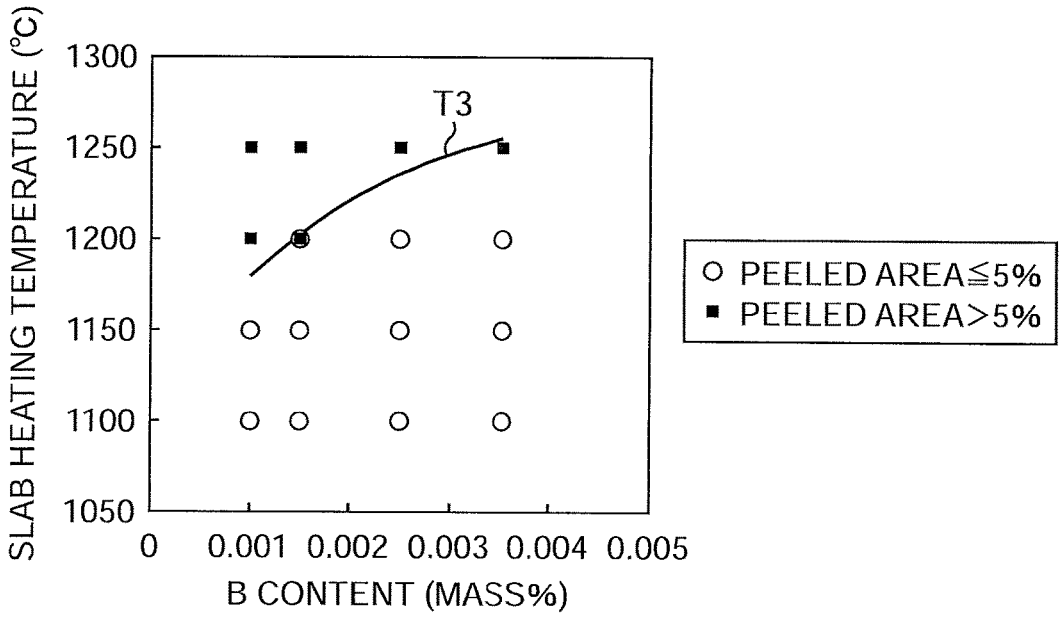
FIG. 9 is a view showing the relationship between the condition of the hot rolling and the coating film adhesiveness after the finish annealing.

Similarly, the relationship between the condition of the hot rolling and the coating film adhesiveness after the finish annealing was examined. The evaluation of the adhesiveness was performed by the same method as that described in the explanation in FIG. 3. This result is shown in FIG. 8 and FIG. 9. In FIG. 8, the horizontal axis indicates the Mn content (mass %) and the vertical axis indicates the slab heating temperature (° C.) at the time of hot rolling. Further, white circles each indicate that there was no problem in terms of the coating film adhesiveness, and black squares each indicate that coating film peeling occurred. Further, the curve in FIG. 8 indicates the solution temperature T1 (° C.) of MnS expressed by Expression (2), and the curve in FIG. 9 indicates the solution temperature T3 (° C.) of BN expressed by Expression (4). As shown in FIG. 8, it turned out that in the samples in which the slab heating is performed at a temperature determined according to the Mn content or lower, a coating film adhesiveness improving effect is obtained. Further, it also turned out that this temperature approximately agrees with the solution temperature T1 of MnS. Further, as shown in FIG. 9, it also turned out that in the samples in which the slab heating is performed at a temperature determined according to the B content or lower, the coating film adhesiveness improving effect is obtained. Further, it also turned out that this temperature approximately agrees with the solution temperature T3 of BN.

Further, the present inventors examined a finishing temperature of the finish rolling in the hot rolling. In this examination, first, various silicon steel slabs each containing Si: 3.3 mass %, C: 0.06 mass %, acid-soluble Al: 0.027 mass %, N: 0.008 mass %, Mn: 0.1 mass %, S: 0.007 mass %, and B: 0.001 mass % to 0.004 mass %, and a balance being composed of Fe and inevitable impurities were obtained. Next, the silicon steel slabs were heated at a temperature of 1200° C. and were subjected to hot rolling. In the hot rolling, rough rolling was performed at 1050° C. and then finish rolling was performed at 1020° C. to 900° C., and thereby hot-rolled steel strips each having a thickness of 2.3 mm were obtained. Then, a cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and cold-rolled steel strips each having a thickness of 0.22 mm were obtained. Thereafter, the cold-rolled steel strips were heated at a speed of 15° C./s, and were subjected to decarburization annealing at a temperature of 840° C., and decarburization-annealed steel strips were obtained. Subsequently, the decarburization-annealed steel strips were annealed in an ammonia containing atmosphere to increase nitrogen in the steel strips up to 0.022 mass %. Next, an annealing separating agent having MgO as its main component was applied on the steel strips and finish annealing was performed. With regard to the atmosphere of the finish annealing, of the atmosphere from 800° C. to 1100° C., the nitrogen partial pressure $P_{N2}$ was set to 0.5 and the oxygen potential Log $[P_{H2O}/P_{H2}]$ was set to −1.0, and of the atmosphere at 1100° C. or higher, the nitrogen partial pressure $P_{N2}$ was set to 0.1 or less and the oxygen potential Log $[P_{H2O}/P_{H2}]$ was set to −2 or less, and various samples were manufactured.

Figure 10:
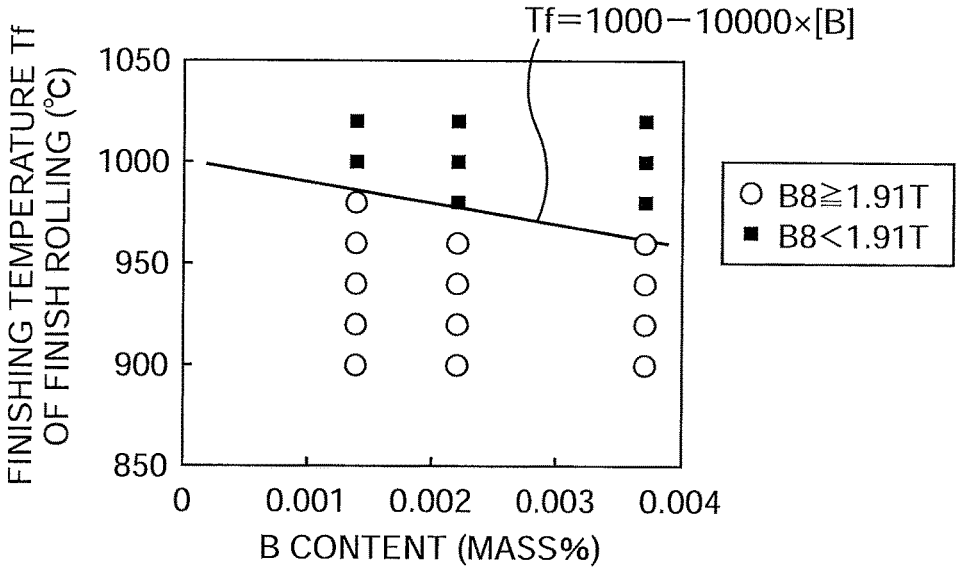
FIG. 10 is a view showing the relationship between a finishing temperature of finish rolling in the hot rolling and the magnetic property after the finish annealing.

Then, the relationship between the finishing temperature of the finish rolling in the hot rolling and the magnetic property after the finish annealing was examined. This result is shown in FIG. 10. In FIG. 10, the horizontal axis indicates the B content (mass %), and the vertical axis indicates a finishing temperature Tf of the finish rolling. Further, white circles each indicate that the magnetic flux density B8 was 1.91 T or more, and black squares each indicate that the magnetic flux density B8 was less than 1.91 T. As shown in FIG. 10, it turned out that when the finishing temperature Tf of the finish rolling satisfies Expression (5) below, the high magnetic flux density B8 is obtained. This is conceivably because by controlling the finishing temperature Tf of the finish rolling, the precipitation of BN was further promoted.

$$Tf \leq 1000 - 10000 \times [B] \quad (5)$$

Figure 11:
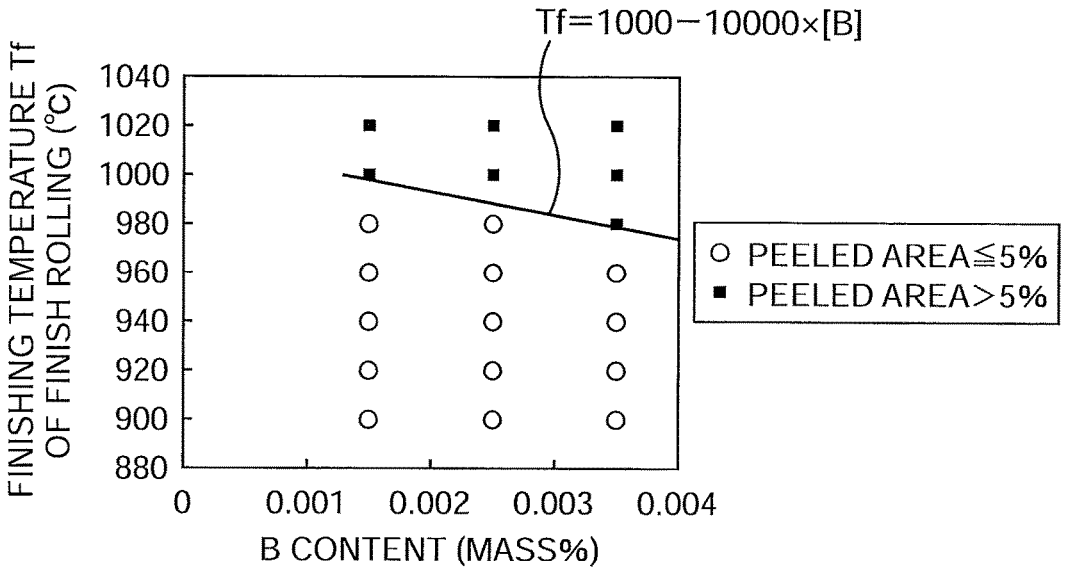
FIG. 11 is a view showing the relationship between the finishing temperature of the finish rolling in the hot rolling and the coating film adhesiveness after the finish annealing.

Further, the relationship between the finishing temperature of the finish rolling in the hot rolling and the coating film adhesiveness after the finish annealing was examined. The evaluation of the adhesiveness was performed by the same method as that described in the explanation in FIG. 3. This result is shown in FIG. 11. In FIG. 11, the horizontal axis indicates the B content (mass %) and the vertical axis indicates the finishing temperature Tf of the finish rolling. Further, white circles each indicate that the coating film adhesiveness was good, and black squares each indicate that coating film peeling occurred. As shown in FIG. 11, it turned out that the finishing temperature Tf of the finish rolling satisfies Expression (5) and the atmosphere of the finish annealing is made appropriate, and thereby the coating film adhesiveness improving effect is obtained.

Second Experiment

Next, with regard to the relationship between the precipitates and the magnetic property and the coating film adhesiveness, tests to examine a silicon steel material having a composition containing Se were performed.

First, various silicon steel slabs each containing Si: 3.3 mass %, C: 0.06 mass %, acid-soluble Al: 0.028 mass %, N: 0.007 mass %, Mn: 0.05 mass % to 0.20 mass %, Se: 0.007 mass %, and B: 0.0010 mass % to 0.0035 mass %, and a balance being composed of Fe and inevitable impurities were obtained. Next, the silicon steel slabs were heated at a temperature of 1100° C. to 1250° C. and were subjected to hot rolling. In the hot rolling, rough rolling was performed at 1050° C. and then finish rolling was performed at 1000° C., and thereby hot-rolled steel strips each having a thickness of 2.3 mm were obtained. Then, a cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and cold-rolled steel strips each having a thickness of 0.22 mm were obtained. Thereafter, the cold-rolled steel strips were heated at a speed of 15° C./s, and were subjected to decarburization annealing at a temperature of 850° C., and decarburization-annealed steel strips were obtained. Subsequently, the decarburization-annealed steel strips were annealed in an ammonia containing atmosphere to increase nitrogen in the steel strips up to 0.023 mass %. Next, an annealing separating agent having MgO as its main component was applied on the steel strips and finish annealing was performed in a manner that of the atmosphere from 800° C. to 1100° C., the nitrogen partial pressure $P_{N2}$ was set to 0.5 and the oxygen potential Log $[P_{H2O}/P_{H2}]$ was set to −1.0, and of the atmosphere at 1100° C. or higher, the nitrogen partial pressure $P_{N2}$ was set to 0.1 or less and the oxygen potential Log $[P_{H2O}/P_{H2}]$ was set to −2 or less, and various samples were manufactured.

Figure 12:
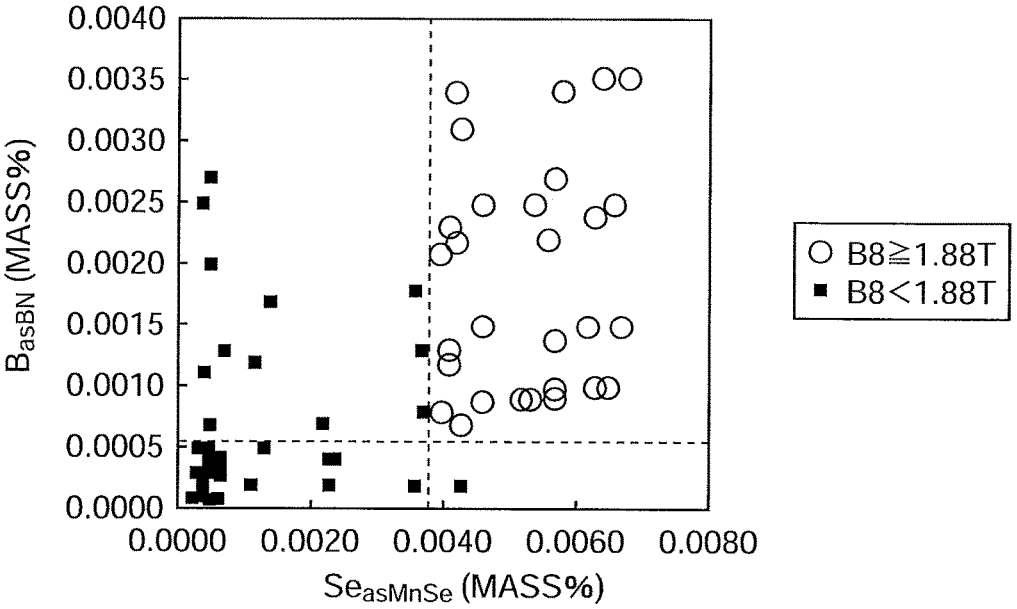
FIG. 12 is a view showing the relationship between precipitates of hot rolling and a magnetic property after finish annealing.

Then, the relationship between precipitates in the hot-rolled steel strip and a magnetic property after the finish annealing was examined. This result is shown in FIG. 12. In FIG. 12, the horizontal axis indicates a value (mass %) obtained by converting a precipitation amount of MnSe into an amount of Se, and the vertical axis indicates a value (mass %) obtained by converting a precipitation amount of BN into B. Further, white circles each indicate that the magnetic flux density B8 was 1.88 T or more, and black squares each indicate that the magnetic flux density B8 was less than 1.88 T. As shown in FIG. 12, in the samples each having the precipitation amount of MnSe or BN being less than a certain value, the magnetic flux density B8 was low. This indicates that secondary recrystallization was unstable.

Figure 13:
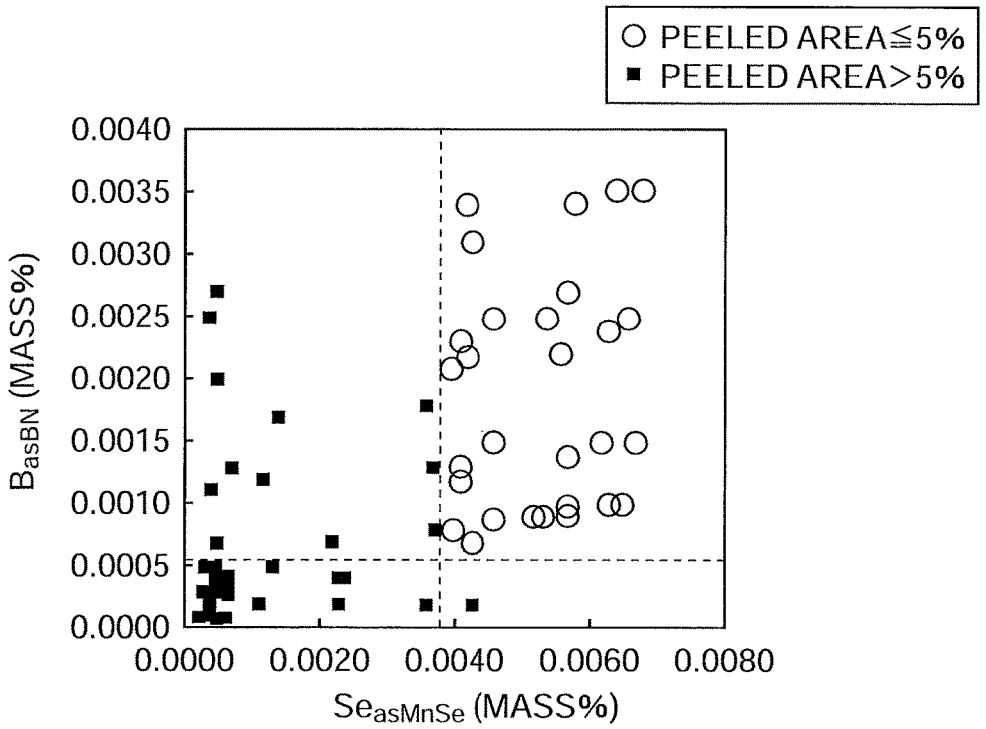
FIG. 13 is a view showing the relationship between the precipitates of the hot rolling and coating film adhesiveness after the finish annealing.

Similarly, the relationship between the precipitates in the hot-rolled steel strip and coating film adhesiveness after the finish annealing was examined. The evaluation of the coating film adhesiveness was performed by the same method as that described in the explanation in FIG. 3. This result is shown in FIG. 13. In FIG. 13, the horizontal axis indicates the value (mass %) obtained by converting the precipitation amount of MnSe into the amount of Se, and the vertical axis indicates the value (mass %) obtained by converting the precipitation amount of BN into B. Further, white circles each indicate that the coating film adhesiveness is good and black squares each indicate that coating film peeling occurred. As shown in FIG. 13, it is found that in the case of the samples in which the precipitation amounts of MnSe and BN are certain values or more and the atmosphere of the finish annealing being appropriate, the coating film adhesiveness improving effect is obtained.

Further, with regard to the samples in which certain amounts or more of MnSe and BN are precipitated, the relationship between an amount of B that has not precipitated as BN and the magnetic property after the finish annealing was examined.

Figure 14:
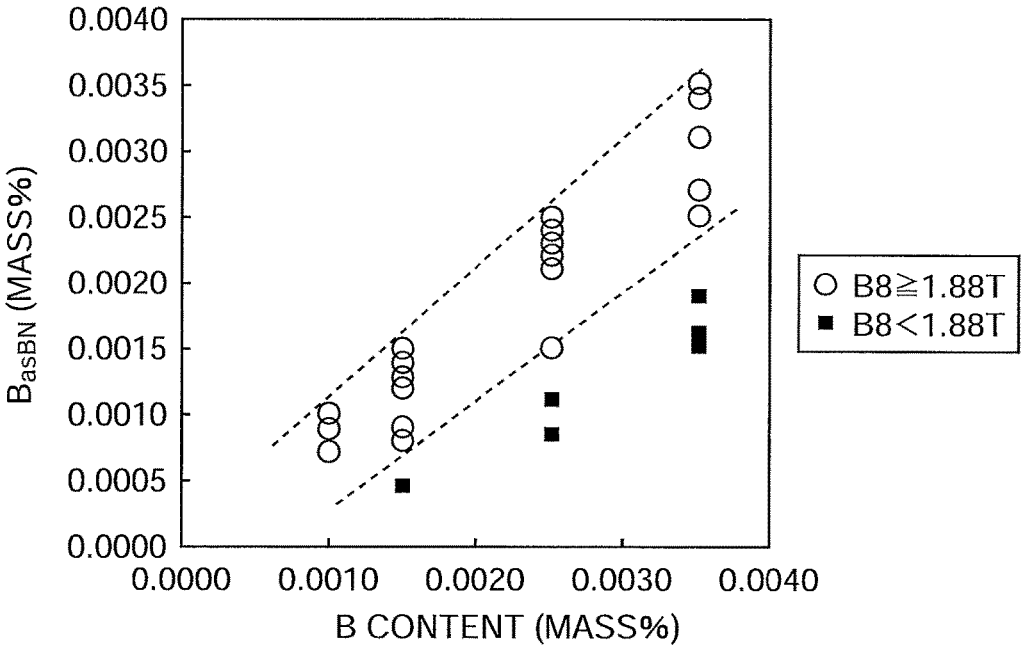
FIG. 14 is a view showing the relationship between an amount of B that has not precipitated as BN and the magnetic property after the finish annealing.

This result is shown in FIG. 14. In FIG. 14, the horizontal axis indicates the B content (mass %), and the vertical axis indicates the value (mass %) obtained by converting the precipitation amount of BN into B. Further, white circles each indicate that the magnetic flux density B8 was 1.88 T or more, and black squares each indicate that the magnetic flux density B8 was less than 1.88 T. As shown in FIG. 14, in the samples in which the amount of B that has not precipitated as BN is a certain value or more, the magnetic flux density B8 was low. This indicates that the secondary recrystallization was unstable.

Figure 15:
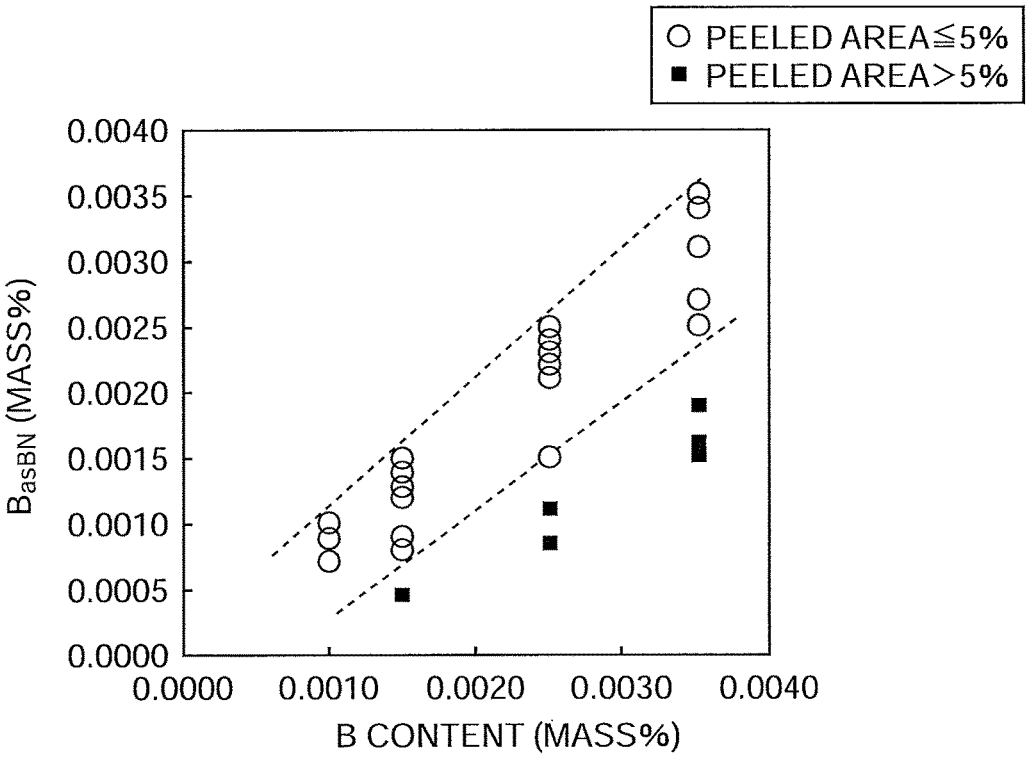
FIG. 15 is a view showing the relationship between the amount of B that has not precipitated as BN and the coating film adhesiveness after the finish annealing.

Similarly, with regard to the samples in which certain amounts or more of MnSe and BN are precipitated, the relationship between the amount of B that has not precipitated as BN and the coating film adhesiveness after the finish annealing was examined. The evaluation of the coating film adhesiveness was performed by the same method as that described in the explanation in FIG. 3. This result is shown in FIG. 15. In FIG. 15, the horizontal axis indicates the B content (mass %), and the vertical axis indicates the value (mass %) obtained by converting the precipitation amount of BN into B. Further, white circles each indicate that the improvement effect was seen in the coating film adhesiveness, and black squares each indicate that coating film peeling occurred and there was no improvement effect in the coating film adhesiveness. As shown in FIG. 15, in the case of the samples in which the amount of B that has not precipitated as BN is a certain value or less and the atmosphere of the finish annealing being the appropriate condition, the improvement effect of the coating film adhesiveness is seen.

Further, as a result of examination of a form of the precipitates in the samples each having the good magnetic property and coating film adhesiveness, it turned out that MnSe becomes a nucleus and BN compositely precipitates around MnSe. Such composite precipitates are effective as inhibitors that stabilize the secondary recrystallization. Further, when the atmosphere of the finish annealing is appropriate, BN is decomposed in an appropriate temperature region during the finish annealing to supply B to an interface between a steel sheet and a glass coating film at the time of the glass coating film being formed, which contributes to the improvement of the coating film adhesiveness finally.

Further, the relationship between a condition of the hot rolling and the magnetic property after the finish annealing was examined. This result is shown in FIG. 16 and FIG. 17.

Figure 16:
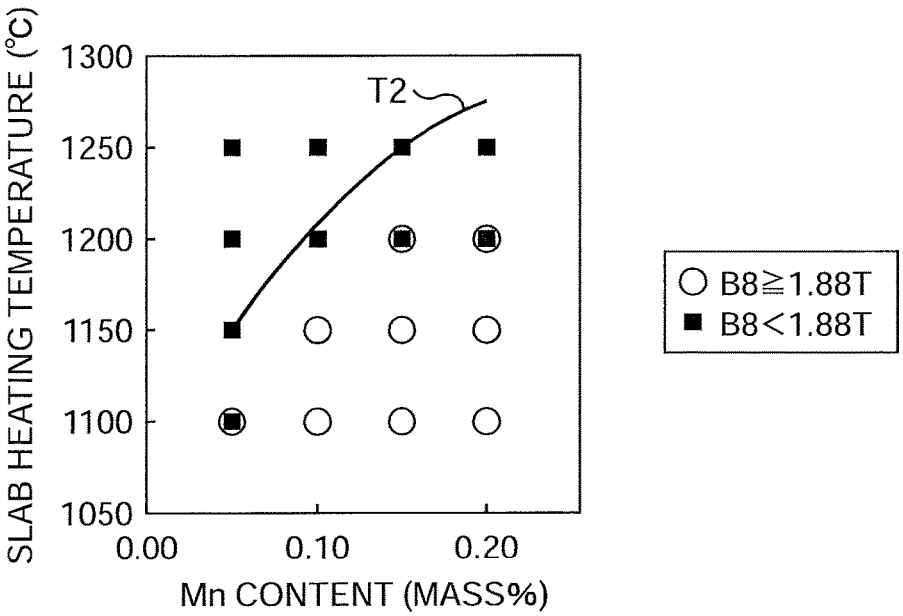
FIG. 16 is a view showing the relationship between a condition of the hot rolling and the magnetic property after the finish annealing.
Figure 17:
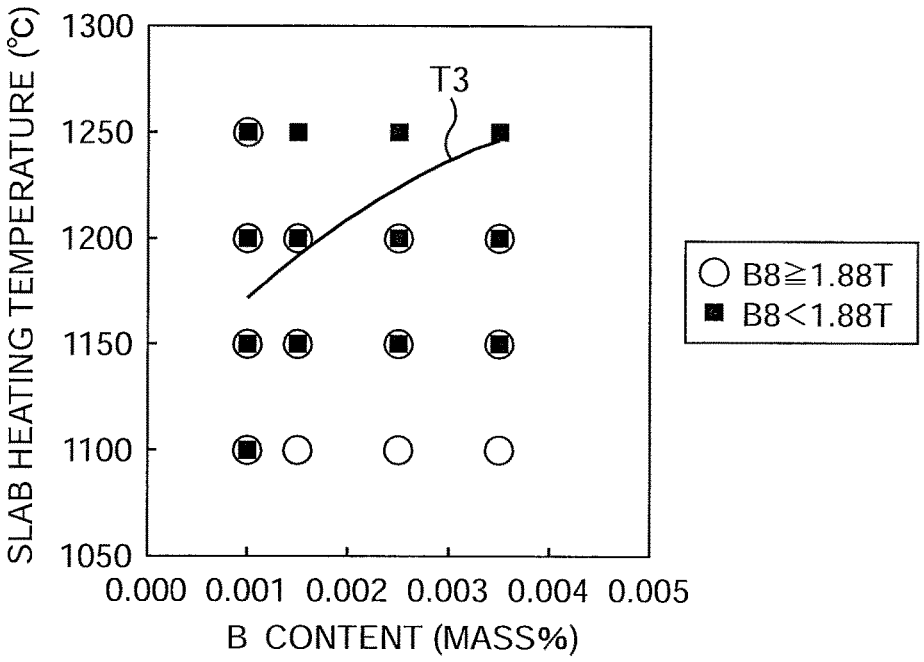
FIG. 17 is a view showing the relationship between the condition of the hot rolling and the magnetic property after the finish annealing.

In FIG. 16, the horizontal axis indicates the Mn content (mass %) and the vertical axis indicates the slab heating temperature (° C.) at the time of hot rolling. In FIG. 17, the horizontal axis indicates the B content (mass %) and the vertical axis indicates the slab heating temperature (° C.) at the time of hot rolling. Further, white circles each indicate that the magnetic flux density B8 was 1.88 T or more, and black squares each indicate that the magnetic flux density B8 was less than 1.88 T. Further, the curve in FIG. 16 indicates a solution temperature T2 (° C.) of MnSe expressed by Expression (3) below, and the curve in FIG. 17 indicates the solution temperature T3 (° C.) of BN expressed by Expression (4). As shown in FIG. 16, it turned out that in the samples in which the slab heating is performed at a temperature determined according to the Mn content or lower, the high magnetic flux density B8 is obtained. Further, it also turned out that this temperature approximately agrees with the solution temperature T2 of MnSe. Further, as shown in FIG. 17, it also turned out that in the samples in which the slab heating is performed at a temperature determined according to the B content or lower, the high magnetic flux density B8 is obtained. Further, it also turned out that this temperature approximately agrees with the solution temperature T3 of BN. That is, it turned out that it is effective to perform the slab heating in the temperature region where MnSe and BN are not completely solid-dissolved.

$$T2=10733/(4.08-\log([Mn]\times[Se]))-273 \quad (3)$$

Here, [Se] represents the Se content (mass %).

Figure 18:
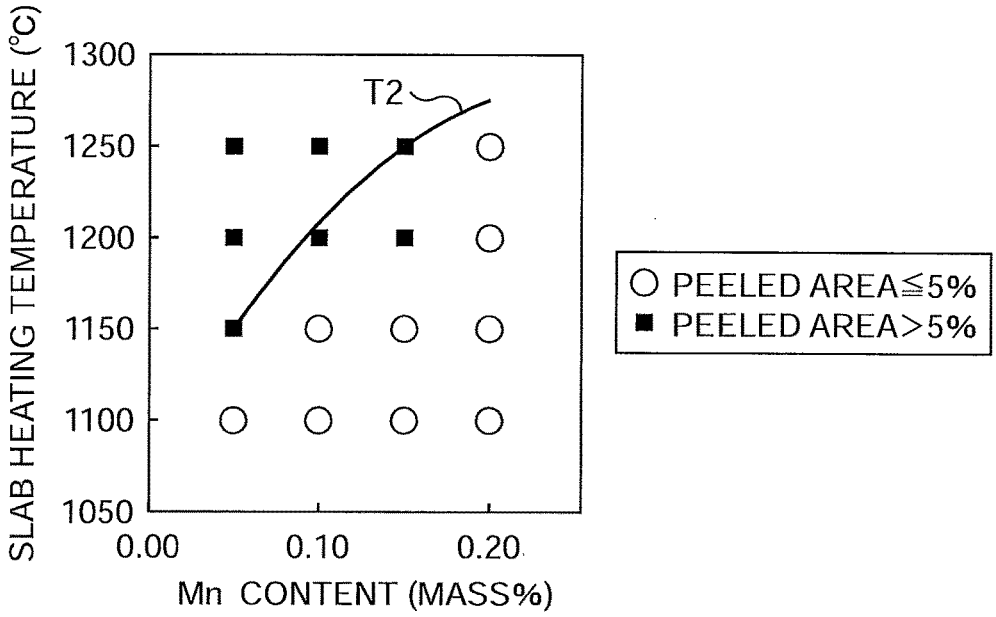
FIG. 18 is a view showing the relationship between the condition of the hot rolling and the coating film adhesiveness after the finish annealing.
Figure 19:
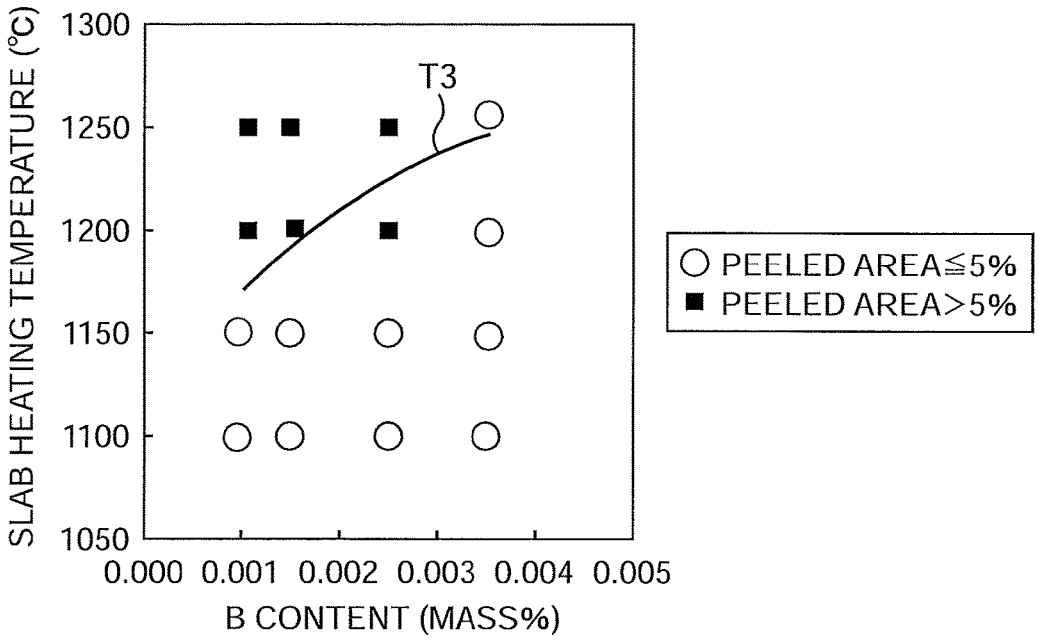
FIG. 19 is a view showing the relationship between the condition of the hot rolling and the coating film adhesiveness after the finish annealing.

Similarly, the relationship between the condition of the hot rolling and the coating film adhesiveness after the finish annealing was examined. This result is shown in FIG. 18 and FIG. 19. The evaluation of the coating film adhesiveness was performed by the same method as that described in the explanation in FIG. 3.

In FIG. 18, the horizontal axis indicates the Mn content (mass %) and the vertical axis indicates the slab heating temperature (° C.) at the time of hot rolling. In FIG. 19, the horizontal axis indicates the B content (mass %) and the vertical axis indicates the slab heating temperature (° C.) at the time of hot rolling. Further, white circles each indicate that the coating film adhesiveness improved, and black squares each indicate that coating film peeling occurred and the adhesiveness did not improve. Further, the curve in FIG. 18 indicates the solution temperature T2 (° C.) of MnSe expressed by Expression (3), and the curve in FIG. 19 indicates the solution temperature T3 (° C.) of BN expressed by Expression (4). As shown in FIG. 18, it turned out that in the samples in which the slab heating is performed at a temperature determined according to the Mn content or lower, the coating film adhesiveness improves. Further, it also turned out that this temperature approximately agrees with the solution temperature T2 of MnSe. Further, as shown in FIG. 19, it turned out that in the samples in which the slab heating is performed at a temperature determined according to the B content or lower, the coating film adhesiveness improving effect is obtained. Further, it also turned out that this temperature approximately agrees with the solution temperature T3 of BN. That is, it turned out that it is effective to perform the slab heating in the temperature region where MnSe and BN are not solid-dissolved completely and to perform the finish annealing in the appropriate atmosphere.

Further, as a result of examination of precipitation behavior of BN, it turned out that a precipitation temperature region of BN is 800° C. to 1000° C.

Further, the present inventors examined a finishing temperature of the finish rolling in the hot rolling. In this examination, first, various silicon steel slabs each containing Si: 3.3 mass %, C: 0.06 mass %, acid-soluble Al: 0.028 mass %, N: 0.007 mass %, Mn: 0.1 mass %, Se: 0.007 mass %, and B: 0.001 mass % to 0.004 mass %, and a balance being composed of Fe and inevitable impurities were obtained. Next, the silicon steel slabs were heated at a temperature of 1200° C. and were subjected to hot rolling. In the hot rolling, rough rolling was performed at 1050° C. and then finish rolling was performed at 1020° C. to 900° C., and thereby hot-rolled steel strips each having a thickness of 2.3 mm were obtained. Then, a cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and cold-rolled steel strips each having a thickness of 0.22 mm were obtained. Thereafter, the cold-rolled steel strips were heated at a speed of 15° C./s, and were subjected to decarburization annealing at a temperature of 850° C., and decarburization-annealed steel strips were obtained. Subsequently, the decarburization-annealed steel strips were annealed in an ammonia containing atmosphere to increase nitrogen in the steel strips up to 0.023 mass %. Next, an annealing separating agent having MgO as its main component was applied on the steel strips, and finish annealing was performed in a manner that of the atmosphere from 800° C. to 1100° C., the nitrogen partial pressure $P_{N2}$ is set to 0.5 and the oxygen potential Log $[P_{H2O}/P_{H2}]$ is set to −1, and of the atmosphere at 1100° C. or higher, the nitrogen partial pressure $P_{N2}$ is set to 0.1 or less and the oxygen potential Log $[P_{H2O}/P_{H2}]$ is set to −2, and various samples were manufactured.

Figure 20:
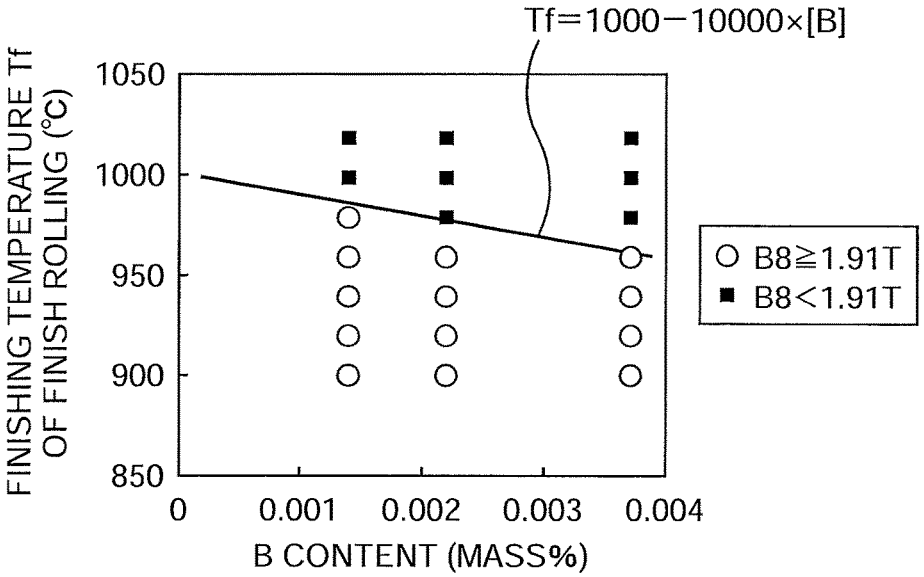
FIG. 20 is a view showing the relationship between a finishing temperature of finish rolling in the hot rolling and the magnetic property after the finish annealing.

Then, the relationship between the finishing temperature of the finish rolling in the hot rolling and the magnetic property after the finish annealing was examined. This result is shown in FIG. 20. In FIG. 20, the horizontal axis indicates the B content (mass %), and the vertical axis indicates the finishing temperature Tf of the finish rolling. Further, white circles each indicate that the magnetic flux density B8 was 1.91 T or more, and black squares each indicate that the magnetic flux density B8 was less than 1.91 T. As shown in FIG. 20, it turned out that when the finishing temperature Tf of the finish rolling satisfies Expression (5) described previously, the high magnetic flux density B8 is obtained. This is conceivably because by controlling the finishing temperature Tf of the finish rolling, the precipitation of BN was further promoted.

Figure 21:
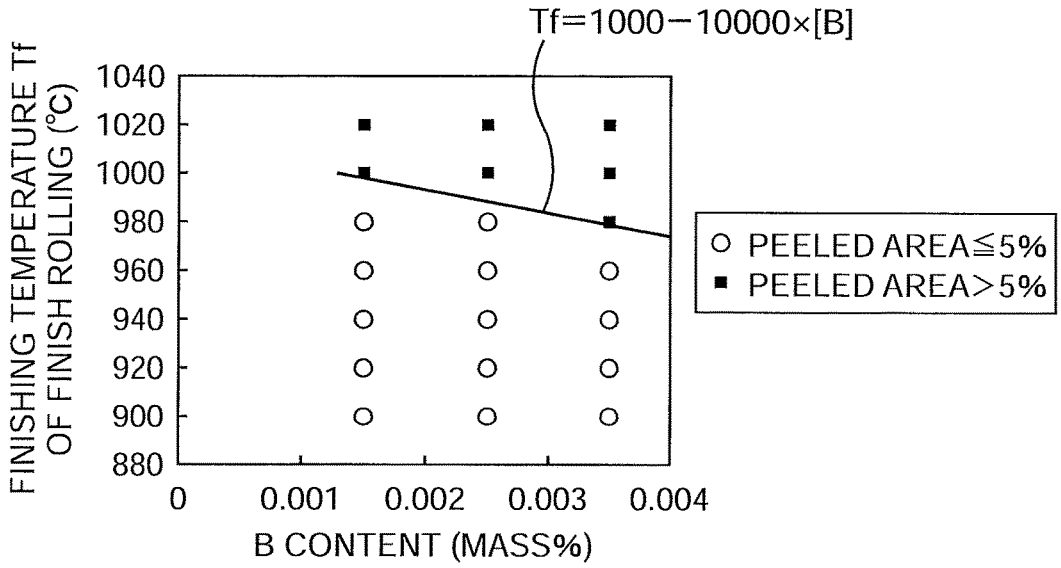
FIG. 21 is a view showing the relationship between the finishing temperature of the finish rolling in the hot rolling and the coating film adhesiveness after the finish annealing.

Similarly, the relationship between the finishing temperature of the finish rolling in the hot rolling and the coating film adhesiveness after the finish annealing was examined. This result is shown in FIG. 21. In FIG. 21, the horizontal axis indicates the B content (mass %) and the vertical axis indicates the finishing temperature Tf of the finish rolling. Further, white circles each indicate that the coating film adhesiveness improved, and black squares each indicate that coating film peeling occurred and no adhesiveness improving effect was obtained. As shown in FIG. 21, it turned out that when the finishing temperature Tf of the finish rolling satisfies Expression (5) and the finish annealing is performed in the appropriate atmosphere, the coating film adhesiveness improving effect is obtained.

Third Experiment

Further, with regard to the relationship between the magnetic property and the coating film adhesiveness, tests to examine a silicon steel material having a composition containing S and Se were performed.

First, various silicon steel slabs each containing Si: 3.3 mass %, C: 0.06 mass %, acid-soluble Al: 0.026 mass %, N: 0.009 mass %, Mn: 0.05 mass % to 0.20 mass %, S: 0.005 mass %, Se: 0.007 mass %, and B: 0.0010 mass % to 0.0035 mass %, and a balance being composed of Fe and inevitable impurities were obtained. Next, the silicon steel slabs were heated at a temperature of 1100° C. to 1250° C. and were subjected to hot rolling. In the hot rolling, rough rolling was performed at 1050° C. and then finish rolling was performed at 1000° C., and thereby hot-rolled steel strips each having a thickness of 2.3 mm were obtained. Then, a cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and cold-rolled steel strips each having a thickness of 0.22 mm were obtained. Thereafter, the cold-rolled steel strips were heated at a speed of 15° C./s, and were subjected to decarburization annealing at a temperature of 850° C., and decarburization-annealed steel strips were obtained. Subsequently, the decarburization-annealed steel strips were annealed in an ammonia containing atmosphere to increase nitrogen in the steel strips up to 0.021 mass %. Next, an annealing separating agent having MgO as its main component was applied on the steel strips, and finish annealing was performed in a manner that of the atmosphere from 800° C. to 1100° C., the nitrogen partial pressure $P_{N2}$ is set to 0.5 and the oxygen potential Log $[P_{H2O}/P_{H2}]$ is set to −1, and of the atmosphere at 1100° C. or higher, the nitrogen partial pressure $P_{N2}$ is set to 0.1 or less and the oxygen potential Log $[P_{H2O}/P_{H2}]$ is set to −2 or less, and various samples were manufactured.

Figure 22:
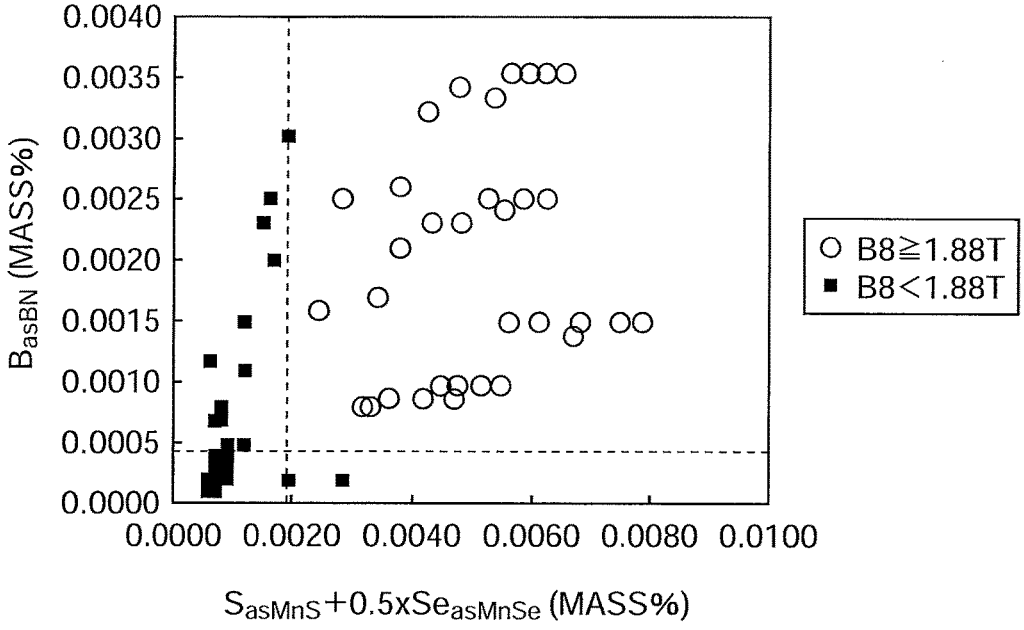
FIG. 22 is a view showing the relationship between precipitate amounts in a hot-rolled steel strip and a magnetic property after finish annealing.

Then, the relationship between precipitates in the hot-rolled steel strip and the magnetic property after the finish annealing was examined. This result is shown in FIG. 22. In FIG. 22, the horizontal axis indicates the sum (mass %) of a value obtained by converting a precipitation amount of MnS into an amount of S and a value obtained by multiplying a value obtained by converting a precipitation amount of MnSe into an amount of Se by 0.5, and the vertical axis indicates a value (mass %) obtained by converting a precipitation amount of BN into B. Further, white circles each indicate that the magnetic flux density B8 was 1.88 T or more, and black squares each indicate that the magnetic flux density B8 was less than 1.88 T. As shown in FIG. 22, in the samples each having the precipitation amount of MnS, MnSe, or BN being less than a certain value, the magnetic flux density B8 was low. This indicates that secondary recrystallization was unstable.

Figure 23:
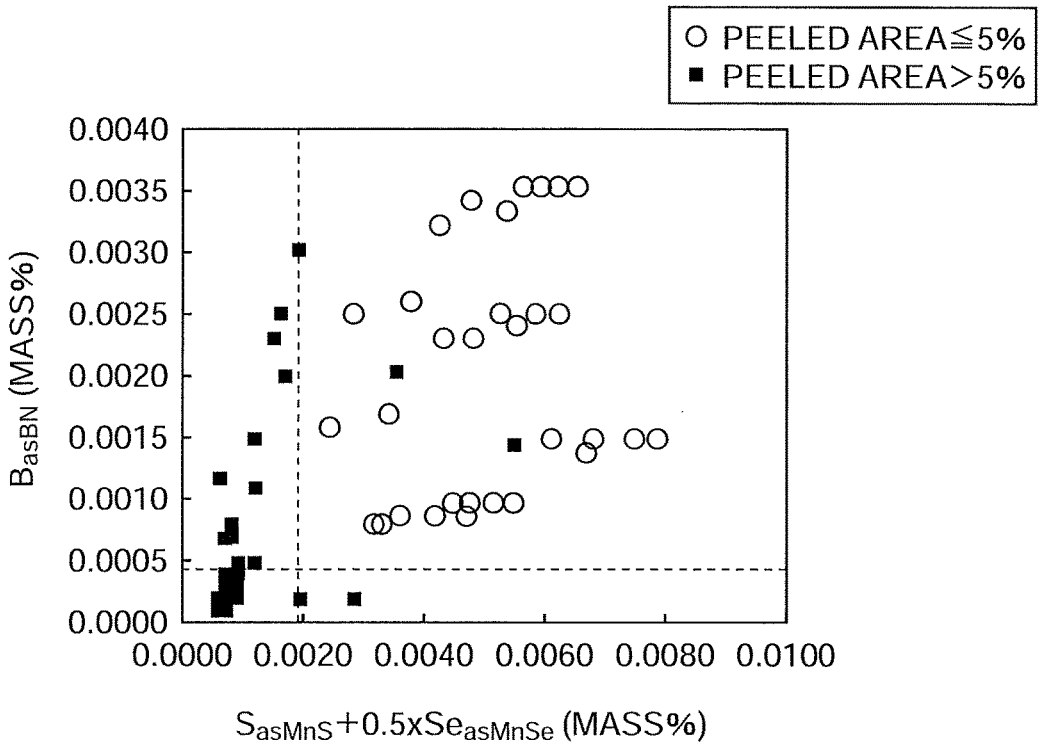
FIG. 23 is a view showing the relationship between the precipitate amounts in the hot-rolled steel strip and coating film adhesiveness after the finish annealing.

Similarly, the relationship between the precipitates in the hot-rolled steel strip and the coating film adhesiveness after the finish annealing was examined. The evaluation of the coating film adhesiveness was performed by the same method as that described in the explanation in FIG. 3. This result is shown in FIG. 23. In FIG. 23, the horizontal axis indicates the sum (mass %) of the value obtained by converting the precipitation amount of MnS into the amount of S and the value obtained by multiplying the value obtained by converting the precipitation amount of MnSe into the amount of Se by 0.5, and the vertical axis indicates the value (mass %) obtained by converting the precipitation amount of BN into B. Further, white circles each indicate that the coating film adhesiveness improved and black squares each indicate that coating film peeling occurred and no coating film adhesiveness improving effect was obtained. As shown in FIG. 23, when the precipitation amounts of MnS, MnSe and BN were certain values or more and the atmosphere of the finish annealing was the appropriate condition, the coating film adhesiveness improved.

Figure 24:
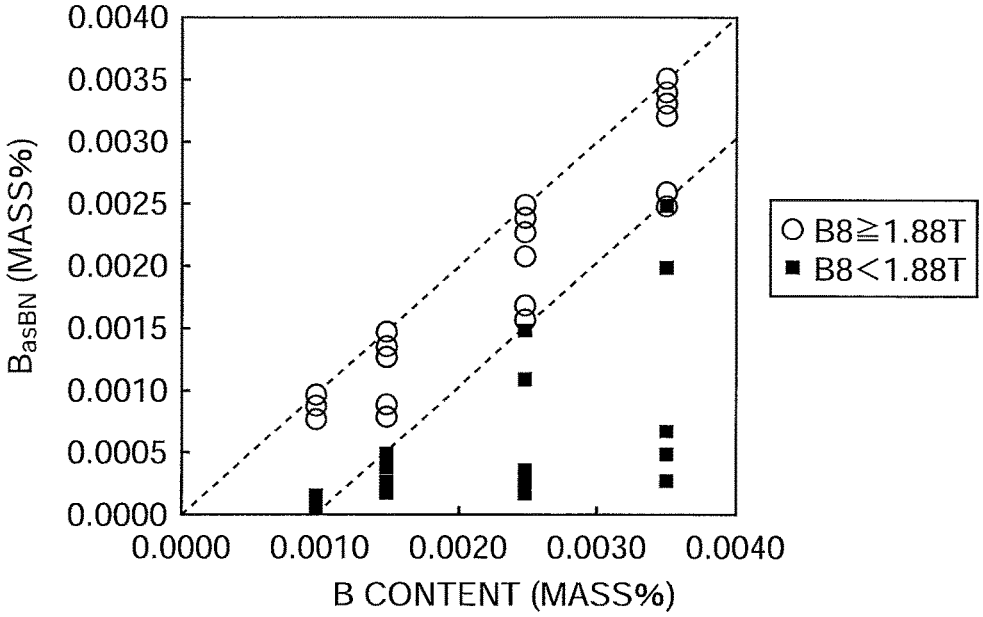
FIG. 24 is a view showing the relationship between an amount of B that has not precipitated as BN and the magnetic property after the finish annealing.

Further, with regard to the samples in which certain amounts or more of MnS, MnSe and BN are precipitated, the relationship between an amount of B that has not precipitated as BN and the magnetic property after the finish annealing was examined. This result is shown in FIG. 24. In FIG. 24, the horizontal axis indicates the B content (mass %), and the vertical axis indicates the value (mass %) obtained by converting the precipitation amount of BN into B. Further, white circles each indicate that the magnetic flux density B8 was 1.88 T or more, and black squares each indicate that the magnetic flux density B8 was less than 1.88 T. As shown in FIG. 24, in the samples in which the amount of B that has not precipitated as BN is a certain value or more, the magnetic flux density B8 was low. This indicates that the secondary recrystallization was unstable.

Figure 25:
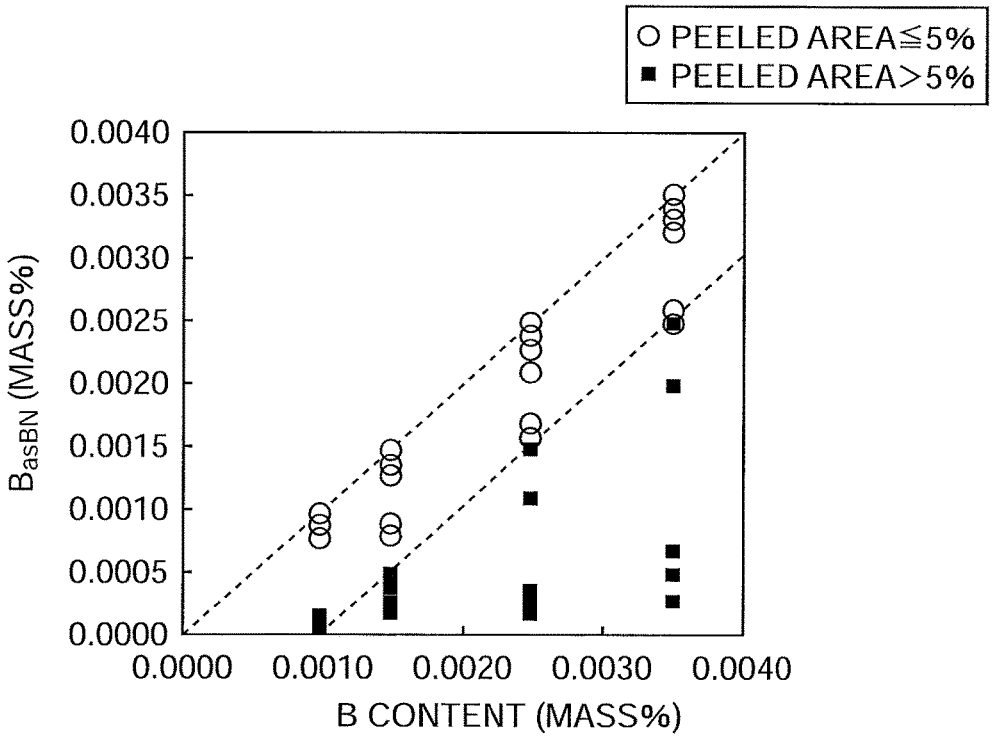
FIG. 25 is a view showing the relationship between the amount of B that has not precipitated as BN and the coating film adhesiveness after the finish annealing.

Similarly, with regard to the samples in which certain amounts or more of MnS, MnSe and BN are precipitated, the relationship between the amount of B that has not precipitated as BN and the coating film adhesiveness after the finish annealing was examined. The evaluation method of the coating film adhesiveness is the same as that used in FIG. 3. This result is shown in FIG. 25. In FIG. 25, the horizontal axis indicates the B content (mass %), and the vertical axis indicates the value (mass %) obtained by converting the precipitation amount of BN into B. Further, white circles each indicate that the coating film adhesiveness improved, and black squares each indicate that coating film peeling occurred and the coating film adhesiveness did not improve. As shown in FIG. 25, in the case of the samples in which the amount of B that has not precipitated as BN is a certain value or less and the atmosphere of the finish annealing being appropriate, the coating film adhesiveness improved.

Further, as a result of examination of a form of the precipitates in the samples each having the good magnetic property and coating film adhesiveness, it turned out that MnS or MnSe becomes a nucleus and BN compositely precipitates around MnS or MnSe. Such composite precipitates are effective as inhibitors that stabilize the secondary recrystallization. Further, when the atmosphere of the finish annealing is set to an appropriate condition, BN is decomposed in an appropriate temperature region during the finish annealing to supply B to an interface between a steel sheet and a glass coating film at the time of the glass coating film being formed, which contributes to the improvement of the coating film adhesiveness finally.

Next, the relationship between a condition of the hot rolling and the magnetic property after the finish annealing was examined. This result is shown in FIG. 26 and FIG. 27.

Figure 26:
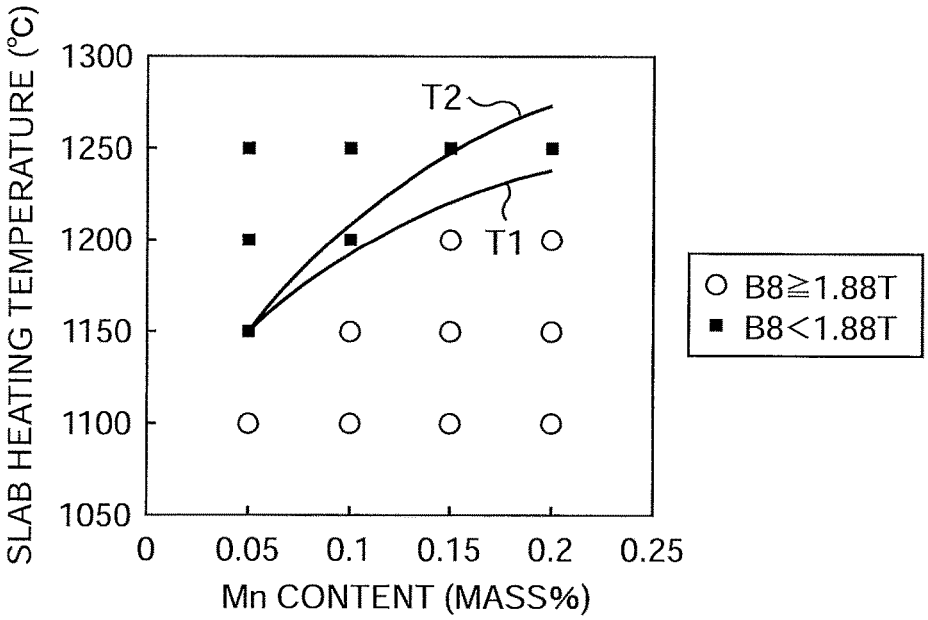
FIG. 26 is a view showing the relationship between a condition of hot rolling and the magnetic property after the finish annealing.
Figure 27:
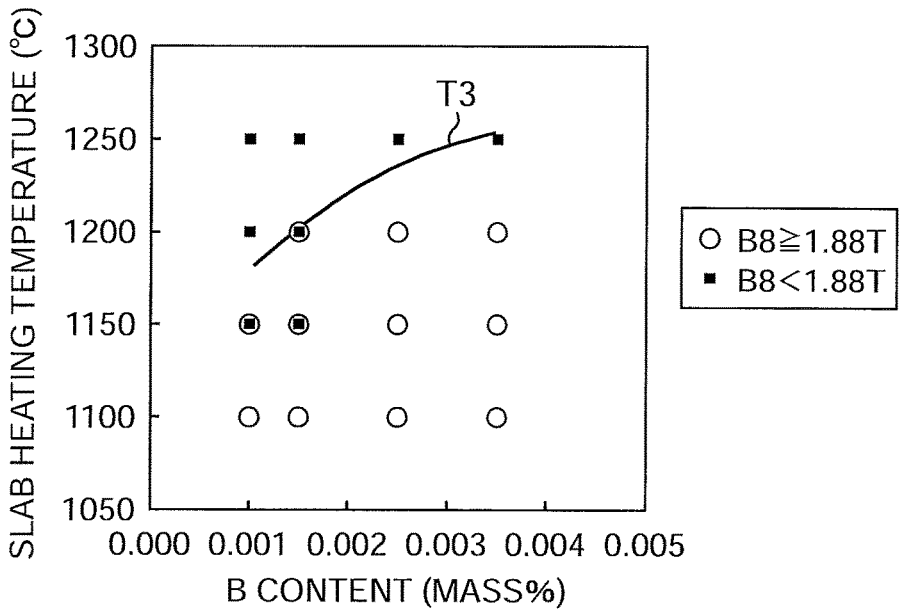
FIG. 27 is a view showing the relationship between the condition of the hot rolling and the magnetic property after the finish annealing.

In FIG. 26, the horizontal axis indicates the Mn content (mass %) and the vertical axis indicates the slab heating temperature (° C.) at the time of hot rolling. In FIG. 27, the horizontal axis indicates the B content (mass %) and the vertical axis indicates the slab heating temperature (° C.) at the time of hot rolling. Further, white circles each indicate that the magnetic flux density B8 was 1.88 T or more, and black squares each indicate that the magnetic flux density B8 was less than 1.88 T. Further, the two curves in FIG. 26 indicate the solution temperature T1 (° C.) of MnS expressed by Expression (2) and the solution temperature T2 (° C.) of MnSe expressed by Expression (3), and the curve in FIG. 27 indicates the solution temperature T3 (° C.) of BN expressed by Expression (4). As shown in FIG. 26, it turned out that in the samples in which the slab heating is performed at a temperature determined according to the Mn content or lower, the high magnetic flux density B8 is obtained. Further, it also turned out that this temperature approximately agrees with the solution temperature T1 of MnS and the solution temperature T2 of MnSe. Further, as shown in FIG. 27, it also turned out that in the samples in which the slab heating is performed at a temperature determined according to the B content or lower, the high magnetic flux density B8 is obtained. Further, it also turned out that this temperature approximately agrees with the solution temperature T3 of BN. That is, it turned out that it is effective to perform the slab heating in the temperature region where MnS, MnSe, and BN are not completely solid-dissolved.

Figure 28:
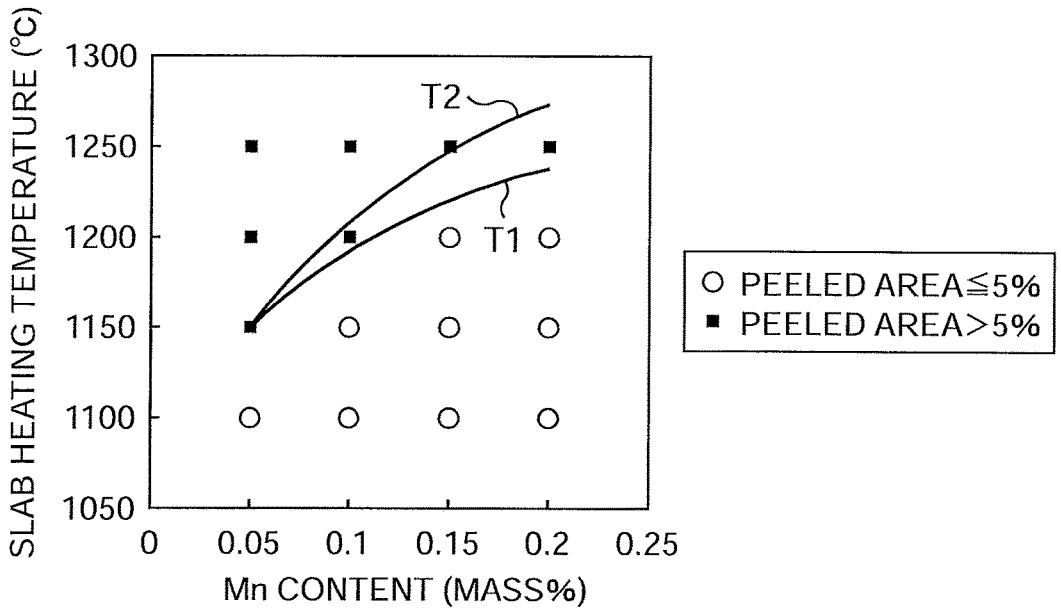
FIG. 28 is a view showing the relationship between the condition of the hot rolling and the coating film adhesiveness after the finish annealing.
Figure 29:
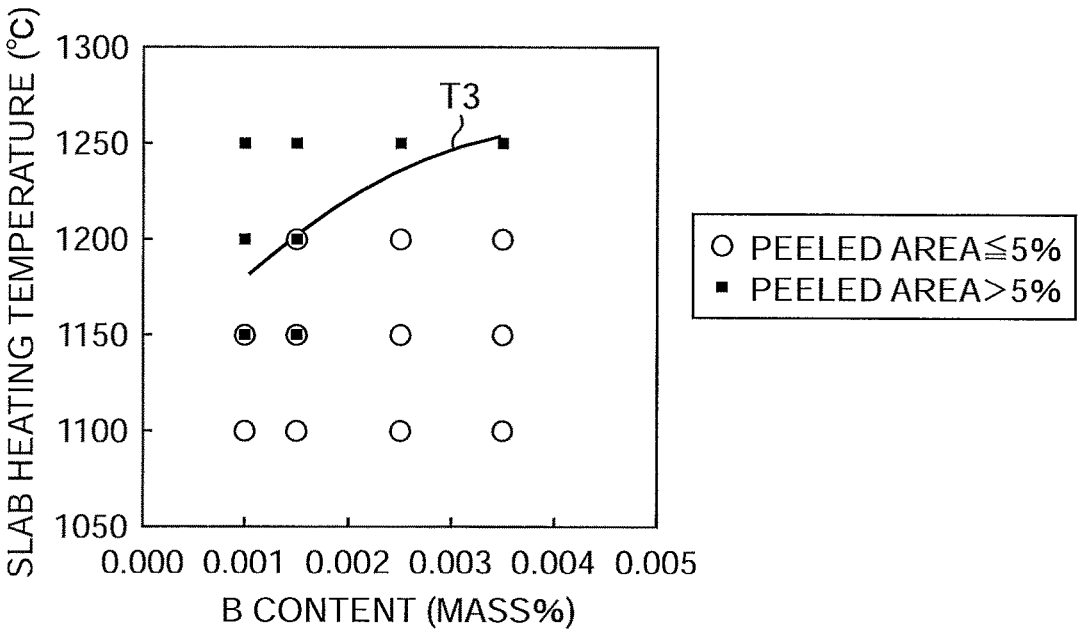
FIG. 29 is a view showing the relationship between the condition of the hot rolling and the coating film adhesiveness after the finish annealing.

Similarly, the relationship between the condition of the hot rolling and the coating film adhesiveness after the finish annealing was examined. This result is shown in FIG. 28 and FIG. 29. In FIG. 28, the horizontal axis indicates the Mn content (mass %) and the vertical axis indicates the slab heating temperature (° C.) at the time of hot rolling. In FIG. 29, the horizontal axis indicates the B content (mass %) and the vertical axis indicates the slab heating temperature (° C.) at the time of hot rolling. Further, white circles each indicate that the coating film adhesiveness improved, and black squares each indicate that coating film peeling occurred and the coating film adhesiveness did not improve. Further, the two curves in FIG. 28 indicate the solution temperature T1 (° C.) of MnS expressed by Expression (2) and the solution temperature T2 (° C.) of MnSe expressed by Expression (3), and the curve in FIG. 29 indicates the solution temperature T3 (° C.) of BN expressed by Expression (4). As shown in FIG. 28, it turned out that in the samples in which the slab heating is performed at a temperature determined according to the Mn content or lower and the atmosphere of the finish annealing is the appropriate condition, the coating film adhesiveness improves. Further, it also turned out that this temperature approximately agrees with the solution temperature T1 of MnS and the solution temperature T2 of MnSe. Further, as shown in FIG. 29, it also turned out that in the samples in which the slab heating is performed at a temperature determined according to the B content or lower and the atmosphere of the finish annealing is the appropriate condition, the coating film adhesiveness improves. Further, it also turned out that this temperature approximately agrees with the solution temperature T3 of BN. That is, it turned out that it is effective that the slab heating is performed in the temperature region where MnS, MnSe, and BN are not solid-dissolved completely and the atmosphere of the finish annealing is appropriate.

Further, as a result of examination of precipitation behavior of BN, it turned out that a precipitation temperature region of BN is 800° C. to 1000° C.

Further, the present inventors examined a finishing temperature of the finish rolling in the hot rolling. In this examination, first, various silicon steel slabs each containing Si: 3.3 mass %, C: 0.06 mass %, acid-soluble Al: 0.026 mass %, N: 0.009 mass %, Mn: 0.1 mass %, S: 0.005 mass %, Se: 0.007 mass %, and B: 0.001 mass % to 0.004 mass %, and a balance being composed of Fe and inevitable impurities were obtained. Next, the silicon steel slabs were heated at a temperature of 1200° C. and were subjected to hot rolling. In the hot rolling, rough rolling was performed at 1050° C. and then finish rolling was performed at 1020° C. to 900° C., and thereby hot-rolled steel strips each having a thickness of 2.3 mm were obtained. Then, a cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and cold-rolled steel strips each having a thickness of 0.22 mm were obtained. Thereafter, the cold-rolled steel strips were heated at a speed of 15° C./s, and were subjected to decarburization annealing at a temperature of 850° C., and decarburization-annealed steel strips were obtained. Subsequently, the decarburization-annealed steel strips were annealed in an ammonia containing atmosphere to increase nitrogen in the steel strips up to 0.021 mass %. Next, an annealing separating agent having MgO as its main component was applied on the steel strips, and finish annealing was performed in a manner that of the atmosphere from 800° C. to 1100° C., the nitrogen partial pressure $P_{N2}$ is set to 0.5 and the oxygen potential Log $[P_{H2O}/P_{H2}]$ is set to −1, and of the atmosphere at 1100° C. or higher, the nitrogen partial pressure $P_{N2}$ is set to 0.1 or less and the oxygen potential Log $[P_{H2O}/P_{H2}]$ is set to −2 or less, and various samples were manufactured.

Figure 30:
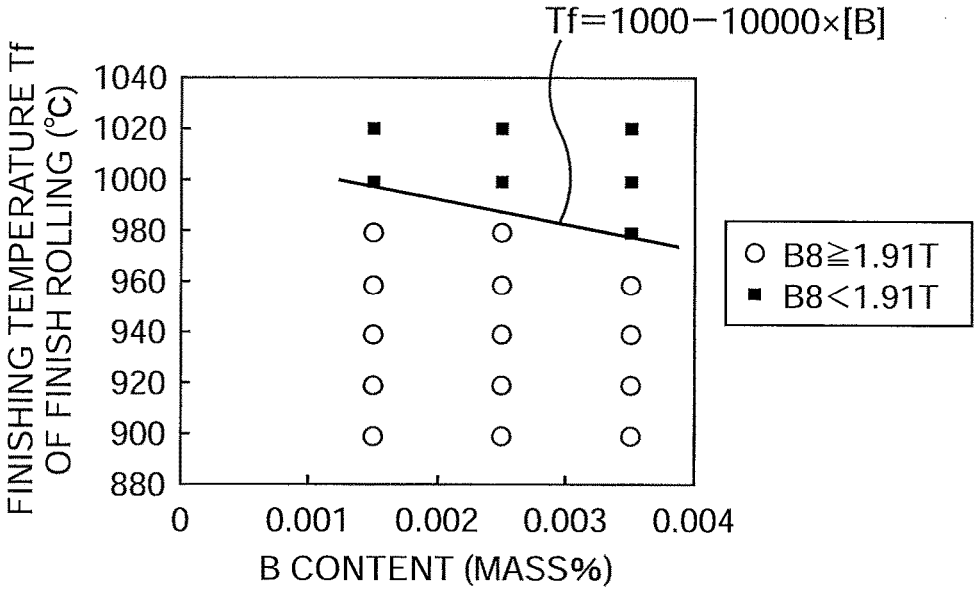
FIG. 30 is a view showing the relationship between a finishing temperature of finish rolling in the hot rolling and the magnetic property after the finish annealing.

Then, the relationship between the finishing temperature of the finish rolling in the hot rolling and the magnetic property after the finish annealing was examined. This result is shown in FIG. 30. In FIG. 30, the horizontal axis indicates the B content (mass %), and the vertical axis indicates the finishing temperature Tf of the finish rolling. Further, white circles each indicate that the magnetic flux density B8 was 1.91 T or more, and black squares each indicate that the magnetic flux density B8 was less than 1.91 T. As shown in FIG. 30, it turned out that when the finishing temperature Tf of the finish rolling satisfies Expression (5), the high magnetic flux density B8 is obtained. This is conceivably because by controlling the finishing temperature Tf of the finish rolling, the precipitation of BN was further promoted.

Figure 31:
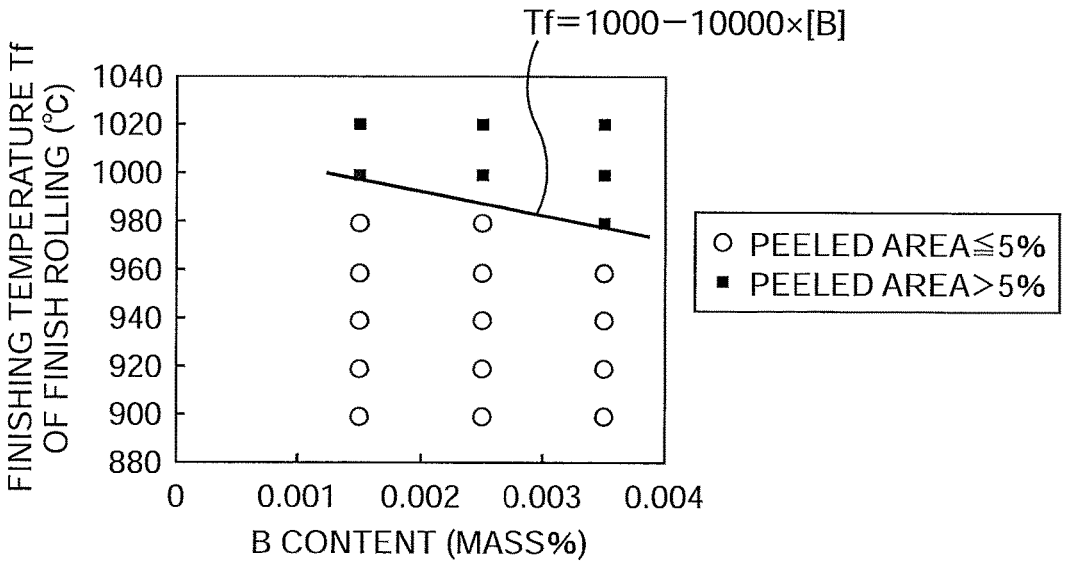
FIG. 31 is a view showing the relationship between the finishing temperature of the finish rolling in the hot rolling and the coating film adhesiveness after the finish annealing.

Similarly, the relationship between the finishing temperature of the finish rolling in the hot rolling and the coating film adhesiveness after the finish annealing was examined. This result is shown in FIG. 31. In FIG. 31, the horizontal axis indicates the B content (mass %) and the vertical axis indicates the finishing temperature Tf of the finish rolling. Further, white circles each indicate that the coating film adhesiveness improved, and black squares each indicate that coating film peeling occurred and the coating film adhesiveness did not improve. As shown in FIG. 31, it turned out that when the finishing temperature Tf of the finish rolling satisfies Expression (5) and the atmosphere of the finish annealing is the appropriate condition, the coating film adhesiveness improves.

From the results of the first to third experiments, it is found that the precipitated form of BN and the atmosphere of the finish annealing are controlled as above, and thereby the magnetic property and coating film adhesiveness of the grain-oriented electrical steel sheet improve stably. Incidentally, when the atmosphere of the finish annealing was not set to the values by Expressions (9) and (10), the magnetic property was good but the coating film adhesiveness improving effect was not obtained. The detailed reason why when B does not compositely precipitate with MnS or MnSe as BN, the secondary recrystallization becomes unstable, thereby making it impossible to obtain the good magnetic property and unless the atmosphere of the finish annealing is controlled, the coating film adhesiveness improving effect does not appear has not been clarified yet so for, but is conceived as follows.

First, the magnetic property is as follows. Generally, B in a solid solution state is likely to segregate in grain boundaries, and BN that has precipitated independently after the hot rolling is often fine. B in a solid solution state and fine BN suppress grain growth at the time of primary recrystallization as strong inhibitors in a low-temperature region where the decarburization annealing is performed, and in a high-temperature region where the finish annealing is performed, B in a solid solution state and fine BN do not function as inhibitors locally, thereby turning the crystal grain structure of the steel into a mixed grain structure. Thus, when a primary recrystallization temperature is in the low-temperature region, primary recrystallized grains are small, so that the magnetic flux density of the grain-oriented electrical steel sheet becomes low. Further, in the high-temperature region, the crystal grain structure is turned into the mixed grain structure, so that the secondary recrystallization becomes unstable.

Next, the coating film adhesiveness is as follows. First, with regard to the state of B after the purification annealing, it is conceivable that B existing in the interface between the glass coating film and the steel sheet exists as oxide. It is conceivable that B exists as BN before the purification occurs, but BN is decomposed by the purification and B in the steel sheet diffuses to the vicinity of the surface of the steel sheet to form oxide. Details of the oxide are not clarified, but the present inventors presume that B forms composite oxide with Mg, Si, and Al existing in the glass coating film and at the bottom of the glass coating film.

BN is decomposed at a later stage of the finish annealing and B is concentrated on the surface of the steel sheet, but when the concentration of B occurs at an early stage of the glass coating film being formed, the interface structure after the completion of the finish annealing is in a state where B is concentrated in a portion, of the glass coating film, shallower than the bottom. For this reason, the interface between the glass coating film and the steel sheet is not brought into the structure provided with the characteristics of the present invention. On the other hand, when the decomposition of BN is started in a state where the formation of the glass coating film has advanced to a predetermined extent, B is concentrated in the vicinity of the bottom of the glass coating film and the interface between the glass coating film and the steel sheet is brought into the structure provided with the characteristics of the present invention. Here, the state where the formation of the glass coating film has advanced to a predetermined extent is a situation where the formation of the bottom of the glass coating film has started, and a temperature region of the situation is about 1000° C. or higher. Thus, in order to make the interface structure between the glass coating film and the steel sheet of the present invention, B is concentrated at this temperature or higher, which may be set as the condition, but for this, the precipitate of BN in the steel sheet needs to exist stably until the temperature becomes high.

Unless BN is fine and is compositely precipitated with MnS or MnSe, the decomposition temperature in the finish annealing decreases and solid-dissolved B is concentrated on the interface between the glass coating film and the steel sheet before the bottom of the glass coating film is formed, which does not contribute to improvement of an anchor effect of the interface between the glass coating film and the steel sheet. For this reason, it is conceivable that the coating film adhesiveness improving effect disappear.

Thus, in order to make B function effectively, it is necessary to control the atmosphere of the finish annealing in a high temperature region. In order to achieve this, the inventors found that it is effective to suppress the decomposition of BN from 800° C. to 1100° C. and at 1100° C. or higher, promote the decomposition of BN and make the atmosphere where the purification is advanced.

Incidentally, B is also used as an additive of the annealing separating agent, and thus in the grain-oriented electrical steel sheet that has been subjected to the finish annealing, segregation of B is sometimes observed in the vicinity of the interface between the glass coating film and the steel sheet. However, B derived from the annealing separating agent makes it difficult to obtain the interface structure between the glass coating film and the steel sheet in the present invention. In order to make the concentration situation such as the interface structure between the glass coating film and the steel sheet of the present invention by B derived from the annealing separating agent, B in sufficient amount needs to diffuse in the steel sheet from the surface of the steel sheet. It is conceivable that the oxide of B has a relatively high oxygen equilibrium dissociation pressure among the elements constituting the glass coating film, and thus the situation where B diffuses to the bottom of the glass coating film that is supposed to be lower in the oxygen potential than the surface layer of the glass coating film to form oxide does not occur easily. Thus, it is difficult to make the interface structure between the glass coating film and the steel sheet in the present invention by using B derived from the annealing separating agent.

Next, there will be explained reasons for limiting respective conditions of the present invention below.

First, with regard to the interface structure between the glass coating film and the steel sheet, when in the deepest portion, the concentration position of B is deeper than a concentration position of Mg, the adhesiveness of the glass coating film improves. As for a value, in the event that the GDS analysis is performed from the surface of the glass coating film, the peak position, of B, of the concentration in the deepest portion is expressed by a discharge time to be set to tB (second) and the peak position of Mg is set to tMg (second), and in this case, the following condition is set, thereby making it possible to obtain a good result.

$$tMg \times 1.6 \leq tB \leq tMg \times 5 \quad (1)$$

On the other hand, when the value tB is too large, the magnetic property tends to deteriorate.

For this reason, the value tB is preferably set to tMg×5.0 or less.

Next, there will be described reasons for limiting the atmosphere of the finish annealing. While the temperature is 800° C. to 1100° C., the nitrogen partial pressure $P_{N2}$ is maintained to 0.75 to 0.2 and the oxygen potential Log $[P_{H2O}/P_{H2}]$ is set to 0.7 or less. This is to suppress the decomposition of BN in the temperature region of 800 to 1100° C. Unless the decomposition of BN is suppressed in this temperature region, it makes impossible to obtain the good adhesiveness. This is because unless the decomposition of BN is suppressed sufficiently in the case of the inappropriate atmosphere, B diffuses to the surface of the steel sheet since the early period of the finish annealing and is concentrated in the shallow position from the surface of the steel sheet.

Details of the condition of the atmosphere of the finish annealing are as follows. That is, the nitrogen partial pressure $P_{N2}$ is set to the value of 0.2 or more in order to suppress the decomposition of BN appropriately. On the other hand, when it exceeds 0.75 to be too large, the decomposition of BN is suppressed excessively and the good secondary recrystallization does not occur. Further, when the oxygen potential Log $[P_{H2O}/P_{H2}]$ exceeds −0.7, oxidation of B occurs, to thereby promote the decomposition of BN consequently. Thus, in order to suppress the decomposition of BN in the temperature region of 800 to 1100° C., the atmosphere of the finish annealing satisfies the above-described conditions of the nitrogen partial pressure $P_{N2}$ and the oxygen potential Log $[P_{H2O}/P_{H2}]$.

Further, as for control of the atmosphere of the finish annealing, when the oxygen partial pressure and the nitrogen partial pressure are controlled according to (11) Expression, the better result can be obtained.

$$4 \text{ Log } [P_{N2}] = 3 \text{ Log } [P_{H2O}/P_{H2}] + A + 3455/T \quad (11)$$

Here, $-3.72 \geq 3 \text{ Log } [P_{H2O}/P_{H2}] + A \geq -5.32$ and $-0.7 \geq \text{Log } [P_{H2O}/P_{H2}]$ are satisfied and T represents the absolute temperature.

Further, the temperature region where the above-described atmosphere conditions are set is set to 800° C. to 1100° C. If the temperature region is lower than 800° C., it overlaps with a temperature region of the early stage of the formation of the glass coating film, and when in this region, the above-described oxygen potential Log $[P_{H2O}/P_{H2}]$ is set, the sound glass coating film cannot be obtained and the coating film adhesiveness is likely to be adversely affected. When the lower limit temperature is too low, the adhesiveness is adversely affected, and when it is too high, the decomposition of BN cannot be suppressed sufficiently, and thus in this embodiment, the lower limit temperature is set to 800° C. On the other hand, when the upper limit temperature is too high, the secondary recrystallization becomes unstable, and when the upper limit temperature is too low, B is easily concentrated in the vicinity of poles of the steel sheet surface and the adhesiveness improving effect is likely to disappear. Thus, in this embodiment, the atmosphere of the above-described conditions is made from 800° C. to 1100° C.

With regard to the nitrogen partial pressure $P_{N2}$, a method of adjusting the atmosphere of the finish annealing can be performed by controlling a mixed ratio of a nitrogen gas and a gas that does not react with the steel sheet such as hydrogen. Further, with regard to the oxygen potential Log $[P_{H2O}/P_{H2}]$, it can be performed by controlling the dew point of the atmosphere, or the like.

Further, in the atmosphere at a temperature in excess of 1100° C., the nitrogen partial pressure $P_{N2}$ is preferably set to 0.1 or less and the oxygen potential Log $[P_{H2O}/P_{H2}]$ is preferably set to −2 or less. This is to concentrate B in a predetermined position as oxide and to further advance the purification after the secondary recrystallization. The reason why the upper limit of the oxygen potential Log $[P_{H2O}/P_{H2}]$ is set to −2 is to further concentrate B in the vicinity of the surface of the steel sheet as oxide. When this value is too high, the concentration of oxide of B occurs in the deep portion of the steel sheet to make it difficult to obtain the good magnetic property. Further, the reason why the nitrogen partial pressure $P_{N2}$ is set to 0.1 or less is because when the nitrogen partial pressure $P_{N2}$ is too high, the concentration of oxide of B occurs in the vicinity of the surface of the steel sheet to make it impossible to obtain the good adhesiveness. Further, this is also because there is sometimes a case that the purification does not advance easily and an annealing time period becomes long to be uneconomic. As has been described above in detail, in order to make B function effectively so as to improve the coating film adhesiveness, it is necessary to control the nitrogen partial pressure $P_{N2}$ and the oxygen potential Log $[P_{H2O}/P_{H2}]$ in the high temperature region during the finish annealing.

Next, there will be described reasons for limiting the component ranges.

The silicon steel material used in this embodiment contains Si: 0.8 mass % to 7 mass %, acid-soluble Al: 0.01 mass % to 0.065 mass %, N: 0.004 mass % to 0.012 mass %, Mn: 0.05 mass % to 1 mass %, and S and Se: 0.003 mass % to 0.015 mass % in total amount, B: 0.0005 mass % to 0.0080 mass %, and a C content being 0.085 mass % or less, and a balance being composed of Fe and inevitable impurities.

Further, the grain-oriented electrical steel sheet obtained finally contains Si of 0.8 mass % to 7 mass %, Mn of 0.05 mass % to 1 mass %, B of 0.0005 mass % to 0.0080 mass %, each content of Al, C, N, S, and Se of 0.005 mass % or less, and a balance being composed of Fe and inevitable impurities.

Si increases electrical resistance to reduce a core loss. However, when the Si content exceeds 7 mass %, the cold rolling becomes difficult to be performed, and a crack is likely to be caused at the time of cold rolling. Thus, the Si content is set to 7 mass % or less, and is preferably 4.5 mass % or less, and is further preferably 4 mass % or less. Further, when the Si content is less than 0.8 mass %, a y transformation is caused at the time of finish annealing to thereby make a crystal orientation of the grain-oriented electrical steel sheet deteriorate. For this reason, the Si content is set to 0.8 mass % or more, and is preferably 2 mass % or more, and is further preferably 2.5 mass % or more.

C is an element effective for controlling the primary recrystallized structure, but adversely affects the magnetic property. For this reason, in this embodiment, before the finish annealing, the decarburization annealing is performed. However, when the C content exceeds 0.085 mass %, the time taken for the decarburization annealing becomes long, and productivity in industrial production is impaired. For this reason, the C content is set to 0.085 mass % or less, and is preferably 0.07 mass % or less.

Further, when exceeding 0.005 mass % in the grain-oriented electrical steel sheet to be obtained finally, C adversely affects the magnetic property, and thus the C content in the grain-oriented electrical steel sheet to be obtained finally is set to 0.005 mass % or less.

Acid-soluble Al bonds to N to precipitate as (Al, Si)N and functions as an inhibitor. When the content of acid-soluble Al falls within a range of 0.01 mass % to 0.065 mass %, the secondary recrystallization is stabilized. For this reason, the content of acid-soluble Al is set to not less than 0.01 mass % nor more than 0.065 mass %. Further, the content of acid-soluble Al is preferably 0.02 mass % or more, and is further preferably 0.025 mass % or more. Further, the content of acid-soluble Al is preferably 0.04 mass % or less, and is further preferably 0.03 mass % or less.

Further, when exceeding 0.005 mass % in the grain-oriented electrical steel sheet to be obtained finally, Al adversely affects the magnetic property, and thus the Al content in the grain-oriented electrical steel sheet to be obtained finally is set to 0.005 mass % or less.

B bonds to N to compositely precipitate with MnS or MnSe as BN and functions as an inhibitor. When the B content falls within a range of 0.0005 mass % to 0.0080 mass %, the secondary recrystallization is stabilized. For this reason, the B content is set to not less than 0.0005 mass % nor more than 0.0080 mass %. Further, the B content is preferably 0.001 mass % or more, and is further preferably 0.0015 mass % or more. Further, the B content is preferably 0.0040 mass % or less, and is further preferably 0.0030 mass % or less.

Further, to the grain-oriented electrical steel sheet to be obtained finally, B is added because of being derived from the annealing separating agent, or the like. When exceeding 0.0080 mass %, B adversely affects the magnetic property, and thus the B content in the grain-oriented electrical steel sheet to be obtained finally is set to 0.0005 mass % to 0.0080 mass %.

N bonds to B or Al to function as an inhibitor. When the N content is less than 0.004 mass %, it is not possible to obtain a sufficient amount of the inhibitor. For this reason, the N content is set to 0.004 mass % or more, and is preferably 0.006 mass % or more, and is further preferably 0.007 mass % or more. On the other hand, when the N content exceeds 0.012 mass %, a hole called a blister occurs in the steel strip at the time of cold rolling. For this reason, the N content is set to 0.012 mass % or less, and is preferably 0.010 mass % or less, and is further preferably 0.009 mass % or less.

Further, when exceeding 0.005 mass % in the grain-oriented electrical steel sheet to be obtained finally, N adversary affects the magnetic property, and thus the N content in the grain-oriented electrical steel sheet to be obtained finally is set to 0.005 mass % or less.

Mn, S and Se produce MnS and MnSe to be a nucleus around which BN compositely precipitates, and composite precipitates function as inhibitors. When the Mn content falls within a range of 0.05 mass % to 1 mass %, the secondary recrystallization is stabilized. For this reason, the Mn content is set to not less than 0.05 mass % nor more than 1 mass %. Further, the Mn content is preferably 0.08 mass % or more, and is further preferably 0.09 mass % or more. Further, the Mn content is preferably 0.50 mass % or less, and is further preferably 0.2 mass % or less.

Further, when Mn falls outside the range of 0.05 mass % to 1 mass % even in the grain-oriented electrical steel sheet to be obtained finally, the secondary recrystallization becomes unstable to adversely affect the magnetic property, and thus the Mn content in the grain-oriented electrical steel sheet to be obtained finally is set to 0.05 mass % to 1 mass %.

Further, when the content of S and Se falls within a range of 0.003 mass % to 0.015 mass % in total amount, the secondary recrystallization is stabilized. For this reason, the content of S and Se is set to not less than 0.003 mass % nor more than 0.015 mass % in total amount. Further, in terms of preventing occurrence of a crack in the hot rolling, Expression (14) below is preferably satisfied. Incidentally, only either S or Se may be contained in the silicon steel material, or both S and Se may also be contained in the silicon steel material. When both S and Se are contained, it is possible to promote the precipitation of BN more stably and to improve the magnetic property stably.

$$[Mn]/([S]+[Se])\geq 4 \quad (14)$$

Further, when exceeding 0.005 mass % in the grain-oriented electrical steel sheet to be obtained finally, S and Se adversary affect the magnetic property, and thus the content of S and Se in the grain-oriented electrical steel sheet to be obtained finally is set to 0.005 mass % or less.

Ti forms coarse TiN to affect the precipitation amounts of BN and (Al, Si)N functioning as inhibitors. When the Ti content exceeds 0.004 mass %, the good magnetic property is not easily obtained. For this reason, the Ti content is preferably 0.004 mass % or less.

Further, one type or more selected from a group consisting of Cr, Cu, Ni, P, Mo, Sn, Sb, and Bi may also be contained in the silicon steel material in ranges below.

Cr improves an oxide layer formed at the time of decarburization annealing, and is effective for forming the glass coating film. However, when the Cr content exceeds 0.3 mass %, decarburization is noticeably prevented. For this reason, the Cr content is set to 0.3 mass % or less.

Cu increases specific resistance to reduce a core loss. However, when the Cu content exceeds 0.4 mass %, this effect is saturated. Further, a surface flaw called "copper scab" is sometimes caused at the time of hot rolling. For this reason, the Cu content is set to 0.4 mass % or less.

Ni increases specific resistance to reduce a core loss. Further, Ni controls a metallic structure of the hot-rolled steel strip to improve the magnetic property. However, when the Ni content exceeds 1 mass %, the secondary recrystallization becomes unstable. For this reason, the Ni content is set to 1 mass % or less.

P increases specific resistance to reduce a core loss. However, when the P content exceeds 0.5 mass %, there is caused a problem in a rolling property. For this reason, the P content is set to 0.5 mass % or less.

Mo improves a surface property at the time of hot rolling. However, when the Mo content exceeds 0.1 mass %, this effect is saturated. For this reason, the Mo content is set to 0.1 mass % or less.

Sn and Sb are grain boundary segregation elements. The silicon steel material used in this embodiment contains Al, so that there is sometimes a case that Al is oxidized by moisture released from the annealing separating agent depending on the condition of the finish annealing. In this case, variations occur in inhibitor strength depending on the position in the grain-oriented electrical steel sheet, and the magnetic property also sometimes varies. However, when the grain boundary segregation elements are contained, the oxidation of Al can be suppressed. That is, Sn and Sb suppress the oxidation of Al to suppress the variations in the magnetic property. However, when the content of Sn and Sb exceeds 0.30 mass % in total amount, the oxide layer is not easily formed at the time of decarburization annealing, thereby making the formation of the glass coating film insufficient. Further, the decarburization is noticeably prevented. For this reason, the content of Sn and Sb is set to 0.3 mass % or less in total amount.

Bi stabilizes precipitates such as sulfides to strengthen the function as an inhibitor. However, when the Bi content exceeds 0.01 mass %, the formation of the glass coating film is adversely affected. For this reason, the Bi content is set to 0.01 mass % or less.

Next, each treatment in this embodiment will be explained.

The silicon steel material (slab) having the above-described components can be manufactured in a manner that, for example, steel is melted in a converter, an electric furnace, or the like, and the molten steel is subjected to a vacuum degassing treatment according to need, and next is subjected to continuous casting. Further, the silicon steel material can also be manufactured in a manner that in place of the continuous casting, an ingot is made to then be bloomed. The thickness of the silicon steel slab is set to, for example, 150 mm to 350 mm, and is preferably set to 220 mm to 280 mm. Further, what is called a thin slab having a thickness of 30 mm to 70 mm may also be manufactured. When the thin slab is manufactured, the rough rolling performed when obtaining the hot-rolled steel strip can be omitted.

After the silicon steel slab is manufactured, the slab heating is performed, and the hot rolling is performed. Then, in this embodiment, BN is made to compositely precipitate with MnS and/or MnSe, and the conditions of the slab heating and the hot rolling are set in such a manner that the precipitation amounts of BN, MnS, and MnSe in the hot-rolled steel strip satisfy Expressions (6) to (8) below.

$$B_{asBN} \geq 0.0005 \quad (6)$$

$$[B]-B_{asBN} \leq 0.001 \quad (7)$$

$$S_{asMnS}+0.5\times Se_{asMnSe} \geq 0.002 \quad (8)$$

Here, "$B_{asBN}$" represents the amount of B that has precipitated as BN (mass %), "$S_{asMnS}$" represents the amount of S that has precipitated as MnS (mass %), and "$Se_{asMnSe}$" represents the amount of Se that has precipitated as MnSe (mass %).

As for B, a precipitation amount and a solid solution amount of B are controlled in such a manner that Expression (6) and Expression (7) are satisfied. A certain amount or more of BN is made to precipitate in order to secure an amount of the inhibitors. Further, when the amount of solid-dissolved B is large, there is sometimes a case that unstable fine precipitates are formed in the subsequent processes to adversely affect the primary recrystallized structure.

MnS and MnSe each function as a nucleus around which BN compositely precipitates. Thus, in order to make BN precipitate sufficiently to thereby improve the magnetic property, the precipitation amounts of MnS and MnSe are controlled in such a manner that Expression (8) is satisfied.

The condition expressed in Expression (7) is derived from FIG. 4, FIG. 14, and FIG. 24. It is found from FIG. 4, FIG. 14, and FIG. 24 that in the case of $[B]-B_{asBN}$ being 0.001 mass % or less, the good magnetic flux density, being the magnetic flux density B8 of 1.88 T or more, is obtained.

The conditions expressed in Expression (6) and Expression (8) are derived from FIG. 2, FIG. 12, and FIG. 22. It is found from FIG. 2 that when $B_{asBN}$ is 0.0005 mass % or more and $S_{asMnS}$ is 0.002 mass % or more, the good magnetic flux density, being the magnetic flux density B8 of 1.88 T or more, is obtained.

Similarly, it is found from FIG. 12 that when $B_{asBN}$ is 0.0005 mass % or more and $Se_{asMnSe}$ is 0.004 mass % or more, the good magnetic flux density, being the magnetic flux density B8 of 1.88 T or more, is obtained. Similarly, it is found from FIG. 22 that when $B_{asBN}$ is 0.0005 mass % or more and $S_{asMnS}+0.5\times Se_{asMnSe}$ is 0.002 mass % or more, the good magnetic flux density, being the magnetic flux density B8 of 1.88 T or more, is obtained. Then, as long as $S_{asMnS}$ is 0.002 mass % or more, $S_{asMnS}+0.5\times Se_{asMnSe}$ becomes 0.002 mass % or more inevitably, and as long as $Se_{asMnSe}$ is 0.004 mass % or more, $S_{asMnS}+0.5\times Se_{asMnSe}$ becomes 0.002 mass % or more inevitably. Thus, it is important that $S_{asMnS}+0.5\times Se_{asMnSe}$ is 0.002 mass % or more.

Further, the slab heating temperature is set so as to satisfy the following conditions.

(i) in the case of S and Se being contained in the silicon steel slab the temperature T1 (° C.) expressed by Expression (2) or lower, the temperature T2 (° C.) expressed by Expression (3) or lower, and the temperature T3 (° C.) expressed by Expression (4) or lower (ii) in the case of no Se being contained in the silicon steel slab the temperature T1 (° C.) expressed by Expression (2) or lower and the temperature T3 (° C.) expressed by Expression (4) or lower (iii) in the case of no S being contained in the silicon steel slab the temperature T2 (° C.) expressed by Expression (3) or lower and the temperature T3 (° C.) expressed by Expression (4) or lower $$T1=14855/(6.82-\log([Mn]\times[S]))-273 \quad (2)$$

$$T2=10733/(4.08-\log([Mn]\times[Se]))-273 \quad (3)$$

$$T3=16000/(5.92-\log([B]\times[N]))-273 \quad (4)$$

This is because when the slab heating is performed at such temperatures, BN, MnS, and MnSe are not completely solid-dissolved at the time of slab heating, and the precipitations of BN, MnS, and MnSe are promoted during the hot rolling. As is clear from FIG. 6, FIG. 16, and FIG. 26, the solution temperatures T1 and T2 approximately agree with the upper limit of the slab heating temperature capable of obtaining the magnetic flux density B8 of 1.88 T or more. Further, as is clear from FIG. 7, FIG. 17, and FIG. 27, the solution temperature T3 approximately agrees with the upper limit of the slab heating temperature capable of obtaining the magnetic flux density B8 of 1.88 T or more.

Further, the slab heating temperature is further preferably set so as to satisfy the following conditions as well. This is to make a preferable amount of MnS or MnSe precipitate during the slab heating.

(i) in the case of no Se being contained in the silicon steel slab a temperature T4 (° C.) expressed by Expression (15) below or lower (ii) in the case of no S being contained in the silicon steel slab a temperature T5 (° C.) expressed by Expression (16) below or lower $$T4=14855/(6.82-\log([Mn-0.0034]\times[S-0.002]))-273 \quad (15)$$

$$T5=10733/(4.08-\log([Mn-0.0034]\times[Se-0.004]))-273 \quad (16)$$

When the slab heating temperature is too high, BN, MnS, and/or MnSe are sometimes solid-dissolved completely. In this case, it becomes difficult to make BN, MnS, and/or MnSe precipitate at the time of hot rolling. Thus, the slab heating is preferably performed at the temperature T1 and/or the temperature T2 or lower, and at the temperature T3 or lower. Further, if the slab heating temperature is the temperature T4 or T5 or lower, a preferable amount of MnS or MnSe precipitates during the slab heating, and thus it becomes possible to make BN compositely precipitate around MnS or MnSe to form effective inhibitors easily.

Further, as for B, the finishing temperature Tf of the finish rolling in the hot rolling is set in such a manner that Expression (5) below is satisfied. This is to further promote the precipitation of BN.

$$Tf\leq 1000-10000\times[B] \quad (5)$$

As is clear from FIG. 10, FIG. 20, and FIG. 30, the condition expressed in Expression (5) approximately agrees with the condition capable of obtaining the magnetic flux density B8 of 1.88 T or more. Further, the finishing temperature Tf of the finish rolling is further preferably set to 800° C. or higher in terms of the precipitation of BN.

After the hot rolling, the annealing of the hot-rolled steel strip is performed. Next, the cold rolling is performed. As described above, the cold rolling may be performed only one time, or may also be performed a plurality of times with the intermediate annealing being performed therebetween. In the cold rolling, the final cold rolling rate is preferably set to 80% or more. This is to develop a good primary recrystallized texture.

Thereafter, the decarburization annealing is performed. As a result, C contained in the steel strip is removed. The decarburization annealing is performed in a moist atmosphere, for example. Further, the decarburization annealing is preferably performed for a time such that, for example, a crystal grain diameter obtained by the primary recrystallization in a temperature region of 770° C. to 950° C. becomes 15 μm or more. This is to obtain the good magnetic property. Subsequently, the application of the annealing separating agent and the finish annealing are performed. As a result, the crystal grains oriented in the {110}<001> orientation preferentially grow by the secondary recrystallization.

Further, the nitriding treatment is performed between start of the decarburization annealing and occurrence of the secondary recrystallization in the finish annealing. This is to form inhibitors of (Al, Si)N. This nitriding treatment may be performed during the decarburization annealing, or may also be performed during the finish annealing. When the nitriding treatment is performed during the decarburization annealing, the annealing is only necessary to be performed in an atmosphere containing a gas having nitriding capability such as ammonia, for example. Further, the nitriding treatment may be performed during a heating zone or a soaking zone in a continuous annealing furnace, or the nitriding treatment may also be performed at a stage after the soaking zone. When the nitriding treatment is performed during the finish annealing, a powder having nitriding capability such as MnN, for example, is only necessary to be added to the annealing separating agent.

In the method of the finish annealing, the temperature falls within the temperature range of 800° C. to 1100° C. and the atmosphere satisfies (9) and (10) Expressions as described previously.

$$0.75\geq P_{N2}\geq 0.2 \quad (9)$$

$$-0.7\geq \mathrm{Log}\ [P_{H2O}/P_{H2}] \quad (10)$$

The finish annealing is normally performed in a mixed atmosphere of nitrogen and hydrogen, so that the nitrogen partial pressure in this atmosphere is controlled and thereby the condition of (9) Expression is achieved. Further, the oxygen potential can be controlled by containing water vapor in the atmosphere, thereby making it possible to satisfy the condition of (10) Expression.

Here, when further, the condition of (11) Expression is satisfied and the atmosphere at 1100° C. or higher satisfies (12) Expression and (13) Expression, the better results can be obtained.

$$4\ \mathrm{Log}\ [P_{N2}]=3\ \mathrm{Log}\ [P_{H2O}/P_{H2}]+A+3345/T \quad (11)$$

$$0.1\geq P_{N2} \quad (12)$$

$$-2\geq \mathrm{Log}\ [P_{H2O}/P_{H2}] \quad (13)$$

Here, $-3.72\geq 3\ \mathrm{Log}\ [P_{H2O}/P_{H2}]+A\geq -5.32$ and $-0.7\geq \mathrm{Log}\ [P_{H2O}/P_{H2}]$ are satisfied and $P_{N2}$ represents the nitrogen partial pressure, $P_{H2O}$ and $P_{H2}$ represent a water vapor partial pressure and a hydrogen partial pressure respectively, A represents a constant determined in such a manner that $3\ \mathrm{Log}\ [P_{H2O}/P_{H2}]+A$ falls within a predetermined range according to $\mathrm{Log}\ [P_{H2O}/P_{H2}]$, and T represents the absolute temperature.

In this embodiment, the inhibitors are strengthened by BN, so that a heating speed in a temperature range of 1000° C. to 1100° C. is preferably set to 15° C./h or less in a heating process of the finish annealing. Further, in place of controlling the heating speed, it is also effective to perform isothermal annealing in which the steel strip is maintained in the temperature range of 1000° C. to 1100° C. for 10 hours or longer.

According to this embodiment as above, it is possible to stably manufacture the grain-oriented electrical steel sheet excellent in the magnetic property.

EXAMPLE

Next, experiments conducted by the present inventors will be explained. The conditions and so on in the experiments are examples employed for confirming the practicability and the effects of the present invention, and the present invention is not limited to those examples.

Example 1

Slabs each having a composition shown in Table 1 and a balance being composed of Fe and inevitable impurities were made. Next, the slabs were heated at 1100° C., and thereafter were subjected to finish rolling at 900° C. Incidentally, the heating temperature of 1100° C. was a value falling below all the values of the temperatures T1, T2, and T3 calculated from the composition in Table 1. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and decarburization-annealed steel strips were obtained. Subsequently, the decarburization-annealed steel strips were annealed in an ammonia containing atmosphere to increase nitrogen in the steel strips up to 0.023 mass %. Next, an annealing separating agent having MgO as its main component was applied on the steel strips, and of the atmosphere up to 800° C., the nitrogen partial pressure $P_{N2}$ was set to 0.5 and the oxygen potential Log $[P_{H2O}/P_{H2}]$ was set to −0.5, and of the atmosphere from 800° C. to 1100° C., the nitrogen partial pressure $P_{N2}$ was set to 0.5 and the oxygen potential Log $[P_{H2O}/P_{H2}]$ was set to −1, and of the atmosphere at 1100° C. or higher, the nitrogen partial pressure $P_{N2}$ was set to 0.1 or less and the oxygen potential Log $[P_{H2O}/P_{H2}]$ was set to −2 or less, and the steel strips were heated up to 1200° C. at a speed of 15° C./h and were subjected to finish annealing.

Steel sheets obtain in this manner had compositions shown in Table 2. On each of such samples obtained after the finish annealing, the situation of coating films and the magnetic property (magnetic flux density B8) were measured. First, with regard to the situation of coating films, the proportion of forsterite in a glass coating film and peak positions of Mg and B by the GDS were examined. Incidentally, before performing the measurement by the GDS, a coating solution composed of 100 g of an aluminum biphosphate solution having a solid content concentration of 50%, 102 g of colloidal silica having a solid content concentration of 20%, and 5.4 g of chromic anhydride was made. Then, the coating solution was applied on the steel sheet having the glass coating film obtained after the finish annealing to be 5 g/m$^2$ per one side after being baked and was dried, and then was baked at 900° C. The thickness of a secondary coating film was 1.5 μm in this case.

Further, the magnetic property (magnetic flux density B8) was measured based on JIS C2556. Further, the coating film adhesiveness was also tested by the following procedures. First, a coating solution composed of 100 g of an aluminum biphosphate solution having a solid content concentration of 50%, 102 g of colloidal silica having a solid content concentration of 20%, and 5.4 g of chromic anhydride was made. Then, the coating solution was applied on the steel sheet having the glass coating film obtained after the finish annealing to be 10 g/m$^2$ per one side after being baked and was dried, and then was baked at 900° C. Next, this steel sheet was wound around a round bar having a diameter of 20ϕ and then a peeled area of the coating film to expose the steel sheet on the inner side of the bent portion was measured. When the peeled area was 5% or less, the adhesiveness was determined to be good. Results of the above test are shown in Table 3.

TABLE 1

| | STEEL MATERIAL | CHEMICAL COMPOSITION(mass %) | | | | | | | |
|---|---|---|---|---|---|---|---|---|---|
| | No. | Si | B | C | N | S | Se | Al | Mn |
| INVENTION EXAMPLE | A1 | 2.5 | 0.0025 | 0.06 | 0.008 | 0.007 | — | 0.03 | 0.1 |
| | A2 | 4 | 0.0025 | 0.05 | 0.008 | 0.007 | — | 0.03 | 0.1 |
| | A3 | 3.4 | 0.0005 | 0.06 | 0.008 | 0.007 | — | 0.03 | 0.1 |
| | A4 | 3.4 | 0.008 | 0.06 | 0.008 | 0.007 | — | 0.03 | 0.1 |
| | A5 | 3.4 | 0.0025 | 0.06 | 0.008 | 0.007 | — | 0.04 | 0.1 |
| | A6 | 3.4 | 0.0025 | 0.06 | 0.008 | 0.007 | — | 0.03 | 0.3 |
| | A7 | 3.4 | 0.0025 | 0.08 | 0.008 | 0.007 | — | 0.03 | 0.1 |
| | A8 | 3.4 | 0.0025 | 0.06 | 0.008 | 0.012 | — | 0.03 | 0.1 |
| | A9 | 3.4 | 0.0025 | 0.06 | 0.008 | 0.007 | 0.006 | 0.03 | 0.1 |
| | A10 | 3.4 | 0.002 | 0.06 | 0.008 | 0.007 | — | 0.03 | 0.1 |
| | A11 | 3.4 | 0.002 | 0.06 | 0.008 | 0.007 | — | 0.03 | 0.15 |
| | A12 | 3.4 | 0.0025 | 0.06 | 0.011 | 0.007 | — | 0.03 | 0.1 |
| COMPARATIVE EXAMPLE | A13 | 0.6 | 0.0025 | 0.06 | 0.008 | 0.007 | — | 0.03 | 0.1 |
| | A14 | 7.5 | 0.0025 | 0.06 | 0.008 | 0.007 | — | 0.03 | 0.1 |
| | A15 | 3.4 | 0.0002 | 0.06 | 0.008 | 0.007 | — | 0.03 | 0.1 |
| | A16 | 3.4 | 0.01 | 0.06 | 0.008 | 0.007 | — | 0.03 | 0.1 |
| | A17 | 3.4 | 0.0025 | 0.06 | 0.008 | 0.007 | — | 0.07 | 0.1 |
| | A18 | 3.4 | 0.0025 | 0.06 | 0.008 | 0.007 | — | 0.03 | 0.1 |
| | A19 | 3.4 | 0.0025 | 0.086 | 0.008 | 0.007 | — | 0.03 | 0.1 |
| | A20 | 3.4 | 0.0025 | 0.06 | 0.014 | 0.007 | — | 0.03 | 0.1 |
| | A21 | 3.4 | 0.0025 | 0.06 | 0.008 | 0.016 | — | 0.03 | 0.1 |
| | A22 | 3.4 | 0.0025 | 0.06 | 0.008 | 0.009 | 0.007 | 0.03 | 0.1 |

TABLE 2

| TEST | STEEL SHEET No. | CHEMICAL COMPOSITION(mass %) Si | B | C | N | S | Se | Al | Mn |
|---|---|---|---|---|---|---|---|---|---|
| INVENTION EXAMPLE | A1 | 2.5 | 0.002 | 0.0005 | 0.001 | 0.001 | <0.0005 | 0.002 | 0.1 |
| | A2 | 4 | 0.002 | 0.0005 | 0.001 | 0.001 | <0.0005 | 0.002 | 0.1 |
| | A3 | 3.3 | 0.0001 | 0.0005 | 0.001 | 0.001 | <0.0005 | 0.002 | 0.1 |
| | A4 | 3.3 | 0.008 | 0.0005 | 0.001 | 0.001 | <0.0005 | 0.002 | 0.1 |
| | A5 | 3.3 | 0.002 | 0.0005 | 0.001 | 0.001 | <0.0005 | 0.005 | 0.1 |
| | A6 | 3.3 | 0.002 | 0.0005 | 0.001 | 0.001 | <0.0005 | 0.002 | 0.3 |
| | A7 | 3.3 | 0.002 | 0.005 | 0.001 | 0.001 | <0.0005 | 0.002 | 0.1 |
| | A8 | 3.3 | 0.002 | 0.0005 | 0.003 | 0.005 | <0.0005 | 0.002 | 0.1 |
| | A9 | 3.3 | 0.002 | 0.0005 | 0.001 | 0.001 | 0.005 | 0.002 | 0.1 |
| | A10 | 3.3 | 0.0015 | 0.0005 | 0.001 | 0.001 | <0.0005 | 0.002 | 0.1 |
| | A11 | 3.3 | 0.0015 | 0.0005 | 0.001 | 0.001 | <0.0005 | 0.002 | 0.15 |
| | A12 | 3.3 | 0.005 | 0.0005 | 0.005 | 0.001 | <0.0005 | 0.002 | 0.1 |
| COMPAR-ATIVE EXAMPLE | A13 | 0.5 | 0.008 | 0.0005 | 0.0005 | 0.001 | <0.0005 | 0.002 | 0.1 |
| | A14 | 7.1 | 0.002 | 0.0005 | 0.001 | 0.001 | <0.0005 | 0.002 | 0.1 |
| | A15 | 3.3 | <0.0001 | 0.0005 | 0.001 | 0.001 | <0.0005 | 0.002 | 0.1 |
| | A16 | 3.3 | 0.01 | 0.0005 | 0.001 | 0.001 | <0.0005 | 0.002 | 0.1 |
| | A17 | 3.3 | 0.001 | 0.0005 | 0.001 | 0.001 | <0.0005 | 0.008 | 0.1 |
| | A18 | 3.3 | 0.001 | 0.0005 | 0.001 | | <0.0005 | 0.002 | 1.1 |
| | A19 | 3.3 | 0.001 | 0.008 | 0.0005 | 0.001 | <0.0005 | 0.002 | 0.1 |
| | A20 | 3.3 | 0.005 | 0.0005 | 0.01 | 0.004 | <0.0005 | 0.002 | 0.1 |
| | A21 | 3.3 | 0.002 | 0.0005 | 0.001 | 0.007 | <0.0005 | 0.002 | 0.1 |
| | A22 | 3.3 | 0.002 | 0.0005 | 0.001 | 0.001 | 0.007 | 0.002 | 0.1 |

TABLE 3

| TEST | TEST No. | STEEL SHEET No. | COATING FILM FORMING COMPOUND FORSTERITE (mass %) | GDS EMISSION INTENSITY PEAK POSITION OCCURRENCE TIME tB/tMg比 | COATING FILM ADHESIVENESS COATING FILM PEELED AREA (%) | MAGNETIC PROPERTY MAGNETIC FLUX DENSITY B8 (T) |
|---|---|---|---|---|---|---|
| INVENTION EXAMPLE | B1 | A1 | 70 | 1.7 | 5 | 1.893 |
| | B2 | A2 | 90 | 1.8 | 5 | 1.900 |
| | B3 | A3 | 95 | 1.6 | 5 | 1.918 |
| | B4 | A4 | 90 | 1.9 | 0 | 1.905 |
| | B5 | A5 | 95 | 3.9 | 5 | 1.922 |
| | B6 | A6 | 95 | 3.2 | 5 | 1.891 |
| | B7 | A7 | 90 | 1.6 | 0 | 1.926 |
| | B8 | A8 | 95 | 3.6 | 0 | 1.920 |
| | B9 | A9 | 90 | 3.4 | 0 | 1.906 |
| | B10 | A10 | 95 | 2.5 | 0 | 1.902 |
| | B11 | A11 | 95 | 3.1 | 0 | 1.924 |
| | B12 | A12 | 95 | 5 | 0 | 1.925 |
| COMPAR-ATIVE EXAMPLE | b1 | A13 | 65 | 0.8 | 15 | 1.875 |
| | b2 | A14 | 90 | 0.5 | 40 | 1.660 |
| | b3 | A15 | 70 | 0.7 | 20 | 1.861 |
| | b4 | A16 | 90 | 1.5 | 0 | 1.752 |
| | b5 | A17 | 60 | UNCLEAR | 60 | 1.653 |
| | b6 | A18 | 90 | 0.8 | 10 | 1.752 |
| | b7 | A19 | 95 | 0.1 | 60 | 1.788 |
| | b8 | A20 | 95 | 8.3 | 0 | 1.746 |
| | b9 | A21 | 90 | 4.6 | 5 | 1.658 |
| | b10 | A22 | 90 | 3.2 | 10 | 1.685 |

As shown in Table 2 and Table 3, it is found that when the steel sheet has the composition falling within the range of the present invention, an amount of forsterite of the glass coating film is 70% or more, and tB/tMg of the peak positions of Mg and B in a GDS profile is 1.6 or more, the adhesiveness and the magnetic flux density are good. Particularly, when tB/tMg is 2.0 or more, the adhesiveness is particularly good. On the other hand, when tB/tMg exceeds 5.0, the magnetic property deteriorates, and thus the upper limit of tB/tMg is 5. As for the amount of forsterite, 70% or more of the amount cannot be obtained when the amounts of Si and Al each do not fall within the range of the present invention.

Example 2

Slabs each having a composition shown in Table 4 and a balance being composed of Fe and inevitable impurities were made. Further, under the temperature conditions shown in Table 5, slab heating and finish rolling were performed, and hot-rolled steel strips each having a thickness of 2.3 mm were obtained. Analysis results of B, BN, MnS, and MnSe of hot-rolled sheets that were subjected to such heat treatments are as shown in Table 6. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and decarburization-annealed steel strips were obtained. Subsequently, the decarburization-annealed steel strips were annealed in an ammonia containing atmosphere to increase nitrogen in the steel strips up to 0.023 mass %. Next, an annealing separating agent having MgO as its main component was applied on the steel strips, and the atmosphere up to 800° C. was set to be the same as that in Example 1, and of the atmosphere from 800° C. to 1100° C., the nitrogen partial pressure $P_{N2}$ was set to 0.5 and the oxygen potential Log $[P_{H2O}/P_{H2}]$ was set to −1, and of the atmosphere at 1100° C. or higher, the nitrogen partial pressure $P_{N2}$ was set to 0.1 or less and the oxygen potential Log $[P_{H2O}/P_{H2}]$ was set to −2 or less, and the steel strips were heated up to 1200° C. at a speed of 15° C./h and were subjected to finish annealing. Then, in the same manner as that in Example 1, the evaluation of tB and tMg was performed by the GDS and further the magnetic property (magnetic flux density B8) was measured. Further, the test of the coating film adhesiveness was also performed. The above results are shown in Table 7.

TABLE 4

| TEST | STEEL MATERIAL No. | CHEMICAL COMPOSITION(mass %) Si | B | C | N | S | Se | Al | Mn |
|---|---|---|---|---|---|---|---|---|---|
| INVENTION EXAMPLE | B1 | 3.3 | 0.002 | 0.06 | 0.008 | 0.007 | — | 0.03 | 0.1 |
| | B2 | 3.3 | 0.002 | 0.05 | 0.008 | 0.006 | 0.006 | 0.03 | 0.1 |
| | B3 | 3.3 | 0.002 | 0.06 | 0.008 | 0.007 | — | 0.03 | 0.1 |
| | B4 | 3.3 | 0.002 | 0.06 | 0.008 | 0.006 | — | 0.03 | 0.1 |
| | B5 | 3.3 | 0.002 | 0.06 | 0.008 | 0.006 | — | 0.03 | 0.1 |
| | B6 | 3.3 | 0.001 | 0.06 | 0.008 | 0.007 | — | 0.03 | 0.1 |
| | B7 | 3.3 | 0.002 | 0.06 | 0.008 | 0.007 | — | 0.03 | 0.1 |
| | B8 | 3.3 | 0.002 | 0.06 | 0.008 | 0.005 | — | 0.03 | 0.1 |
| | B9 | 3.3 | 0.002 | 0.06 | 0.008 | 0.007 | — | 0.03 | 0.1 |
| | B10 | 3.3 | 0.002 | 0.06 | 0.008 | 0.005 | 0.006 | 0.03 | 0.1 |
| COMPARATIVE EXAMPLE | B11 | 3.3 | 0.002 | 0.06 | 0.008 | 0.007 | — | 0.03 | 0.1 |
| | B12 | 3.3 | 0.002 | 0.05 | 0.008 | 0.006 | 0.006 | 0.03 | 0.1 |
| | B13 | 3.3 | 0.002 | 0.06 | 0.008 | 0.007 | — | 0.03 | 0.1 |
| | B14 | 3.3 | 0.002 | 0.06 | 0.008 | 0.006 | — | 0.03 | 0.1 |
| | B15 | 3.3 | 0.002 | 0.06 | 0.008 | 0.006 | — | 0.03 | 0.1 |
| | B16 | 3.3 | 0.001 | 0.06 | 0.008 | 0.007 | — | 0.03 | 0.1 |
| | B17 | 3.3 | 0.002 | 0.06 | 0.008 | 0.007 | — | 0.03 | 0.1 |
| | B18 | 3.3 | 0.002 | 0.06 | 0.008 | 0.002 | 0.002 | 0.03 | 0.1 |

TABLE 5

| TEST | STEEL MATERIAL No. | TEST No. | SLAB HEATING: HEATING TEMPERATURE (° C.) | T1 (° C.) | T2 (° C.) | T3 (° C.) | FINISH ROLLING: FINISHING TEMPERATURE Tf (° C.) | 1000-10000 × [B] |
|---|---|---|---|---|---|---|---|---|
| INVENTION EXAMPLE | B1 | D1 | 1216 | 1216 | — | 1220 | 900 | 980 |
| | B2 | D2 | 1197 | 1206 | 1197 | 1220 | 900 | 980 |
| | B3 | D3 | 1220 | 1216 | — | 1220 | 900 | 980 |
| | B4 | D4 | 1150 | 1206 | — | 1220 | 980 | 980 |
| | B5 | D5 | 1150 | 1206 | — | 1220 | 800 | 980 |
| | B6 | D6 | 1150 | 1216 | — | 1179 | 900 | 990 |
| | B7 | D7 | 1150 | 1216 | — | 1220 | 900 | 980 |
| | B8 | D8 | 1150 | 1195 | — | 1220 | 900 | 980 |
| | B9 | D9 | 1150 | 1216 | — | 1220 | 900 | 980 |
| | B10 | D10 | 1150 | 1195 | 1197 | 1220 | 900 | 980 |
| COMPARATIVE EXAMPLE | B11 | d1 | 1230 | 1216 | — | 1220 | 900 | 980 |
| | B12 | d2 | 1210 | 1206 | 1197 | 1220 | 900 | 980 |
| | B13 | d3 | 1240 | 1216 | — | 1220 | 900 | 980 |
| | B14 | d4 | 1150 | 1206 | — | 1220 | 1000 | 980 |
| | B15 | d5 | 1150 | 1206 | — | 1220 | 780 | 980 |
| | B16 | d6 | 1280 | 1216 | — | 1179 | 900 | 990 |
| | B17 | d7 | 1280 | 1216 | — | 1220 | 900 | 980 |
| | B18 | d8 | 1280 | 1139 | — | 1220 | 900 | 980 |

TABLE 6

| TEST | STEEL MATERIAL No. | TEST No. | PRECIPITATES IN HOT-ROLLED STEEL STRIP B as BN (%) | [B] − B as BN (%) | S as MnS + 0.5 × Se as MnSe (%) |
|---|---|---|---|---|---|
| INVENTION EXAMPLE | B1 | D1 | 0.0015 | 0.0005 | 0.005 |
| | B2 | D2 | 0.0015 | 0.0005 | 0.01 |
| | B3 | D3 | 0.0015 | 0.0005 | 0.004 |
| | B4 | D4 | 0.0015 | 0.0005 | 0.005 |
| | B5 | D5 | 0.0015 | 0.0005 | 0.005 |
| | B6 | D6 | 0.0005 | 0.0005 | 0.005 |
| | B7 | D7 | 0.001 | 0.001 | 0.005 |
| | B8 | D8 | 0.0015 | 0.0005 | 0.002 |
| | B9 | D9 | 0.0017 | 0.0005 | 0.006 |
| | B10 | D10 | 0.0018 | 0.0005 | 0.009 |
| COMPARATIVE EXAMPLE | B11 | d1 | 0.0011 | 0.0009 | 0.005 |
| | B12 | d2 | 0.0013 | 0.0007 | 0.005 |
| | B13 | d3 | 0.0011 | 0.0009 | 0.006 |
| | B14 | d4 | 0.0012 | 0.0008 | 0.004 |
| | B15 | d5 | 0.0011 | 0.0009 | 0.005 |
| | B16 | d6 | 0.0003 | 0.0007 | 0.005 |
| | B17 | d7 | 0.0005 | 0.0015 | 0.005 |
| | B18 | d8 | 0.0013 | 0.0007 | 0.001 |

the temperatures T1, T2, and T3 in the slab heating temperature, the good coating film adhesiveness and magnetic flux density were obtained.

As is clear from the above, according to the operation conditions in the range of the present invention, it is possible to obtain the grain-oriented electrical steel sheet having the good magnetic property and coating film adhesiveness.

Example 3

Slabs each having a composition shown in Table 8 and a balance being composed of Fe and inevitable impurities were made. Next, under the conditions shown in Table 9, the slabs were heated and then were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and decarburization-annealed steel strips were obtained. Subsequently, the decarburization-annealed steel strips were annealed in an ammonia containing atmosphere to increase nitrogen in the steel strips up to 0.022 mass %. Next, an annealing separating agent having MgO as its main component was applied on the steel strips, and the atmosphere up to 800° C. was set to be the same as that in Example 1, and of the atmosphere from 800° C. to 1100° C., the nitrogen partial pressure $P_{N2}$ was set to 0.5 and the oxygen potential Log $[P_{H2O}/P_{H2}]$ was set to −1, and of the atmosphere at 1100° C. or higher, the nitrogen partial pressure $P_{N2}$ was set to 0.1 or less and the oxygen potential Log $[P_{H2O}/P_{H2}]$ was set to −2, and the steel strips were heated up to 1200° C. at a speed of 15° C./h and were subjected to finish annealing. Then, in the same manner as that in Example 1, the evaluation of tB and tMg was performed by the GDS and further the coating film adhesiveness and the magnetic property (magnetic flux density B8) were measured. The above results are shown in Table 10.

TABLE 7

| TEST | STEEL MATERIAL No. | TEST No. | COATING FILM FORMING COMPOUND FORSTERITE (mass %) | GDS EMISSION INTENSITY PEAK POSITION OCCURRENCE TIME tB/tMg比 | COATING FILM ADHESIVENESS COATING FILM PEELED AREA (%) | MAGNETIC PROPERTY MAGNETIC FLUX DENSITY B8 (T) |
|---|---|---|---|---|---|---|
| INVENTION EXAMPLE | B1 | D1 | 90 | 2.1 | 5 | 1.901 |
| | B2 | D2 | 95 | 2.5 | 0 | 1.923 |
| | B3 | D3 | 90 | 2.6 | 0 | 1.904 |
| | B4 | D4 | 95 | 2.9 | 5 | 1.918 |
| | B5 | D5 | 95 | 2.5 | 5 | 1.921 |
| | B6 | D6 | 90 | 3.1 | 0 | 1.906 |
| | B7 | D7 | 95 | 2.6 | 0 | 1.923 |
| | B8 | D8 | 90 | 2.4 | 0 | 1.914 |
| | B9 | D9 | 95 | 3.8 | 0 | 1.920 |
| | B10 | D10 | 95 | 2.8 | 0 | 1.922 |
| COMPARATIVE EXAMPLE | B11 | d1 | 95 | 1 | 15 | 1.876 |
| | B12 | d2 | 95 | 1 | 20 | 1.875 |
| | B13 | d3 | 90 | 0.9 | 15 | 1.870 |
| | B14 | d4 | 90 | 0.9 | 20 | 1.877 |
| | B15 | d5 | 95 | 1 | 20 | 1.795 |
| | B16 | d6 | 90 | UNCLEAR | 30 | 1.865 |
| | B17 | d7 | 90 | 1 | 20 | 1.874 |
| | B18 | d8 | 90 | 0.9 | 10 | 1.870 |

As shown in Table 7, in the case of Test No. d1 to Test No. d3, the slab heating temperature was higher than T1, so that the coating film adhesiveness was poor and the magnetic flux density was also low. Further, in the case of Test No. d4, the finishing temperature Tf of the finish rolling was higher than 1000−10000×[B], so that the coating film adhesiveness was poor. Further, in the case of Test No. d5, the finishing temperature Tf of the finish rolling did not reach 800° C., so that the coating film adhesiveness was poor and the magnetic flux density was also low. In the case of Test No. d6 and Test No. d7, the slab heating temperature was higher than T1 and T3, and further $B_{asBN}$ was less than 0.0005 and $[B]-B_{asBN}$ was greater than 0.001, so that the coating film adhesiveness was poor and the magnetic flux density was also low. In the case of Test No. d8, the value of $S_{asMnS}+0.5\times Se_{asMnSe}$ was less than 0.002, so that the magnetic flux density was low. On the other hand, in the case of Test No. D1 to Test No. D10 each being an invention example in which the slab heating temperature is equal to or lower than

TABLE 8

| | No. | STEEL MATERIAL No. | CHEMICAL COMPOSITION(mass %) Si | Al | B | C | N | S | Se | Mn | Cr | Cu | Ni | P | Mo | Sn | Sb | Bi |
|---|---|---|---|---|---|---|---|---|---|---|---|---|---|---|---|---|---|---|
| INVENTION EXAMPLE | E1 | C1 | 4 | 0.03 | 0.002 | 0.06 | 0.008 | 0.007 | — | 0.1 | — | — | — | — | — | — | — | — |
| | E2 | C2 | 1.5 | 0.03 | 0.002 | 0.05 | 0.008 | 0.006 | 0.006 | 0.1 | — | — | — | — | — | — | — | — |
| | E3 | C3 | 3.3 | 0.065 | 0.002 | 0.06 | 0.008 | 0.007 | — | 0.1 | — | — | — | — | — | — | — | — |
| | E4 | C4 | 3.3 | 0.01 | 0.002 | 0.06 | 0.008 | 0.006 | — | 0.1 | — | — | — | — | — | — | — | — |
| | E5 | C5 | 3.3 | 0.03 | 0.002 | 0.06 | 0.012 | 0.006 | — | 0.1 | — | — | — | — | — | — | — | — |
| | E6 | C6 | 3.3 | 0.03 | 0.002 | 0.06 | 0.004 | 0.007 | — | 0.1 | — | — | — | — | — | — | — | — |
| | E7 | C7 | 3.3 | 0.03 | 0.002 | 0.06 | 0.008 | 0.007 | — | 0.3 | — | — | — | — | — | — | — | — |
| | E8 | C8 | 3.3 | 0.03 | 0.002 | 0.06 | 0.008 | 0.005 | — | 0.05 | — | — | — | — | — | — | — | — |
| | E9 | C9 | 3.3 | 0.03 | 0.008 | 0.06 | 0.008 | 0.007 | — | 0.1 | — | — | — | — | — | — | — | — |
| | E10 | C10 | 3.3 | 0.03 | 0.0005 | 0.06 | 0.008 | 0.005 | 0.006 | 0.1 | — | — | — | — | — | — | — | — |
| | E11 | C11 | 3.3 | 0.03 | 0.002 | 0.06 | 0.008 | 0.015 | — | 0.1 | — | — | — | — | — | — | — | — |
| | E12 | C12 | 3.3 | 0.03 | 0.002 | 0.06 | 0.008 | 0.003 | — | 0.1 | — | — | — | — | — | — | — | — |
| | E13 | C13 | 3.3 | 0.03 | 0.002 | 0.06 | 0.008 | 0.005 | 0.001 | 0.1 | — | — | — | — | — | — | — | — |
| | E14 | C14 | 3.3 | 0.03 | 0.002 | 0.06 | 0.008 | 0.001 | 0.002 | 0.1 | — | — | — | — | — | — | — | — |
| | E15 | C15 | 3.3 | 0.03 | 0.002 | 0.085 | 0.008 | 0.005 | — | 0.1 | — | — | — | — | — | — | — | — |
| | E16 | C16 | 3.3 | 0.03 | 0.002 | 0.06 | 0.008 | 0.005 | — | 0.1 | 0.3 | — | — | — | — | — | — | — |
| | E17 | C17 | 3.3 | 0.03 | 0.002 | 0.06 | 0.008 | 0.005 | — | 0.1 | — | 0.4 | — | — | — | — | — | — |
| | E18 | C18 | 3.3 | 0.03 | 0.002 | 0.06 | 0.008 | 0.005 | — | 0.1 | — | — | 1 | — | — | — | — | — |
| | E19 | C19 | 3.3 | 0.03 | 0.002 | 0.06 | 0.008 | 0.005 | — | 0.1 | — | — | — | 0.5 | — | — | — | — |
| | E20 | C20 | 3.3 | 0.03 | 0.002 | 0.06 | 0.008 | 0.005 | — | 0.1 | — | — | — | — | 0.1 | — | — | — |
| | E21 | C21 | 3.3 | 0.03 | 0.002 | 0.06 | 0.008 | 0.005 | — | 0.1 | — | — | — | — | — | 0.3 | — | — |
| | E22 | C22 | 3.3 | 0.03 | 0.002 | 0.06 | 0.008 | 0.005 | — | 0.1 | — | — | — | — | — | — | 0.3 | — |
| | E23 | C23 | 3.3 | 0.03 | 0.002 | 0.06 | 0.008 | 0.005 | — | 0.1 | — | — | — | — | — | — | — | 0.01 |
| COMPARATIVE EXAMPLE | e1 | C24 | 3.3 | 0.03 | 0.002 | 0.06 | 0.008 | 0.005 | — | 0.1 | 0.5 | — | — | — | — | — | — | — |
| | e2 | C25 | 3.3 | 0.03 | 0.002 | 0.06 | 0.008 | 0.005 | — | 0.1 | — | 0.5 | — | — | — | — | — | — |
| | e3 | C26 | 3.3 | 0.03 | 0.002 | 0.06 | 0.008 | 0.005 | — | 0.1 | — | — | 1.2 | — | — | — | — | — |
| | e4 | C27 | 3.3 | 0.03 | 0.002 | 0.06 | 0.008 | 0.005 | — | 0.1 | — | — | — | 0.6 | — | — | — | — |
| | e5 | C28 | 3.3 | 0.03 | 0.002 | 0.06 | 0.008 | 0.005 | — | 0.1 | — | — | — | — | 0.2 | — | — | — |
| | e6 | C29 | 3.3 | 0.03 | 0.002 | 0.06 | 0.008 | 0.005 | — | 0.1 | — | — | — | — | — | 0.4 | — | — |
| | e7 | C30 | 3.3 | 0.03 | 0.002 | 0.06 | 0.008 | 0.005 | — | 0.1 | — | — | — | — | — | — | 0.4 | — |
| | e8 | C31 | 3.3 | 0.03 | 0.002 | 0.06 | 0.008 | 0.005 | — | 0.1 | — | — | — | — | — | — | — | 0.011 |

TABLE 9

| TEST | TEST No. | STEEL MATERIAL No. | SLAB HEATING HEATING TEMPERATURE (° C.) | T1 (° C.) | T2 (° C.) | T3 (° C.) |
|---|---|---|---|---|---|---|
| INVENTION EXAMPLE | E1 | C1 | 1170 | 1216 | — | 1220 |
| | E2 | C2 | 1170 | 1206 | 1197 | 1220 |
| | E3 | C3 | 1170 | 1216 | — | 1220 |
| | E4 | C4 | 1170 | 1206 | — | 1220 |
| | E5 | C5 | 1170 | 1206 | — | 1245 |
| | E6 | C6 | 1170 | 1216 | — | 1179 |
| | E7 | C7 | 1170 | 1291 | — | 1220 |
| | E8 | C8 | 1100 | 1152 | — | 1220 |
| | E9 | C9 | 1170 | 1216 | — | 1309 |
| | E10 | C10 | 1100 | 1195 | 1197 | 1141 |
| | E11 | C11 | 1170 | 1267 | — | 1220 |
| | E12 | C12 | 1100 | 1163 | — | 1220 |
| | E13 | C13 | 1170 | — | 1282 | 1220 |
| | E14 | C14 | 1100 | — | 1139 | 1220 |
| | E15 | C15 | 1170 | 1195 | — | 1220 |
| | E16 | C16 | 1170 | 1195 | — | 1220 |

TABLE 9-continued

| TEST | TEST No. | STEEL MATERIAL No. | SLAB HEATING HEATING TEMPERATURE (° C.) | T1 (° C.) | T2 (° C.) | T3 (° C.) |
|---|---|---|---|---|---|---|
| | E17 | C17 | 1170 | 1195 | — | 1220 |
| | E18 | C18 | 1170 | 1195 | — | 1220 |
| | E19 | C19 | 1170 | 1195 | — | 1220 |
| | E20 | C20 | 1170 | 1195 | — | 1220 |
| | E21 | C21 | 1170 | 1195 | — | 1220 |
| | E22 | C22 | 1170 | 1195 | — | 1220 |
| | E23 | C23 | 1170 | 1195 | — | 1220 |
| COMPARATIVE EXAMPLE | e1 | C24 | 1170 | 1195 | — | 1220 |
| | e2 | C25 | 1170 | 1195 | — | 1220 |
| | e3 | C26 | 1170 | 1195 | — | 1220 |
| | e4 | C27 | 1170 | 1195 | — | 1220 |
| | e5 | C28 | 1170 | 1195 | — | 1220 |
| | e6 | C29 | 1170 | 1195 | — | 1220 |
| | e7 | C30 | 1170 | 1195 | — | 1220 |
| | e8 | C31 | 1170 | 1195 | — | 1220 |

TABLE 10

| TEST | TEST No. | STEEL MATERIAL No. | COATING FILM FORMING COMPOUND FORSTERITE (mass %) | GDS EMISSION INTENSITY PEAK POSITION OCCURRENCE TIME tB/tMg比 | COATING FILM ADHESIVENESS COATING FILM PEELED AREA (%) | MAGNETIC PROPERTY MAGNETIC FLUX DENSITY B8 (T) |
|---|---|---|---|---|---|---|
| INVENTION EXAMPLE | E1 | C1 | 95 | 3.1 | 5 | 1.920 |
| | E2 | C2 | 90 | 3.2 | 0 | 1.883 |
| | E3 | C3 | 95 | 2.8 | 0 | 1.919 |
| | E4 | C4 | 90 | 3.2 | 5 | 1.891 |
| | E5 | C5 | 95 | 3.3 | 5 | 1.918 |
| | E6 | C6 | 95 | 3.4 | 0 | 1.921 |

TABLE 10-continued

| TEST | TEST No. | STEEL MATERIAL No. | COATING FILM FORMING COMPOUND FORSTERITE (mass %) | GDS EMISSION INTENSITY PEAK POSITION OCCURRENCE TIME tB/tMg比 | COATING FILM ADHESIVENESS COATING FILM PEELED AREA (%) | MAGNETIC PROPERTY MAGNETIC FLUX DENSITY B8 (T) |
|---|---|---|---|---|---|---|
| | E7 | C7 | 90 | 2.8 | 0 | 1.900 |
| | E8 | C8 | 95 | 2.9 | 0 | 1.917 |
| | E9 | C9 | 90 | 2.6 | 0 | 1.918 |
| | E10 | C10 | 95 | 3.5 | 0 | 1.924 |
| | E11 | C11 | 95 | 3.2 | 5 | 1.916 |
| | E12 | C12 | 95 | 2.8 | 0 | 1.922 |
| | E13 | C13 | 90 | 3.4 | 0 | 1.886 |
| | E14 | C14 | 95 | 3.1 | 0 | 1.910 |
| | E15 | C15 | 95 | 3.3 | 5 | 1.923 |
| | E16 | C16 | 90 | 2.9 | 0 | 1.917 |
| | E17 | C17 | 60 | 3.4 | 0 | 1.902 |
| | E18 | C18 | 90 | 3 | 0 | 1.916 |
| | E19 | C19 | 95 | 2.9 | 5 | 1.919 |
| | E20 | C20 | 95 | 2.7 | 5 | 1.921 |
| | E21 | C21 | 90 | 3.9 | 0 | 1.886 |
| | E22 | C22 | 95 | 3.4 | 5 | 1.925 |
| | E23 | C23 | 95 | 3.3 | 5 | 1.923 |
| COMPAR- | e1 | C24 | 95 | 1 | 5 | 1.876 |
| ATIVE | e2 | C25 | 90 | 0.9 | 10 | 1.876 |
| EXAMPLE | e3 | C26 | 95 | 1 | 30 | 1.870 |
| | e4 | C27 | 95 | 0.8 | 20 | 1.872 |
| | e5 | C28 | 90 | 0.8 | 10 | 1.795 |
| | e6 | C29 | 95 | 0.8 | 10 | 1.865 |
| | e7 | C30 | 95 | 1 | 20 | 1.878 |
| | e8 | C31 | 90 | 1 | 20 | 1.755 |

As is clear from Table 8 and Table 10, in comparative examples each having the composition of the material falling outside the range of the present invention, the coating film adhesiveness deteriorated and the magnetic flux density was low. However, in invention examples E1 to E 23 each having the composition of the material falling within the range of the present invention, the good coating film adhesiveness and magnetic flux density were obtained.

Example 4

The following experiment was performed with the aim of examining effects of the atmosphere from 800° C. to 1100° C. and a switching temperature. First, slabs each having a composition composed of Si: 3.4 mass %, B: 0.0025 mass %, C: 0.06 mass %, N: 0.008 mass %, S: 0.007 mass %, and Al 0.03 mass % and having a balance being composed of Fe and inevitable impurities were made. Next, the slabs were heated at 1100° C., and thereafter were subjected to finish rolling at 900° C. The heating temperature of 1100° C. was a value falling below all the values of the temperatures T1, T2, and T3 calculated from the above-described composition. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and decarburization-annealed steel strips were obtained. Subsequently, the decarburization-annealed steel strips were annealed in an ammonia containing atmosphere to increase nitrogen in the steel strips up to 0.023 mass %. Next, an annealing separating agent having MgO as its main component was applied on the steel strips, and the atmosphere up to a temperature of A1 in Table 11 was set to be the same as that in Example 1, and at switching temperatures A1 and A2 in Table 11, the atmosphere in Table 11 was made, and at a temperature higher than the temperature A2, the nitrogen partial pressure $P_{N2}$ was set to 0.05 and the oxygen potential Log $[P_{H2O}/P_{H2}]$ was set to −2 or less, and the steel strips were heated up to 1200° C. at a speed of 15° C./h and after reaching 1200° C., the steel strips were subjected to finish annealing in an atmosphere of 100% hydrogen.

On each of such samples obtained after the finish annealing, the situation of coating films and the magnetic property (magnetic flux density B8) were measured. First, with regard to the situation of coating films, an amount of forsterite of a glass coating film and peak positions of Mg and B by the GDS were examined. The amount of forsterite was 70% or more in all the samples. Before performing the measurement by the GDS, a coating solution composed of 100 g of an aluminum biphosphate solution having a solid content concentration of 50%, 102 g of colloidal silica having a solid content concentration of 20%, and 5.4 g of chromic anhydride was made. Then, the coating solution was applied on a steel sheet having the glass coating film obtained after the finish annealing to be 5 g/m$^2$ per one side after being baked and was dried, and then was baked at 900° C. The thickness of a secondary coating film was 1.5 μm in this case.

Further, the magnetic property (magnetic flux density B8) was measured based on JIS C2556. Further, the coating film adhesiveness was also tested by the following procedures. First, a coating solution composed of 100 g of an aluminum biphosphate solution having a solid content concentration of 50%, 102 g of colloidal silica having a solid content concentration of 20%, and 5.4 g of chromic anhydride was made. Then, the coating solution was applied on the steel sheet having the glass coating film obtained after the finish annealing to be 10 g/m$^2$ per one side after being baked and was dried, and then was baked at 900° C. This steel sheet was wound around a round bar having a diameter of 20ϕ and then a peeled area of the coating film to expose the steel sheet on the inner side of the bent portion was measured. When the peeled area was 5% or less, the adhesiveness was determined to be good. Results of the above test are shown in Table 11.

TABLE 11

| TEST | No. | SWITCHING TEMPERATURE (° C.) A1 | A2 | ATMOSPHERE PN2 | Log(PH2O/PH2) | tMg/tB | B8 | ADHESIVENESS |
|---|---|---|---|---|---|---|---|---|
| INVENTION EXAMPLE | F1 | 800 | 1100 | 0.2 | −1 | 3.6 | 1.923 | ○ |
| | F2 | 800 | 1100 | 0.75 | −1 | 2.9 | 1.915 | ○ |
| | F3 | 800 | 1100 | 0.5 | −0.7 | 3.4 | 1.931 | ○ |
| | F4 | 800 | 1100 | 0.5 | −1 | 3.6 | 1.932 | ○ |
| COMPARATIVE EXAMPLE | f1 | 800 | 1100 | 0.1 | 0.2 | 0.7 | 1.890 | X |
| | f2 | 800 | 1100 | 0.9 | −1 | 5.6 | 1.872 | ○ |
| | f3 | 800 | 1100 | 0.5 | −0.5 | 0.8 | 1.892 | X |
| | f4 | 700 | 1100 | 0.5 | −1 | 0.9 | 1.909 | X |
| | f5 | 900 | 1100 | 0.5 | −1 | 0.7 | 1.879 | X |
| | f6 | 800 | 1000 | 0.5 | −1 | 1 | 1.889 | X |
| | f7 | 800 | 1150 | 0.5 | −1 | 5.2 | 1.869 | ○ |

As shown in Table 11, in the case of Test No. f1, the nitrogen partial pressure $P_{N2}$ from 800° C. to 1100° C. was too small, so that the decomposition of BN advanced, B was concentrated in the vicinity of the surface, and the ratio tB/tMg became small to make it impossible to obtain the coating film adhesiveness improving effect. Further, in the case of Test No. f2, the nitrogen partial pressure $P_{N2}$ was too high, so that the coating film adhesiveness was good but it was impossible to obtain the good magnetic property. In the case of Test No. f3, the oxygen potential Log $[P_{H2O}/P_{H2}]$ was too high, so that the decomposition of BN advanced, the magnetic flux density was poor, and the ratio tB/tMg became too small to make it impossible to obtain the coating film adhesiveness improving effect.

On the other hand, in Test No. f4 in which the atmosphere switching temperature was changed, the switching temperature A1 was too low to thus make it impossible to obtain the adhesiveness improving effect. In Test No. f5, the switching temperature A1 was too high, so that the decomposition of BN by oxidation was accelerated, the ratio tB/tMg became an inappropriate value, and the magnetic flux density B8 was also poor. In Test No. f6, the switching temperature A2 was too low, so that the decomposition of BN was accelerated, the ratio tB/tMg became an inappropriate value, and the magnetic flux density B8 was also poor. In Test No. f7, the switching temperature A2 was too high, so that the decomposition of BN was slow, the ratio tB/tMg was too large, and the magnetic property was poor.

As is clear from the above, when the operation conditions of the present invention are set, it is possible to obtain the grain-oriented electrical steel sheet having the good magnetic property and coating film adhesiveness.

Example 5

The following experiment was performed with the aim of examining better conditions of the atmosphere from 800° C. to 1100° C. First, slabs each having a composition composed of Si: 3.4 mass %, B: 0.0025 mass %, C: 0.06 mass %, N: 0.008 mass %, S: 0.007 mass %, and Al 0.03 mass % and having a balance being composed of Fe and inevitable impurities were made. Next, the slabs were heated at 1100° C., and thereafter were subjected to finish rolling at 900° C. The heating temperature of 1100° C. was a value falling below all the values of T1, T2, and T3 calculated from the above-described composition. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and decarburization-annealed steel strips were obtained. Subsequently, the decarburization-annealed steel strips were annealed in an ammonia containing atmosphere to increase nitrogen in the steel strips up to 0.023 mass %. Next, an annealing separating agent having MgO as its main component was applied on the steel strips, and the atmosphere up to the temperature of A1 in Table 12 was set to be the same as that in Example 1, and at the switching temperatures A1 and A2 in Table 12, the atmosphere in Table 12 was made, and at a temperature higher than the temperature A2, the nitrogen partial pressure $P_{N2}$ was set to 0.05 and the oxygen potential Log $[P_{H2O}/P_{H2}]$ was set to −2 or less, and the steel strips were heated up to 1200° C. at a speed of 15° C./h and after reaching 1200° C., the steel strips were subjected to finish annealing in an atmosphere of 100% hydrogen.

On each of such samples obtained after the finish annealing, the situation of coating films and the magnetic property (magnetic flux density B8) were measured. First, with regard to the situation of coating films, an amount of forsterite of a glass coating film layer and peak positions of Mg and B by the GDS were examined. The amount of forsterite was 70% or more in all the samples. Before performing the measurement by the GDS, a coating solution composed of 100 g of an aluminum biphosphate solution having a solid content concentration of 50%, 102 g of colloidal silica having a solid content concentration of 20%, and 5.4 g of chromic anhydride was made. Then, the coating solution was applied on a steel sheet having the glass coating film obtained after the finish annealing to be 5 g/m$^2$ per one side after being baked and was dried, and then was baked at 900° C. The thickness of a secondary coating film was 1.5 μm in this case.

Further, the magnetic property (magnetic flux density B8) was measured based on JIS C2556. Further, the coating film adhesiveness was also tested by the following procedures. First, a coating solution composed of 100 g of an aluminum biphosphate solution having a solid content concentration of 50%, 102 g of colloidal silica having a solid content concentration of 20%, and 5.4 g of chromic anhydride was made. Then, in order to obtain particularly high tension, the coating solution was applied on the steel sheet having the glass coating film obtained after the finish annealing to be 12 g/m$^2$ per one side after being baked and was dried, and then was baked at 900° C. This steel sheet was wound around a round bar having a diameter of 20ϕ and then a peeled area of the coating film to expose the steel sheet on the inner side of the bent portion was measured. When the peeled area was 5% or less, the adhesiveness was determined to be good. Results of the above test are shown in Table 12.

TABLE 12

| TEST | No. | SWITCHING TEMPERATURE (° C.) A1 | A2 | ATMOSPHERE $3\text{Log}[P_{H2O}/P_{H2}] + A$ | $\text{Log}[P_{H2O}/P_{H2}]$ | tMg/tB | B8 | ADHESIVENESS |
|---|---|---|---|---|---|---|---|---|
| INVENTION EXAMPLE | G1 | 800 | 1100 | −3.7 | −1 | 3.9 | 1.925 | ○ |
| | G2 | 800 | 1100 | −5.3 | −1 | 4.1 | 1.931 | ○ |
| | G3 | 800 | 1100 | −4.2 | −1 | 3.8 | 1.929 | ○ |
| | G4 | 800 | 1100 | −4.2 | −0.7 | 4.2 | 1.919 | ○ |
| COMPARATIVE EXAMPLE | g1 | 800 | 1100 | −5.9 | −1 | 1.7 | 1.905 | X |
| | g2 | 800 | 1100 | −3.3 | −1 | 5.8 | 1.879 | ○ |
| | g3 | 800 | 1100 | −4.2 | 0.2 | 1.0 | 1.895 | X |
| | g4 | 800 | 1100 | −3.4 | 0.2 | 0.9 | 1.874 | X |
| | g5 | 800 | 1100 | −5.9 | 0.2 | 0.9 | 1.875 | X |
| | g6 | 700 | 1100 | −4.2 | −1 | 0.7 | 1.910 | X |
| | g7 | 900 | 1100 | −4.2 | −1 | 0.8 | 1.869 | X |
| | g8 | 800 | 1000 | −4.3 | −1 | 0.9 | 1.871 | X |
| | g9 | 800 | 1150 | −4.2 | −1 | 6.0 | 1.872 | ○ |

As shown in Table 12, in the case of Test No. g1, 3 Log $[P_{H2O}/P_{H2}]+A$ in (11) Expression from 800° C. to 1100° C. was lower than the best condition, so that the decomposition of BN advanced easily, and as compared to the best condition, B was concentrated in the vicinity of the surface and the ratio tB/tMg became small, and in the case of this embodiment example having high coating film tension in particular, the coating film adhesiveness was not good. Further, in the case of Test No. g2, 3 Log $[P_{H2O}/P_{H2}]+A$ in (11) Expression was too high, so that the coating film adhesiveness was good, but it was impossible to obtain the good magnetic property. In the case of Test No. g3, the oxygen potential Log $[P_{H2O}/P_{H2}]$ was too high, so that the ratio tb/tMg became an inappropriate value to make it impossible to obtain the good adhesiveness. In the case of Test No. g4 and Test No. g5, the oxygen potential Log $[P_{H2O}/P_{H2}]$ was too high and the value of 3 Log $[P_{H2O}/P_{H2}]+A$ was inappropriate, so that it was impossible to obtain the good magnetic property in both cases, and further in the case of Test No. g5, it was impossible to obtain the good adhesiveness.

On the other hand, in Test No. g6 in which the atmosphere switching temperature was changed, the switching temperature A1 was too low to thus make it impossible to obtain the adhesiveness improving effect. In Test No. g7, the switching temperature A1 was too high, so that the decomposition of BN by oxidation was accelerated, the ratio tB/tMg became an inappropriate value, and the magnetic flux density B8 was poor. In Test No. g8, the switching temperature A2 was too low, so that the decomposition of BN was accelerated, the ratio tB/tMg became an inappropriate value, and the magnetic flux density B8 was also poor. In Test No. g9, the switching temperature A2 was too high, so that the decomposition of BN was slow, the ratio tB/tMg was too large, and the magnetic property was poor.

As is clear from the above, when the operation condition of the finish annealing of the present invention is set to the particularly good nitrogen partial pressure range, it is possible to obtain the grain-oriented electrical steel sheet that has the good coating film adhesiveness in addition to the good magnetic property even though the coating films to generate particularly high tension are formed.

Example 6

The following experiment was performed with the aim of examining conditions of the atmosphere at 1100° C. or higher. First, slabs each having a composition composed of Si: 3.4 mass %, B: 0.0025 mass %, C: 0.06 mass %, N: 0.008 mass %, S: 0.007 mass %, and Al 0.03 mass % and having a balance being composed of Fe and inevitable impurities were made. Next, the slabs were heated at 1100° C., and thereafter were subjected to finish rolling at 900° C. The heating temperature of 1100° C. was a value falling below all the values of T1, T2, and T3 calculated from the above-described composition. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and decarburization-annealed steel strips were obtained. Subsequently, the decarburization-annealed steel strips were annealed in an ammonia containing atmosphere to increase nitrogen in the steel strips up to 0.023 mass %. Next, an annealing separating agent having MgO as its main component was applied on the steel strips, and of the atmosphere up to 800° C., the nitrogen partial pressure $P_{N2}$ was set to 0.5 and the oxygen potential Log $[P_{H2O}/P_{H2}]$ was set to −0.5, and of the atmosphere from 800° C. to 1100° C., the nitrogen partial pressure $P_{N2}$ was set to 0.5 and the oxygen potential Log $[P_{H2O}/P_{H2}]$ was set to −1, and at 1100° C. or higher, the atmosphere shown in Table 13 was made, and the steel strips were heated up to 1200° C. at a speed of 15° C./h and after reaching 1200° C., the steel strips were subjected to finish annealing in an atmosphere of 100% hydrogen.

On each of such samples obtained after the finish annealing, the situation of coating films and the magnetic property (magnetic flux density B8) were measured. First, with regard to the state of coating films, an amount of forsterite of a glass coating film layer and peak positions of Mg and B by the GDS were examined. The amount of forsterite was 70% or more in all the samples. Before performing the measurement by the GDS, a coating solution composed of 100 g of an aluminum biphosphate solution having a solid content concentration of 50%, 102 g of colloidal silica having a solid content concentration of 20%, and 5.4 g of chromic anhydride was made. Then, the coating solution was applied on a steel sheet having the glass coating film obtained after the finish annealing to be 5 g/m$^2$ per one side after being baked and was dried, and then was baked at 900° C. The thickness of a secondary coating film was 1.5 μm in this case.

Further, the magnetic property (magnetic flux density B8) was measured based on JIS C2556. Further, the coating film adhesiveness was also tested by the following procedures. First, a coating solution composed of 100 g of an aluminum biphosphate solution having a solid content concentration of 50%, 102 g of colloidal silica having a solid content concentration of 20%, and 5.4 g of chromic anhydride was made. Then, in order to apply particularly high tension, the coating solution was applied on the steel sheet having the glass coating film obtained after the finish annealing to be 12 g/m$^2$ per one side after being baked and was dried, and then was baked at 900° C. This steel sheet was wound around a round bar having a diameter of 20ϕ and then a peeled area of the coating film to expose the steel sheet on the inner side of the bent portion was measured. When the peeled area was 5% or less, the adhesiveness was determined to be good. Results of the above test are shown in Table 13.

TABLE 13

| TEST | No. | SWITCHING TEMPERATURE A2 | ATMOSPHERE PN2 | Log(PH2O/PH2) | tMg/tB | B8 | ADHESIVENESS |
|---|---|---|---|---|---|---|---|
| INVENTION EXAMPLE | H1 | 1100 | 0.05 | −2 | 3.1 | 1.924 | ○ |
| | H2 | 1100 | 0.05 | −3 | 3.2 | 1.917 | ○ |
| | H3 | 1100 | 0.1 | −2 | 3.1 | 1.901 | ○ |
| COMPARATIVE EXAMPLE | h1 | 1100 | 0.15 | −1 | 5.5 | 1.874 | ○ |
| | h2 | 1100 | 0.1 | 0 | 5.4 | 1.872 | ○ |
| | h3 | 1100 | 0.2 | −2 | 1.7 | 1.880 | X |

As shown in Table 13, in the case of Test No. h1, the nitrogen partial pressure $P_{N2}$ and the oxygen potential Log $[P_{H2O}/P_{H2}]$ at 1100° C. or higher were too high, so that the decomposition of BN did not advance, the ratio tB/tMg was too large, and the magnetic property was poor. Further, in the case of Test No. h2, the oxygen potential Log $[P_{H2O}/P_{H2}]$ was too high, so that the ratio tb/tMg was too large and the magnetic property was poor. In the case of Test No. h3, the nitrogen partial pressure $P_{N2}$ was too high, so that the ratio tB/tMg was too small and when the coating films to generate particularly high tension were formed as was in this embodiment example, it was impossible to obtain the adhesiveness improving effect.

As is clear from the above, when the operation condition of the present invention is set in terms of the finish annealing, it is possible to obtain the grain-oriented electrical steel sheet that has the good coating film adhesiveness in addition to the good magnetic property even though particularly high tension is applied.

INDUSTRIAL APPLICABILITY

The present invention can be utilized in an industry of manufacturing electrical steel sheets and in an industry of utilizing electrical steel sheets, for example.

The invention claimed is:

1. A grain-oriented electrical steel sheet having a composition comprising 0.8 mass % to 7 mass % of Si, 0.05 mass % to 1 mass % of Mn, 0.0005 mass % to 0.0080 mass % of B, 0.005 mass % or less of each of Al, C, N, S and Se, and a balance comprising Fe and inevitable impurities, and having a glass coating film, comprising a composite oxide mainly comprising forsterite on a steel sheet surface, wherein:

a peak position of B in emission intensity from the steel sheet surface is different from and deeper than a peak position of Mg in emission intensity when glow discharge optical emission spectrometry (GDS) is performed, and out of peaks of B in emission intensity observed by the glow discharge optical emission spectrometry (GDS), a peak occurrence time tB of a peak that is the farthest from the steel sheet surface is expressed by the following Expression (1):

$$tMg \times 1.6 \leq tB \leq tMg \times 5 \quad (1)$$

where tMg represents a peak occurrence time of Mg, and the peak position of B, Mg, the values tB and tMg are measured by the GDS on a surface of a secondary coating film containing 26 to 38 mass % of colloidal silica, 4 to 12 mass % of one type or two types selected from the group consisting of chromium anhydride and chromate, and a balance comprising aluminum biphosphate, and having a thickness of not less than 1 μm nor more than 2 μm.

2. A manufacturing method of the grain-oriented electrical steel sheet according to claim 1, comprising:

at a predetermined temperature, heating an electrical steel sheet material containing Si of 0.8 mass % to 7 mass %, acid-soluble Al of 0.01 mass % to 0.065 mass %, N of 0.004 mass % to 0.012 mass %, Mn of 0.05 mass % to 1 mass %, B of 0.0005 mass % to 0.0080 mass %, at least one type selected from a group consisting of S and Se of 0.003 mass % to 0.015 mass % in total amount, a C content of 0.085 mass % or less, and a balance being composed of Fe and inevitable impurities;

performing hot rolling of the heated silicon steel material to obtain a hot-rolled steel strip;

performing annealing of the hot-rolled steel strip to obtain an annealed steel strip;

performing cold rolling of the annealed steel strip one time or more to obtain a cold-rolled steel strip;

performing decarburization annealing of the cold-rolled steel strip to obtain a decarburization-annealed steel strip in which primary recrystallization has been caused;

applying an annealing separating agent having MgO as its main component on the decarburization-annealed steel strip;

finish annealing the decarburization-annealed steel strip and thereby causing secondary recrystallization;

and further performing a nitriding treatment in which an N content in the decarburization-annealed steel strip is increased between start of the decarburization annealing and occurrence of the secondary recrystallization in the finish annealing, wherein the predetermined temperature, when S and Se are contained in the silicon steel material, is a temperature T1

(° C.) expressed by Expression (2) below or lower, a temperature T2 (° C.) expressed by Expression (3) below or lower, and a temperature T3 (° C.) expressed by Expression (4) below or lower, when no Se is contained in the silicon steel material, the predetermined temperature is the temperature T1 (° C.) expressed by Expression (2) below or lower and the temperature T3 (° C.) expressed by Expression (4) below or lower, when no S is contained in the silicon steel material, the predetermined temperature is the temperature T2 (° C.) expressed by Expression (3) below or lower and the temperature T3 (° C.) expressed by Expression (4) below or lower, and a finishing temperature Tf of finish rolling in the hot rolling satisfies Expression (5) below, amounts of BN, MnS, and MnSe in the hot-rolled steel strip satisfy Expressions (6), (7), and (8) below, and at the time of finish annealing, a temperature falls within a temperature range of 800° C. to 1100° C. and an atmosphere satisfies Expressions (9) and (10) below, $$T1=14855/(6.82-\log([Mn]\times[S]))-273 \quad (2)$$

$$T2=10733/(4.08-\log([Mn]\times[Se]))-273 \quad (3)$$

$$T3=16000/(5.92-\log([B]\times[N]))-273 \quad (4)$$

$$Tf\leq 1000-10000\times[B] \quad (5)$$

$$B_{asBN}\geq 0.0005 \quad (6)$$

$$[B]-B_{asBN}\leq 0.001 \quad (7)$$

$$S_{asMnS}+0.5\times Se_{asMnSe}\geq 0.002 \quad (8)$$

$$0.75\geq P_{N2}\geq 0.2 \quad (9)$$

$$-0.7>\mathrm{Log}\ [P_{H2O}/P_{H2}] \quad (10)$$

here, [Mn] represents the Mn content (mass %) of the silicon steel material, [S] represents the S content (mass %) of the silicon steel material, [Se] represents the Se content (mass %) of the silicon steel material, [B] represents the B content (mass %) of the silicon steel material, [N] represents the N content (mass %) of the silicon steel material, $B_{asBN}$ represents an amount of B (mass %) that has precipitated as BN in the hot-rolled steel strip, $S_{asMns}$ represents an amount of S (mass %) that has precipitated as MnS in the hot-rolled steel strip, and $Se_{asMnSe}$ represents an amount of Se (mass %) that has precipitated as MnSe in the hot-rolled steel strip; further, $P_{N2}$ represents a nitrogen partial pressure, and $P_{H2O}$ and $P_{H2}$ represent a water vapor partial pressure and a hydrogen partial pressure respectively.

3. The manufacturing method of the grain-oriented electrical steel sheet according to claim 2, wherein at the time of finish annealing, the temperature falls within the temperature range of 800° C. to 1100° C. and the atmosphere satisfies Expression (11) below, $$4\ \mathrm{Log}\ [P_{N2}]=3\ \mathrm{Log}\ [P_{H2O}/P_{H2}]+A+3455/T \quad (11)$$

here, $-3.72\geq 3\ \mathrm{Log}\ [P_{H2O}/P_{H2}]+A\geq -5.32$ and $-0.7\geq \mathrm{Log}\ [P_{H2O}/P_{H2}]$ are satisfied and A represents a constant determined in such a manner that $3\ \mathrm{Log}\ [P_{H2O}/P_{H2}]+A$ falls within a predetermined range according to $\mathrm{Log}\ [P_{H2O}/P_{H2}]$, and T represents the absolute temperature.

4. The manufacturing method of the grain-oriented electrical steel sheet according to claim 2, wherein at the time of finish annealing, an atmosphere at 1100° C. or higher satisfies Expressions (12) and (13) below, $$0.1\geq P_{N2} \quad (12)$$

$$-2\geq \mathrm{Log}\ [P_{H2O}/P_{H2}] \quad (13).$$

5. The manufacturing method of the grain-oriented electrical steel sheet according to claim 2, wherein the electrical steel sheet material further contains at least one type selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

* * * * *